US006109742A

United States Patent [19]

Higuma et al.

[11] Patent Number: 6,109,742

[45] **Date of Patent: *Aug. 29, 2000**

[54] INK TANK, HEAD CARTRIDGE AND INK JET PRINTING APPARATUS

[75] Inventors: Masahiko Higuma, Togane; Jun Kawai, Tokyo; Yohei Sato; Yoichi Taneya, both of Yokohama; Hiroshi Sugitani, Machida; Tokuya Ohta, Yokohama; Kazuaki Masuda, Kawasaki; Hiroyuki Ishinaga, Tokyo; Torachika Osada, Yamato; Takashi Saito, Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/905,831

[22] Filed: Aug. 4, 1997

Related U.S. Application Data

[63] Continuation of application No. 08/241,636, May 12, 1994, abandoned.

[30] Foreign Application Priority Data

| | | | |
|---|---|---|---|
| May 13, 1993 | [JP] | Japan | 5-111937 |
| May 13, 1993 | [JP] | Japan | 5-111938 |
| May 13, 1993 | [JP] | Japan | 5-111940 |
| May 13, 1993 | [JP] | Japan | 5-350238 |

[51] Int. Cl.[7] ..... B41J 2/185

[52] U.S. Cl. ..... 347/86

[58] Field of Search ..... 347/85–87

[56] References Cited

U.S. PATENT DOCUMENTS

| | | | |
|---|---|---|---|
| 4,540,717 | 9/1985 | Mahnke | 521/52 |
| 4,929,969 | 5/1990 | Morris | 346/140 R |
| 5,079,570 | 1/1992 | Mohr et al. | 346/140 R |
| 5,233,369 | 8/1993 | Carlotta et al. | 347/87 |
| 5,430,471 | 7/1995 | Nakajima et al. | 347/87 |
| 5,489,932 | 2/1996 | Ceschin et al. | 347/87 |
| 5,509,140 | 4/1996 | Koitabashi et al. | 347/86 |
| 5,805,188 | 9/1998 | Nakajima et al. | 347/87 |

FOREIGN PATENT DOCUMENTS

| | | | |
|---|---|---|---|
| 0466142 | 1/1992 | European Pat. Off. . | |
| 488829 | 6/1992 | European Pat. Off. | 347/87 |
| 493058 | 7/1992 | European Pat. Off. | 347/87 |
| 0536980 | 4/1993 | European Pat. Off. . | |
| 0358833 | 3/1990 | Germany . | |
| 22952 | 1/1986 | Japan | 347/87 |
| 118260 | 5/1988 | Japan | 347/87 |
| 21423 | of 1989 | Japan . | |
| 204052 | 8/1990 | Japan | 347/87 |
| 6-040043 | 2/1994 | Japan | 347/86 |
| 6-99585 | 4/1994 | Japan . | |
| WO91002652 | 3/1991 | WIPO . | |

*Primary Examiner*—John E. Barlow, Jr.
*Assistant Examiner*—Craig A. Hallacher
*Attorney, Agent, or Firm*—Fitzpatrcik, Cella, Harper & Scinto

[57] ABSTRACT

A length of a melamine foamed block to be accommodated in an ink tank housing as measured in the longitudinal direction is dimensioned to be larger than a length of the ink tank housing as measured in the longitudinal direction. Thus, while the foamed block is accommodated in the ink tank housing, it is compressed in the direction orienting toward an ink feeding port from which ink is fed to a printing head, i.e., in the ink feeding direction. Consequently, the ink retaining force induced by the capillary force is not intensified in the compressing direction of the melamine foamed block, resulting in an ink feeding capability of the printing head being improved. On the contrary, the ink retaining force effective at a right angle relative to the compressing direction of the melamine foamed block is intensified.

9 Claims, 40 Drawing Sheets

INK TANK, HEAD CARTRIDGE AND INK JET PRINTING APPARATUS

This application is a continuation of application Ser. No. 08/241,636 filed May 12, 1994, now abandoned.

BACKGROUND OF THE INVENTION

1. Field of the Invention

The present invention relates to an ink tank, a head cartridge including the ink tank and an ink jet head integrated with each other, and an ink jet printing apparatus including the ink tank and the head cartridge for performing a printing operation with them. More particularly, the present invention relates to the structure of the ink tank of the type having an ink absorbing member accommodated therein for the purpose of ink retaining.

Here, the printing operation represents all type of operations each to be performed for a various kind of ink receiving medium such as a cloth, a thread, a paper, a sheet-like material or the like so as to allow ink to be adhesively secured thereto. Therefore, the present invention can be applied to a printing apparatus, i.e., a printer serving as an information outputting apparatus operatively associated with a various kind of information processing apparatus.

2. Description of the Related Art

Many foamed blocks each molded of a polyurethane resin are hitherto used as an ink absorbing member to be accommodated in an ink tank of the foregoing type. In the case that a urethane foamed block is used as an ink absorbing member, films are formed in the foamed block during each molding operation in such a manner as to wrap each of a number of voids (pores) in the foamed block with a film. Thus, since the voids are isolated from each other due to the presence of the film between adjacent voids, the foamed block can not exhibit a function of absorbing ink therein as it is. To cope with this problem, the foamed block is subjected to film removing treatment via heating, cleaning and others. However, it is very difficult to completely remove films in the foamed block with the film removing treatment as mentioned above. In most cases, a considerable amount of residue practically adheres to each void or pore on completion of the film removing treatment.

In the case that the urethane foamed block is used as the ink absorbing member, it is usually accommodated in the ink tank in the compressed state. In addition, to assure that an adequate intensity of negative pressure acts on a communicating portion between the foamed block and a connecting member for an ink outflow portion while maintaining a certain pressure gradient across the foregoing communicating portion, a part of the foamed block is usually compressed at the communicating portion. However, since film residues remaining between adjacent voids or pores are liable to overlap in the foamed block, there arise malfunctions that ink hardly flows in the ink absorbing member, and moreover, ink fails to be fed outside of the ink tank.

On the other hand, in contrast with the urethane foamed block, an ink absorbing member comprising a foamed block molded of a condensate composed of a melamine and a formaldehyde is described in an official gazette of, e.g., International Patent Laid-Open Publication NO. WO 91/02652. The ink absorbing member as described in the above official gazette is molded in the form of a skeleton having no thin film in each gap present in the circuit network of the foamed block while assuming a net-shaped structure. Thus, the ink absorbing member composed of a melamine foamed block has many advantages that any type of film removing treatment is not required, a large quantity of ink can storably be received in the melamine foamed block owing to the presence of a number of fine fibers constituting the circuit network compared with the urethane foamed block, initial ink filling treatment can easily be conducted owing to an excellent hydrophilic property of the melamine foamed block in contrast with the urethane foamed block having a water repelling property, no ink remains in the melamine foamed block having no film formed therein due to the presence of a residue on completion of ink consumption, and the ink in the melamine foamed block can completely be utilized at a high efficiency.

Basically, it is preferable that the ink absorbing member composed of a melamine foamed block which is disclosed in the above-stated gazette is practically used in the compressed state, and ink is fed to an ink outflow portion disposed at the lower part of an ink tank by the function of the gravity force of ink itself. Thus, the ink feeding direction orienting toward the ink outflow portion is firmly determined to coincide with the downward direction. For this reason, there arises a problem that an attitude to be assumed at the time of practical use of the ink tank described in the official gazette is restrictively determined. In addition, in the case that the ink absorbing member is accommodated in the ink tank in the preferably employable uncompressed state, it is difficult that the ink absorbing member is brought in close contact with the inner wall surface of the ink tank. Thus, a gap is liable to appears between the ink absorbing member and the inner wall surface of the ink tank. When the atmospheric air taken through an atmospheric air communication port or an ink ejecting port of an ink jet head stays in the gap, there arises a malfunction that as ink is ejected from the ink jet head, a bubble is involved in the ink fed to the ink jet head, causing a quality of printed image to be remarkably degraded. Especially, with respect to an ink jet recording apparatus of the type including an ink tank and an ink jet head integrated with each other to perform a printing operation by reciprocably scanning the integrated structure composed of the ink tank and the ink jet head relative to a printing medium, there readily arises a problem that the ink tank is vibratively displaced due to the reciprocable scanning of the foregoing integrated structure. In the case that the ink jet printing apparatus is adversely affected by the vibrative displacement of the ink tank or in the case that the ink tank includes a member at the position located in the vicinity of an ink outflow portion, when a part of the ink absorbing member located in the vicinity of the ink outflow portion exhibits deterioration in terms of properties as time elapses, a gap is liable to appear at the above-noted part of the ink absorbing member. At this time, it is anticipated that the adverse influence given to the ink absorbing member due to staying of air at the gap becomes more remarkable. In an extreme case, it is preestimated that the atmospheric air communicating portion and the gap located in the vicinity of the ink outflow portion are communicated with each other. Once such a malfunction as mentioned above has arose, it becomes impossible to perform a desired ink ejecting operation, and moreover, the ink present in an ink feeding path leaks from an ink ejecting port, causing the interior of the ink jet printing apparatus to be contaminated with the leaked ink.

Since feeding of ink to the ink outflow portion is achieved by utilizing the gravity force of the ink itself, when an ink jet head is driven at a high frequency highly desired in recent years, there is a possibility that the ink feeding can not follow the driving of the ink jet head at a high frequency. To improve a property of followability of the ink jet head at the driving of the latter at a high frequency, it is thinkable that a pore size is enlarged to some extent and a magnitude of resistance against flowing of the ink is reduced. In this case, however, there is a possibility that an ink retaining capability of the ink absorbing member is degraded, causing ink to leak from the atmospheric air communicating port.

According to the description of the official gazette of the prior invention, in some case, it is desirable that a certain intensity of compressing force is applied to a foamed structure for the ink absorbing member in a specific application example of the ink jet printing apparatus in order to maintain useful or suitable properties of the ink absorbing member in the uncompressed state, and moreover, adjust a gap space of the foamed structure.

It is considered that the description of the official gazette was made in consideration of the relationship between inner dimensions of the accommodating space and outer dimensions of the ink absorbing member. The inventors of the present invention conducted a variety of examinations and as a result derived from the examinations, they found that it was acceptable that the ink absorbing member was properly compressed in order to assure that ink could smoothly and reliably be fed to the ink absorbing member regardless of an attitude assumed by the ink tank while utilizing advantages of the ink absorbing member molded of a condensate composed of a melamine and a formaldehyde. In addition, the inventors found the following technical problems to be solved. Specifically, one of the problems is that the ink absorbing member should be compressed corresponding to the structure of the ink absorbing member in a certain adequate direction in order to assure that ink can smoothly be fed to the ink absorbing member, other one is that so-called warpage or breakage is liable to occur at a compressible part of the ink absorbing member having a comparative brittle fibrous structure, and another one is that once the warpage has occurred with the ink absorbing member, the compressed state of the latter can not be maintained any more, resulting in the ink absorbing member assuming an uncompressed state.

In addition, a filter is usually disposed at the ink outflow portion for removing foreign materials involved in the ink fed from the ink absorbing member, and an opening area of the ink outflow portion is determined corresponding to a quantity of ink to be fed therefrom. However, since the thermosetting melamine based condensate is brittle in structure, a part of the condensate is peeled away from the ink outflow portion when the ink absorbing member is worked, accommodated in the ink tank or put in later practical use, and the filter is clogged with fractured pieces of the condensate. In this connection, the inventors found another technical problem to be solved at this time, i.e., a problem that a desired quantity of ink to be fed could not be assured with the ink absorbing member. These technical problems mentioned above is not described in the official gazette.

SUMMARY OF THE INVENTION

The present invention has been made in consideration of the aforementioned background.

An object of the present invention is to provide an ink tank, a head cartridge and an ink jet printing apparatus wherein at least one of the technical problems as mentioned above can be solved by utilizing advantages obtainable from an ink absorbing member comprising a porous block having a three-dimensional net-shaped structure, i.e., a foamed block molded of a condensate composed of a compound having an amino group and a formaldehyde.

Other object of the present invention is to provide an ink tank, a head cartridge and an ink jet printing apparatus wherein an ink feeding capability of the ink absorbing member can be improved by reducing only an intensity of ink retaining force effective in the ink feeding direction while unchangeably maintaining a predetermined intensity of ink retaining force on the assumption that the foamed block constituting the ink absorbing member to be accommodated in an ink tank is compressed in the direction orienting toward an ink feeding port, and a size of each of a number of pores in the foamed block orienting in the compressing direction does not vary but a pore size as measured at a right angle relative to the compressing direction is reduced.

Another object of the present invention is to provide a method of producing an ink absorbing member wherein cut chips or impurities are hardly generated during a step of working by actuating a water jet cutter for cutting the ink absorbing member to be accommodated in an ink tank or forming a plurality of slits, a yielding rate of the ink absorbing member or the ink tank can be improved, there does not arise malfunction that flowing of the ink is obstructed in the presence of cut chips or similar foreign materials, an ink jet head can be driven at a high frequency corresponding to the improvement of the ink feeding capability, a quantity of each printed image can be improved, the foamed block can be cleaned with the aid of a piping line laid at a small expenditure while using the water ejected from the water jet cutter at the same time as the working operation performed by the water jet cutter, and a series of steps of forming the ink absorbing member can simplified.

Further object of the present invention is to provide an ink tank, a head cartridge and an ink jet printing apparatus wherein the ink absorbing member is effectively and adequately thrusted against the ink outflow portion, and a number of single fibers each having a high ink usage efficiency are employed for the ink absorbing member so as to enable ink to be easily filled in the ink absorbing member.

Further another object of the present invention is to provide an ink tank, a head cartridge and an ink jet printing apparatus wherein any ink leakage does not occur regardless of mechanical shock induced by vibrations of the ink jet head and the ink tank as well as thermal shock induced by temperature variation not only during transportation of the ink jet printing apparatus but also at the time when the ink jet printing apparatus is practically operated, and ink can reliably be fed to the head cartridge mounted on the ink jet printing apparatus.

According to a first aspect of the present invention, there is provided an ink tank for storably receiving ink therein, comprising:

- a housing having an ink feeding port formed therethrough so as to allow ink to be storably received therein to be fed through the ink feeding port;
- an ink absorbing member accommodated in the housing for retaining ink therein, the ink absorbing member being a porous block having a three-dimensional net-shaped structure and comprising a foamed block molded of a condensate composed of a compound having an amino group and a formaldehyde as base materials; and
- compressing means for compressing the ink absorbing member toward the ink feeding port.

According to a second aspect of the present invention, there is provided an ink tank for storably receiving ink therein, comprising:

a housing having an ink feeding port formed therethrough so as to allow ink to be storably received therein to be fed through the ink feeding port;

an ink absorbing member accommodated in the housing for retaining ink therein, the ink absorbing member being a porous block having a three-dimensional net-shaped structure and comprising a foamed block molded of a condensate composed of a compound having an amino group and a formaldehyde as base materials; and compressing means for compressing the ink absorbing member in the housing at least in one direction.

According to a third aspect of the present invention there is provided an ink tank for storably receiving ink therein, comprising:

a housing;

an ink absorbing member accommodated in the housing for retaining ink therein, the ink absorbing member comprising a foamed block including cell films of which number is smaller than that of a foamed block molded of a polyurethane resin or a foamed block molded of a condensate composed of a compound having an amino group and a formaldehyde; and foamed block deforming/accommodating means for compensating or suppressing deterioration of properties of the ink absorbing member.

According to a fourth aspect of the present invention, there is provided an ink tank for storably receiving ink therein, comprising;

a housing;

an ink absorbing member accommodated in the housing for retaining ink therein, the ink absorbing member being a foamed block including cell films of which number is smaller than that of a foamed block molded of a polyurethane resin or a foamed block molded of a condensate composed of a compound having an amino group and a formaldehyde; and at least a part of the ink absorbing member accommodated in the housing for retaining ink therein being subjected to preliminary treatment for the purpose of compensation.

According to a fifth aspect of the present invention, there is provided head cartridge including a printing head for ejecting ink therefrom and an ink tank for storably receiving ink to be fed to the printing head, the printing head and the ink tank being integrated with each other, wherein the ink tank comprises:

a housing having an ink feeding port formed therethrough so as to allow ink to be storably received therein to be fed through the ink feeding port;

an ink absorbing member accommodated in the housing for retaining ink therein, the ink absorbing member being a porous block having a three-dimensional net-shaped structure and comprising a foamed block molded of a condensate composed of a compound having an amino group and a formaldehyde as base materials; and compressing means for compressing the ink absorbing member toward the ink feeding port.

According to a sixth aspect of the present invention, there is provided a head cartridge including a printing head for ejecting ink therefrom and an ink tank for storably receiving therein ink to be fed to the printing head, the printing head and the ink tank being integrated with each other, wherein the ink tank comprises:

a housing having an ink feeding port formed therethrough so as to allow ink to be storably received therein to be fed through the ink feeding port;

an ink absorbing member accommodated in the housing for retaining ink therein, the ink absorbing member being a porous block having a three-dimensional net-shaped structure and comprising a foamed block molded of a condensate composed of a compound having an amino group and a formaldehyde as base materials; and compressing means for compressing the ink absorbing member in the housing at least in one direction.

According to a seventh aspect of the present invention, there is provided an ink jet printing apparatus for performing a printing operation by ejecting ink to a printing medium from a printing head adapted to eject ink therefrom, wherein the ink jet apparatus includes an ink tank for storably receiving ink to be fed to the printing head, the ink tank comprising;

a housing having an ink feeding port formed therethrough so as to allow ink to be storably received therein to be fed through the ink feeding port;

an ink absorbing member accommodated in the housing for retaining ink therein, the ink absorbing member being a porous block having a three-dimensional net-shaped structure and comprising a foamed block molded of a condensate composed of a compound having an amino group and a formaldehyde as base materials; and compressing means for compressing the ink absorbing member toward the ink feeding port.

According to an eighth aspect of the present invention, there is provided an ink jet printing apparatus for performing a printing operation by ejecting ink to a printing medium from a printing head adapted to eject ink therefrom, wherein the ink jet printing apparatus includes an ink tank for storably receiving therein ink to be fed to the printing head, the ink tank comprising;

a housing having an ink feeding port formed therethrough so as to allow ink to be storably received therein to be fed through the ink feeding port;

an ink absorbing member accommodated in the housing for retaining ink therein, the ink absorbing member being a porous block having a three-dimensional net-shaped structure and comprising a foamed block molded of a condensate composed of a compound having an amino group and a formaldehyde as base materials; and compressing means for compressing the ink absorbing member in the housing at least in one direction.

According to a ninth aspect of the present invention, there is provided a method of producing an ink absorbing member, comprising the steps of:

providing a thermosetting foamed block having a porous three-dimensional divergent circuit network, the thermosetting foamed block being molded of a condensate composed of a compound having an amino group and a formaldehyde; and working the foamed block by actuating a water jet cutter in such a manner as to enable the foamed block to be accommodated in an ink tank.

According to a tenth aspect of the present invention, there is provided an ink tank for storably receiving ink therein, comprising:

an ink absorbing member having a porous three-dimensional divergent circuit network and comprising a thermosetting foamed block molded of a condensate composed of a compound having an amino group and a formaldehyde as base materials;

pressing means for pressing the ink absorbing member against an ink outflow portion; and alleviating means for alleviating an intensity of pressure applied to the ink absorbing member by the pressing means.

According to an 11th aspect of the present invention, there is provided an ink tank, comprising:

an ink absorbing member having a porous three-dimensional divergent circuit network and comprising a thermosetting foamed block molded of a condensate composed of a compound having an amino group and a formaldehyde; and compensating means for applying a functional force to the thermosetting foamed block corresponding to deterioration of properties of the ink absorbing member.

According to a 12th aspect of the present invention, there is provided an ink tank, comprising:

an ink absorbing member having a porous three-dimensional divergent circuit network and comprising a thermosetting foamed block molded of a condensate composed of a compound having an amino group and a formaldehyde as base materials;

a holding portion for holding an ink feeding tube inserted into the ink tank so as to allow ink to flow outside of the ink absorbing member therethrough; and a pressure alleviating member interposed between the holding portion and the ink absorbing member.

According to a 13th aspect of the present invention, an ink tank for storably receiving ink therein, comprising:

a first ink chamber including an ink feeding portion and an atmospheric air communicating portion and having an ink absorbing member accommodated therein; and one or a plurality of second ink chambers each communicated with the first ink chamber and having ink storably received therein, wherein the ink absorbing member is a porous block having a three-dimensional net-shaped structure and is molded of a condensate composed of a compound having an amino group and a formaldehyde.

According to a fourteenth aspect of the present invention, there is provided an ink tank for storably receiving ink therein, comprising:

a first ink chamber including an ink feeding portion and having an ink absorbing member accommodated therein; and one or a plurality of second ink chambers each communicated with the first ink chamber and having ink storably received therein, wherein each of the second ink chambers communicated with the first ink chamber and including an atmospheric communicating portion has an ink absorbing member accommodated therein; and the ink absorbing member is a porous block having a three-dimensional net-shaped structure and is molded of a condensate composed of a compound having an amino group and a formaldehyde as base materials.

Other object, features and advantages of the present invention will become apparent from reading of the following description which has been made in conjunction with the accompanying drawings.

DESCRIPTION OF THE PREFERRED EMBODIMENTS

Figures 1A, 1B:
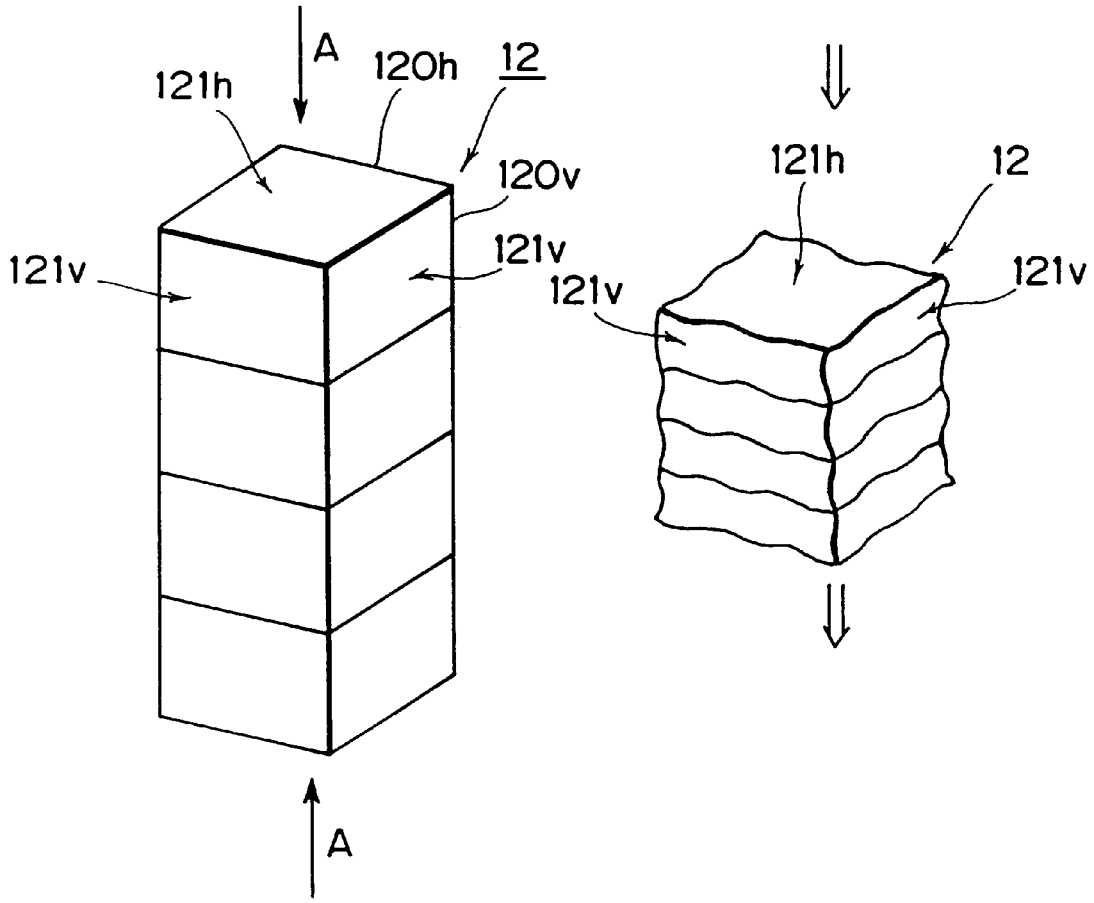
FIG. 1A and FIG. 1B are schematic perspective views each of which shows the structure of a plurality of foamed cells for the purpose of explaining an principle of the present invention, respectively.

The present invention will now be described in detail hereinafter with reference to the accompanying drawings which illustrate several preferred embodiments thereof.

(First Embodiment)

In this embodiment, a foamed component molded of a melamine resin to be used as an ink absorbing member is prepared in the form of a porous member having a three-dimensional net-shaped structure, and it is provided as one of foamed substances each of which base material is a condensate composed of a compound having an amino group and a formaldehyde. Generally, the three-dimensional net-shaped structure of the foregoing foamed component is built by using a number of comparatively fine single fibers, and it does not include any cell wall (film). Each single fiber has a relatively large length compared with its width or diameter. Thus, a hollow portion (hereinafter referred to as a pore) of each cell has a large volume in the foamed component, causing the foamed component to exhibit a small volumetric density and a large volumetric efficiency. A pore size of the foamed component is comparatively uniformalized, and the pore rate represented by pores each having a pore size smaller than that of an average pore is comparatively small. In this embodiment, to assure that the foamed component is advantageously used, it is preferable that the volumetric efficiency of the foamed component is set to 95% or more, the volumetric density of the same is set to 0.024 g/cm or less, and the average pore size is set to 200 $\mu$m or more. The foamed component as mentioned above can be produced by employing any one of hitherto known processes.

In this embodiment, in the circumstances as mentioned above, the foamed component is compressed at least in the direction orienting toward an ink feeding port through which ink is fed to an ink jet head (hereinafter referred to as a printing head).

The foregoing fact will be described in more detail in the following manner.

Specifically, as an ink jet printing apparatus performs a printing operation at a higher speed, the printing head is activated by a comparatively high frequency (3 kHz or more) for ejecting ink therefrom, causing a quantity of ink to be ejected from an opening for a unit time to be increased. In this case, when the ink received in an ink tank is not fed to the printing head as the latter is activated by a high frequency, an optimum image can not be formed on a printing paper.

In this embodiment, to cope with the foregoing problem, a intensity of capillary force is reduced by enlarging the pore size of the foamed component molded of a melamine resin, and moreover, reducing resistance against flowing of the ink in the foamed component. However, once the intensity of capillary force is reduced, there arise problems that a quantity of ink capable of being storably received in the ink tank without any occurrence of ink leakage is reduced, and moreover, the number of printing papers capable of being printed is also reduced.

The foregoing problems can be eliminated by compressing the foamed component in the ink tank at least in the direction orienting toward the ink feeding port.

FIG. 1A and FIG. 1B are schematic perspective views each of which shows a part constituting the foamed component molded of a melamine resin, respectively.

FIG. 1A shows by way of perspective view the structure of the foamed component designated by reference numeral 12 before the latter is compressed. As is apparent from the drawing, each cell in the foamed component 12 is composed by combining horizontally extending single fibers 120*h* with vertically extending single fibers 120*v* and includes pore opening portions 121*h* and pore opening portions 121*v*.

FIG. 1B shows by way of perspective view the state that the melamine foamed component 12 is compressed in the A arrow-marked direction. As is apparent from the drawing, each of the pore opening portions 121*v* orienting at a right angle relative to the A arrow-marked direction shown in FIG. 1A has a reduced opening area due to the foregoing compression but an opening area of each of the pore opening portions 121*h* is not reduced irrespective of the compression.

While the melamine foamed component 12 is kept in the compressed state as mentioned above, the capillary force exhibits certain directionality or the directionality of the capillary force is increased. Thus, when the ink held in each pore is displaced to the feeding port side under the influence of a negative pressure or an atmospheric pressure applied to the printing head, the ink retaining force induced by the capillary force to act as resistance against the displacement of the ink is enlarged in the direction at a right angle relative to the compressing direction attributable to variation of the opening area of each pore opening portion 121*v* but it hardly varies in the compressing direction.

Consequently, the pore size as measured in the ink feeding direction is enlarged so as to allow the ink to be quickly fed while an intensity of ink retaining force is reduced, and a necessary ink retaining power effective in the other direction can be obtained.

With respect to a conventional foamed component molded of a polyurethane resin, when it is compressed in the same manner as mentioned above, the ink retaining force of the foamed component does not exhibit remarkable variation of directionality or an intensity of ink retaining power is not enlarged so far. This is attributable to the fact that thin films remaining still in structural members constituting the urethane foamed component are superimposed one above another when it is compressed, causing an area (projected area) of each opening portion orienting in the compressing direction to be reduced, whereby an intensity of ink retaining force effective in the compressing direction is enlarged.

Figure 2:
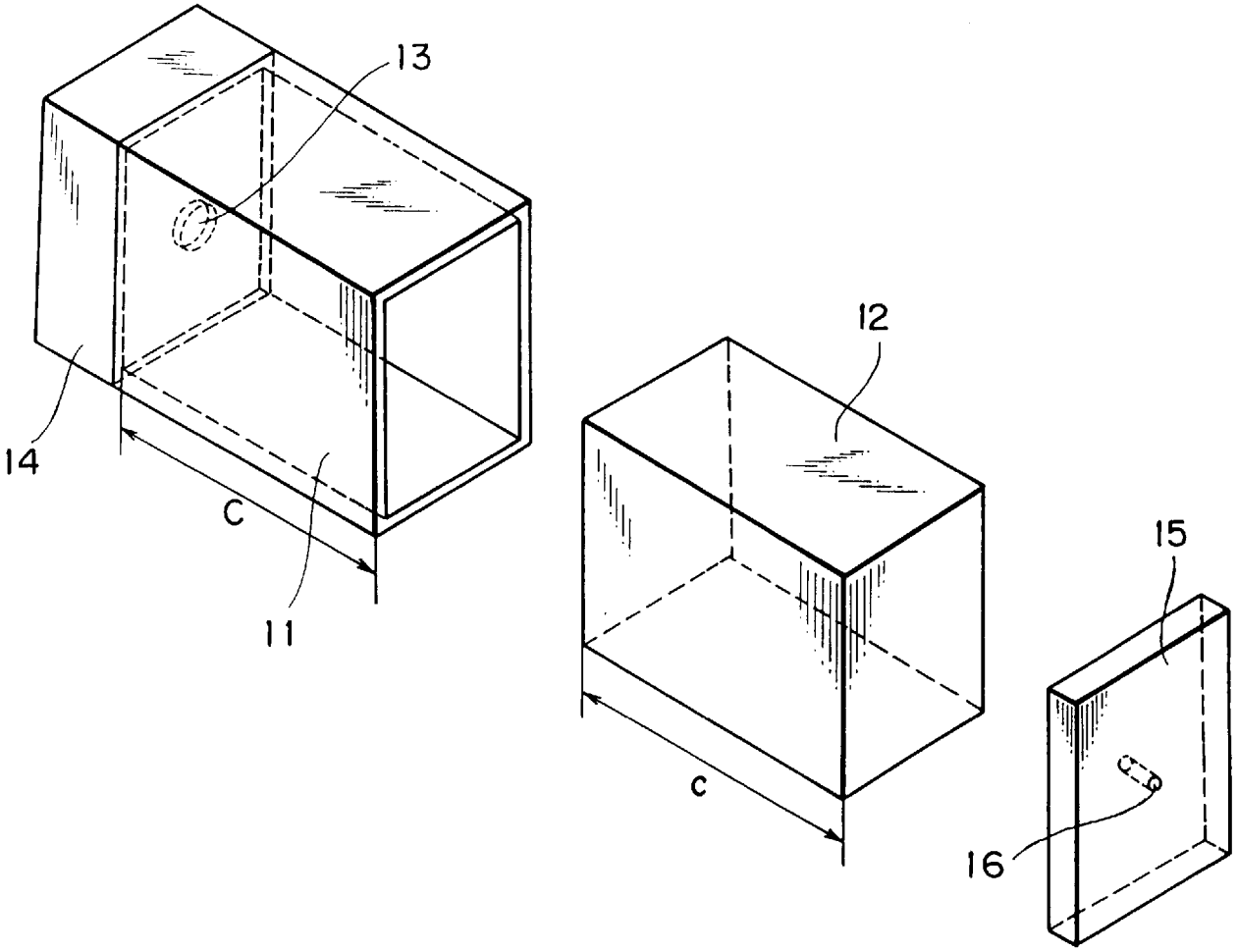
FIG. 2 is a perspective view of an ink tank constructed according to a first embodiment of the present invention, showing the structure of the ink tank in the disassembled state.

FIG. 2 is a schematic perspective view of an ink tank constructed according to the first embodiment of the present invention, particularly showing the structure of the ink tank in the disassembled state.

A printing head 14 is connected to the fore end surface of a housing 11 of the ink tank. As is hitherto known, the printing head 14 may detachably be connected to the housing 11 of the ink tank. Alternatively, the printing head 14 may immovably be integrated with the housing 11 of the ink tank. In addition, a feeding port 13 is formed through the housing 11 of the ink tank at the central part of the connected surface between the housing 11 of the ink tank and the printing head 14 so as to enable ink to be fed from the ink tank to the printing head 14 therethrough. In this embodiment, the printing head 14 ejects ink therefrom by the functional force induced by the formation of a bubble as thermal energy is applied to the ink.

A foamed component 12 molded of a melamine resin to serve as an ink absorbing member is fully accommodated in the housing 11 of the ink tank, and a length C of the accommodating portion of the housing 11 of the ink tank as measured in the ink feeding direction is dimensioned to be smaller than a length c of the melamine foamed component 12 as measured in the same direction. Thus, the melamine foamed component 12 can fully be accommodated in the housing 11 of the ink tank, and when the rear surface of the housing 11 of the ink tank is sealably closed with a cover 15, the melamine foamed component 12 is compressed by the cover 15 in the ink feeding direction.

Although the foamed component 12 is compressed in the direction orienting toward the feeding port 12 in the above-described manner, an intensity of capillary force effective in the ink feeding direction is not enlarged because there is not any possibility that a pore size of the foamed component measured in the direction orienting toward the ink feeding port 13 is not reduced. This leads to the result that resistance against flowing of ink is not increased by any means. On the other hand, since a pore size of the foamed component 12 measured in the direction orienting at a right angle relative to the ink feeding direction is reduced, the intensity of capillary force effective in the last-mentioned direction is enlarged, resulting in a desired intensity of ink retaining force being obtainable. With this construction, a quantity of initially charged ink does not decrease, and moreover, there does arise a malfunction that ink leaks outside of the housing 11 through an environment communication pore 16 or the like.

Figure 3:
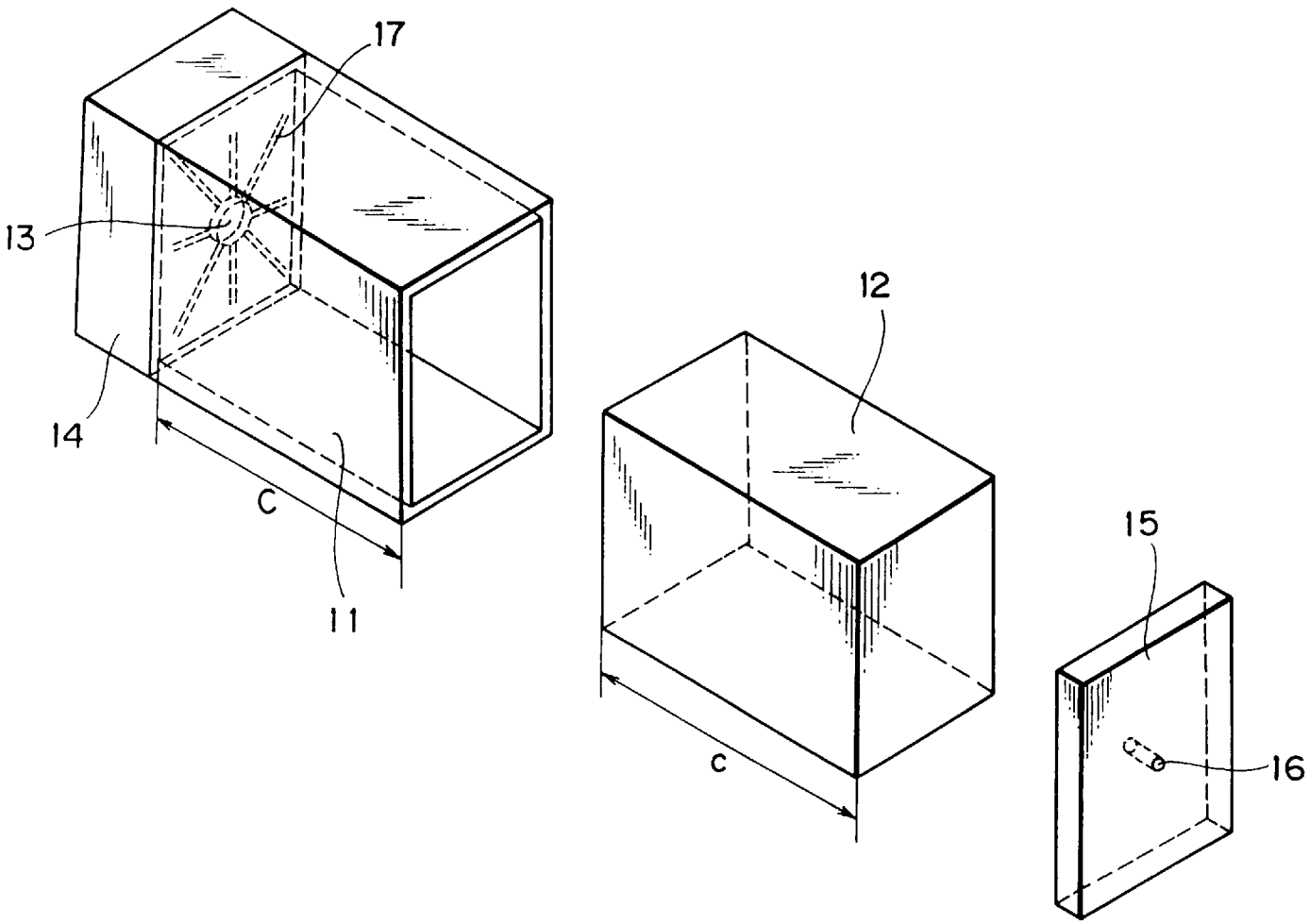
FIG. 3 is a perspective view of an ink tank constructed according to an embodiment modified from the first embodiment of the present invention, showing the structure of the ink tank in the disassembled state.

FIG. 3 is a perspective view similar to FIG. 2 wherein an ink tank is constructed according to an embodiment modified from the first embodiment of the present invention.

In this embodiment, a plurality of grooves radially extending from the ink feeding port 13 are formed on the inner wall surface of the fore wall of the housing 11 in order to allow ink to promotively flow toward the ink feeding port 13.

The relationship among a pore size of the foamed component available in this embodiment, a compression rate of the foamed component required for assuring a desired intensity of ink retaining force and resistance against flowing of the ink at this time is shown in Table 1.

TABLE 1

| | Pour size | Compression rate for assuring a predetermined intensity of ink retaining force | Resistance against flowing of ink |
|---|---|---|---|
| Comparative | 180–200 (μm) | 1 | 100% |
| Example | 200–240 (μm) | 1.4 | about 83% |
| Embodiments | 240–280 (μm) | 1.8 | about 71% |
| | 280–320 (μm) | 2.2 | about 45% |

As is apparent from Table 1, in this embodiment, in the case that the melamine foamed block having a pore size of 200 to 320 μm in the uncompressed state is used at a compression rate of 1.4 to 2.2, a predetermined intensity of ink retaining force, i.e., an intensity of ink retaining force assuring a desired quantity of charged ink without any occurrence of ink leakage can be obtained, and moreover, it is possible to set resistance against the flowing of ink in the compressing direction to about 83% or less in the case that the foamed block is not compressed (i.e., in the case that a compression rate of the foamed block assumes a value of 1).

It should be noted that the pore size departing from the foregoing range of pore size but assuring that a desired effect can be expected by carrying out the present invention is exemplified by 150 to 450 (μm) in the uncompressed state, more preferably, 200 to 400 (μm).

In the case that the pore size is enlarged within the aforementioned range, a certain degree of pore size can be assured regardless of partial breakage or injury of each single fiber. Thus, the reduction of ink feeding ability can be minimized.

On the contrary, in the case that the pore size is set to 100 μm or less, desired reduction of the resisting against the flowing of ink can not be obtained with the ink tank. Thus, the ink tank can not practically be used when the printing head is driven at a high ejection frequency. In the case that the pore size is set to 500 μm or more, the compression rate should be set to 3 or more in order to assure that a desired intensity of ink retaining force can be obtained. However, this can not practically be realized for the reason associated with the structural conditions of the ink tank. In addition, there is a possibility that each single fiber constituting the melamine foamed block is often broken or damaged, resulting in mechanical properties of the melamine foamed block being degraded.

A melamine constituting the foamed block used in this embodiment is a compound having an amino group, and at least one kind of material selected from a group consisting of urea, carboxylic acid amide, dicyandiamode, guanidine, sulfonic acid am-de, aliphatic amine, benzoguana and its derivative can be used as a compound similar to the melamine resin. Besides formaldehyde, at least one kind of material selected from a group consisting of acetaldehyde, trimethylaldehyde, acrolein, benzaldehyde, fluoroflore, glyoxal, phthalaldehyde and terephthalaldehyde may be contained in the melamine based compound.

The resultant ink absorbing block is prepared in the form of a porous block having a three-dimensional net-shaped structure, and the foregoing porous block is an elastic foamed block which is molded of a condensate composed of a melamine and a formaldehyde as a base material. This elastic foamed block can be produced by employing a method as disclosed in an official gazette of U.S. Pat. No. 4,540,717. In addition, it is preferable that the resultant foamed block is prepared in the form of an elastic foamed block containing 80% or more of condensate composed of melamine and formaldehyde.

The condensate composed of melamine and formaldehyde may contain a compound having other type of amino group by a quantity of 50 to 20% by weight in addition to the melamine. Alternatively, it may contain other type of aldehyde of 50 to 20% by weight in the condensed state in addition to the formaldehyde.

According to the first embodiment of the present invention as described above, an occurrence of malfunction that the ink absorbing block is permanently or excessively warped can be compensated or suppressed. In other words, the aforementioned problems associated with the ink tank have been satisfactorily solved by improving the structure of the ink absorbing block itself under a condition that the ink tank includes a mechanism for deformably accommodating a foamed block therein.

(Second Embodiment)

In contrast with the melamine foamed block constructed according to the first embodiment of the present invention, this embodiment is intended to optimize the structure of an ink tank in consideration of material properties of the foamed block, an ink feeding direction, a quantity of ink storably received in the ink tank and other factors.

Figure 4:
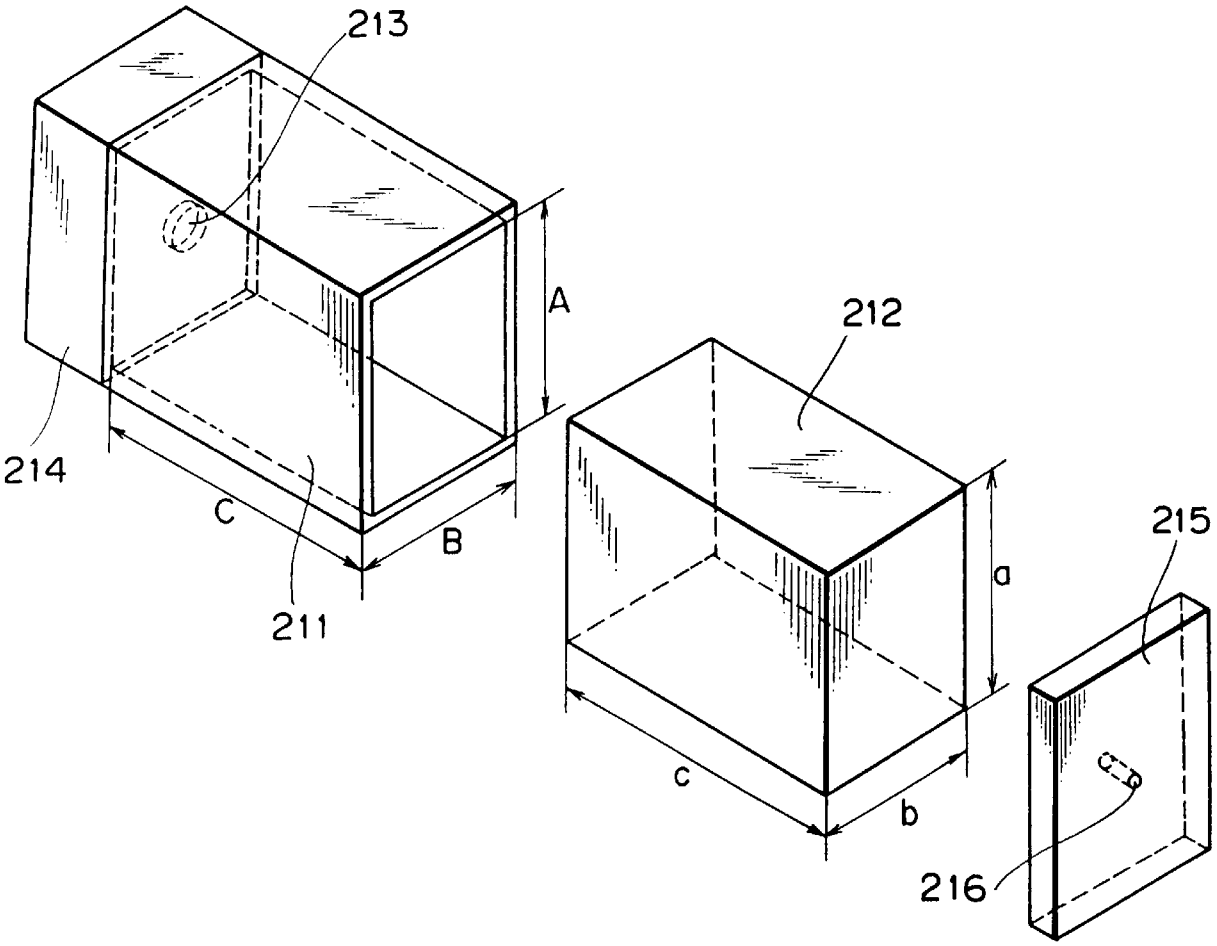
FIG. 4 is a perspective view of an ink tank constructed according to a second embodiment of the present invention, showing the structure of the ink tank in the disassembled state.

FIG. 4 is a perspective view of an ink tank constructed according to a second embodiment of the present invention, particularly showing the structure of the ink tank in the disassembled state.

Referring to FIG. 4, a melamine foamed block (hereinafter referred to a melamine foam) 212 is fully accommodated in a housing 211. A melamine foam insert opening portion of the ink housing 211 kept open to the outside is sealably closed with a housing cover 215, and an environment communicating port 216 is formed through the housing cover 215 so as to enable an environmental air to be substituted from the consumed ink. A printing head 214 attached to the housing 211 serves to eject ink droplets to perform a printing operation with the ejected ink droplets in the same manner as the first embodiment of the present invention. As ink is ejected from the printing head 214, ink is continuously fed to the printing head 214 through an ink feeding port 213 projected slightly inside of the inner wall surface of the housing 211.

Referring to FIG. 4, when a height of the housing 211 is designated by A, a width of the same is designated by B, a length of the same is designated by C, a height of the melamine foam 212 is designated by a, a width of the same is designates by b and a length of the same is designated by c, the following relationship is established among these dimensions.

Firstly, a ratio of c/C represents a compression rate of the ink absorbing block 212 as measured in the ink feeding direction in the same manner as the first embodiment of the present invention. In this connection, the relationship between the compression rate and a quality of printed image established in this embodiment is shown in Table 2.

TABLE 2

| dimensional ratio of c/C | <1.0 | 1.0 | 1.2 | 1.5 | 1.8 |
|---|---|---|---|---|---|
| Quality of printed image in terms of density | occurrence of stopping of ink feed | good | good | good | reduced density |

As shown in Table 2, in this embodiment, each printing operation can excellently be achieved when the ratio of c/C assumes a value of 1 or more but 1.5 or less in the state that the relationship between other dimensions, i.e., a and b is modified in such a manner these dimensions to be reduced.

Secondarily, the dimensions a, b, A and B are determined to satisfactorily establish the relationship as represented by the following inequality.

$$0.8 \leqq a/A \times b/B \leqq 1.7$$

Data on performances of the ink tank obtained from a comparison made under a condition that the dimensional ratio among the above dimensions is changed are shown in Table (wherein the dimensions c and C are unchangeably determined such thaws the ratio of c/C assumes a predetermined value).

Specifically, the dimensions of the housing 211 are unchangeably determined such that A is set to 3 cm, B is set to 2 cm and C is set to 4.5 cm but the dimensions a and b of the melamine foamed block 212 are changed.

TABLE 3

| | 0.7 | 0.8 | 1.0 | 1.3 | 1.7 | 2.0 |
|---|---|---|---|---|---|---|
| Quantity of ink available | 17 g | 20 g | 25 g | 25 g | 23 g | 20 g |
| Quality of printed image in terms of density | good | good | good | good | good | reduced density |
| Occurrence of dust particles when foamed block is accommodated | none | none | none | small | small | large |

Referring to Table 3, a quantity of ink available for each printing operation is represented by the following equation.

(quantity of ink available for printing operation)=(quantity of ink capable of being charged in foamed block)−(quantity of ink remaining in foamed block)

Referring to Table 3 again, in the case that a product of a/A×b/B is smaller than 0.8, as a volume of the foamed block 212 itself is considerably reduced, a quantity of ink capable of being initially retained is correspondingly reduced. This leads to the result that a quantity of ink available for each printing operation is reduced. When the value representing the foregoing product is larger than 1.75, an intensity of ink retaining force of the foamed block 212 is enlarged, resulting the ink feeding ability of the foamed block 212 being degraded. Consequently, the foamed block 212 becomes unsuitable for the printing head 214 when the latter is driven at a high ejection frequency, and moreover, it becomes practically difficult to feed ink to the printing head 214, causing a quantity of ink remaining in the foamed block 212 to be increased. Thus, a quantity of ink available for each printing operation is reduced.

Next, with respect to the density of printed image and the quality of the same, in the case that the value representing the foregoing product is larger than 2.0, the ink feeding ability of the foamed block 212 is reduced and the density of printed image is likewise reduced.

The dust particles arising when the foamed block 212 is accommodated in the housing 211 as shown in Table 3 represent cut pieces appearing from the melamine foamed block 212 due to frictional rubbing between the foamed block 212 and the housing 211 not only when the foamed block 212 is accommodated in the housing 211 but also after the former is accommodated in the latter. It should be noted that the appearance of the dust particles as mentioned above is caused attributable to comparatively hard and brittle properties of the melamine foamed block 212.

To prevent the foamed block 212 from being partially broken or damaged not only when the foamed block 212 is accommodated in the housing 211 but also after the former is accommodated in the latter, it is recommendable that the inner wall surface of the housing 211 and the outer surface of the foamed block 212 are coated with a surface active agent and a slip additive.

Specifically, in this embodiment, to prevent the foamed block 212 from being partially broken or damaged or to compensate or suppress the deterioration of properties of the foamed block 212, the housing 211 and/or the foamed block 212 are subjected to various kind of preliminary treatment. For example, slidability is preliminarily given to the slidable surface of the housing 211 and/or the foamed block 212 before the foamed block 212 is accommodated in the housing 211. To prevent the foamed block 212 itself from being partially broken or damaged, each cut surface of the foamed block 212 is processed in such a manner as to exhibit excellent smoothness. In addition, various kinds of compensative treatments for compensating the deterioration of properties of the ink absorbing member, i.e., the foamed block 212 (inclusive of treatment for giving a water repelling property to the hydrophilic foamed block 212, treatment for strengthening the structure of the same and treatment for improving the durability of the same) are conducted for the ink tank.

It is preferable that typical preliminary treatment is conducted for the ink tank in such a manner that the housing 211 and/or the foamed block 212 is coated with a surface active agent, a slip additive, a water repelling agent or the like.

The surface active agent is exemplified by a negative ion type surface active agent, a positive ion type surface active agent, an amphoteric type surface active agent and a non-ion type surface active agent. Alternatively, a fluorine based surface active agent may be employed for the same purpose.

Generally, an oil based lubricant is used as a slip additive. For example, a dibasic acid ester, a silicone or the like is preferably employable as a slip additive. In addition, a manganese disulfate and a steatite are employable as a solid type slip additive, and a grease or the like is employable as a semisolid type slip additive. Additionally, a polyethylene grycerode is preferably used as a water soluble type slip additive because it has few effect on an ink to be used. It should be noted that water and the ink itself to be used can serve as a slip additive.

A high molecular compound having a large number of molecules compared with that of the surface active agent is employable as a water repelling agent, and it is preferable to use a fluorine-containing high molecular compound as a water repelling agent.

It should be noted that at least the surface located opposite to the ink feeding port on the housing 211 is processed by employing a water jet process in order to satisfactorily achieve a printing operation with remarkable reduction of the generation of dust particles.

When it is assumed that substantial inner dimensions of the housing 211 are designated by A and B and outer dimensions of the foamed block 212 are designated by a and b, a dimensional ratio defining the inner tank is determined to establish the relationship represented by the following inequality.

$$0.8 \leqq a/A \times b/B \leqq 1.7$$

Figure 5:
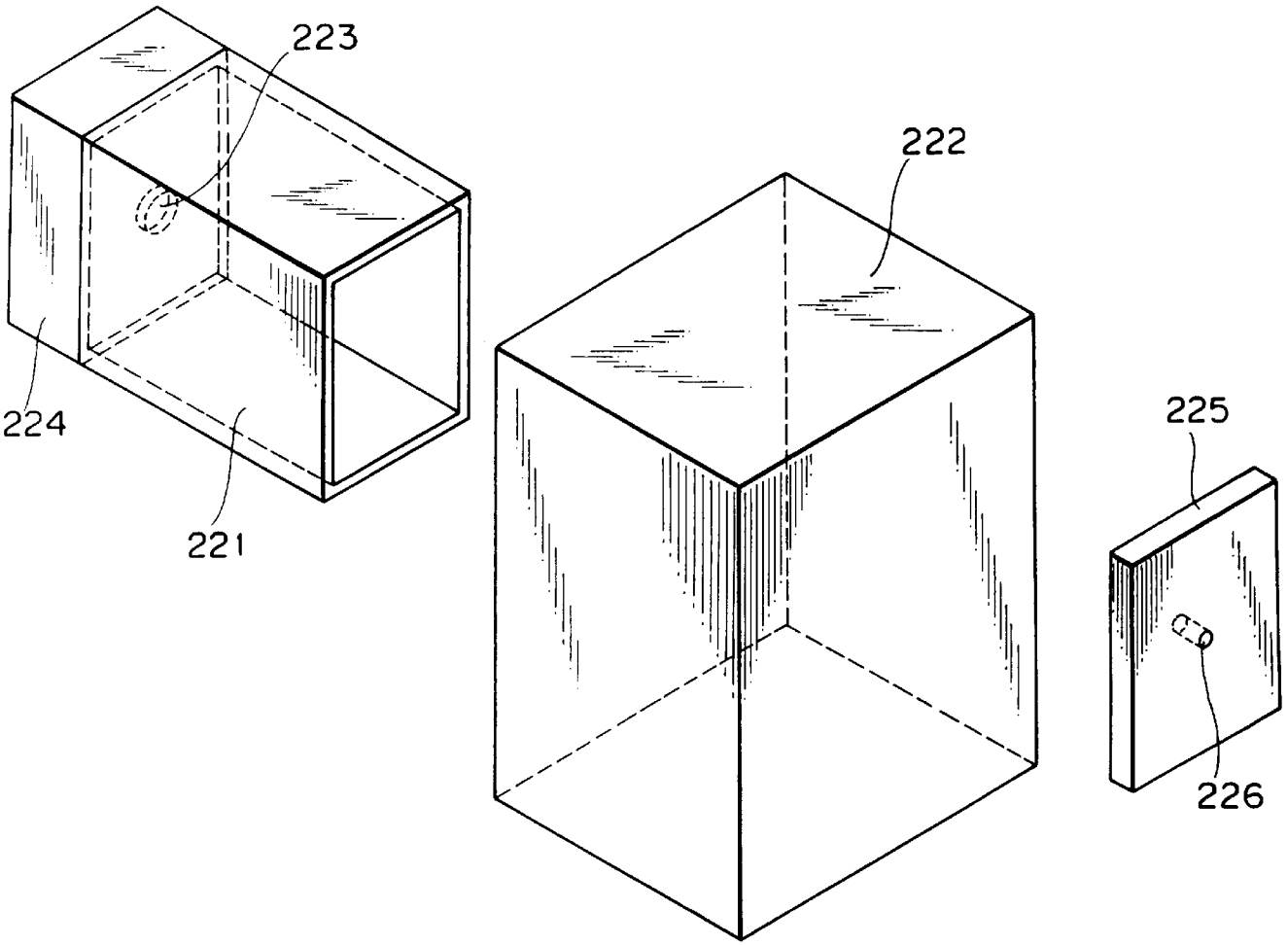
FIG. 5 is a perspective view of an ink tank constructed according to a comparative example which uses urethane foam, showing the structure of the ink tank in the disassembled state.

FIG. 5 is a perspective view of an ink tank constructed according to a comparative example from the second embodiment of the present invention as shown in FIG. 4, particularly showing by way of comparative example the structure of the ink tank in the disassembled state. In this example, a formed block 222 molded of a polyurethane resin serves as an ink absorbent. Specifically, the ink tank includes a foamed block 222 and a housing 221 in which the foamed block 222 is accommodated, and when the latter is practically accommodated in the housing 221, a volume of the foamed block 222 is compressed in the housing 221 at a comparatively large compression rate (ranging from 3 to 5).

The reason why the compression rate is determined to assume a large value as mentioned above consists in that reliability of the ink tank against an occurrence of leakage or a similar malfunction is assured. Generally, a desired intensity of ink retaining force is realized by compressing the foamed block 222 having a low intensity of ink retaining force in the non-compressed state so as to reduce a pore size of the foamed block 222, causing an intensity of capillary force of the foamed block 222 effective for retaining ink in the latter to be enlarged.

In the case that a foamed block molded of a melamine resin is used for the ink tank like in the preceding embodiment, since the melamine foamed block exhibits a high hydrophilic property compared with the urethane foamed block, it is possible to assure a sufficiently high intensity of ink retaining force without any necessity for enlarging the compression rate as mentioned above.

Figure 6:
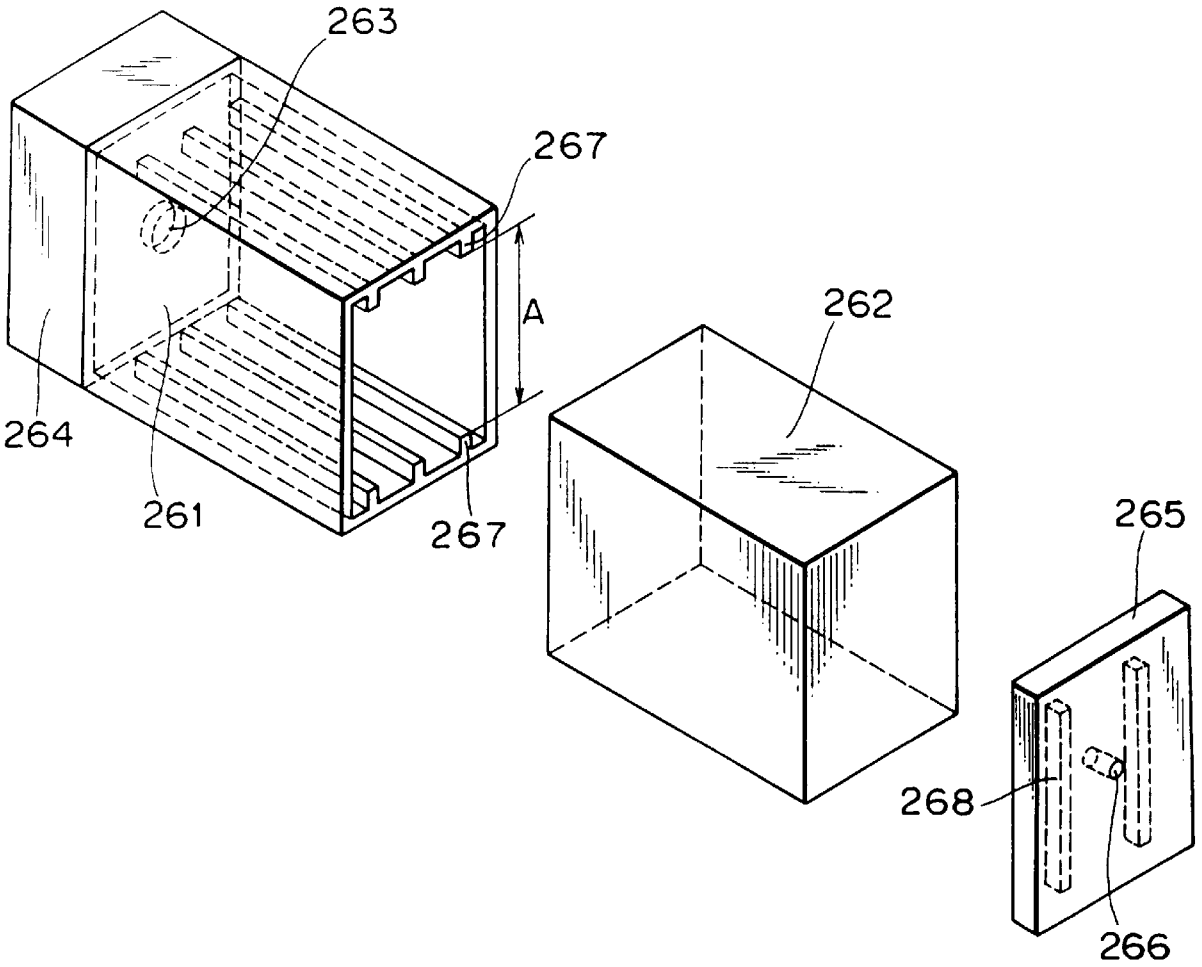
FIG. 6 is a perspective view of an ink tank constructed according to an embodiment modified from the second embodiment of the present invention, showing the structure of the ink tank in the disassembled state.

FIG. 6 is a perspective view of an ink tank constructed according to another embodiment modified from the second embodiment of the present invention shown in FIG. 4, particularly showing by way of example the state that the function of the ink tank is substantially improved. The ink tank includes a foamed block 262 molded of a melamine resin and a housing 261 in which the foamed block 262 is accommodated. In this embodiment, a plurality of ribs 267 each extending toward the ink feeding port 263 side are formed on the inner wall surface of the ink housing 261. With this construction, a plurality of atmospheric air flowing paths each extending in the forward direction to reach the left-hand wall of the housing 261 are maintained in the housing 261, whereby as the ink retained in the foamed block 262 is consumed, an atmospheric air flowing through an atmospheric air communication port 266 is stably substituted for the consumed ink. In this embodiment, a substantial dimension of the housing 261 as measured in the vertical direction is designated by A in the drawing (i.e., a distance between the lower ends of the upper ribs 267 and the upper ends of the lower ribs 267). In addition, to facilitate inflow of an environmental air in the housing 261 from the outside, ribs 268 are formed on a cover 268.

As described above, according to the second embodiment of the present invention, while the ink absorbing block is accommodated in the housing in the operative state compressed at least in one direction, the compression rate of the ink absorbing block is adequately determined, and moreover, a quantity of ink initially charged in the ink absorbing block and an ink feeding ability of the ink tank are satisfactorily determined. Consequently, there hardly arises a malfunction that the ink absorbing block is partially broken or damaged due to frictional rubbing between the housing and the foamed block.

(Modified Example 1 of Second Embodiment)

Figure 7:
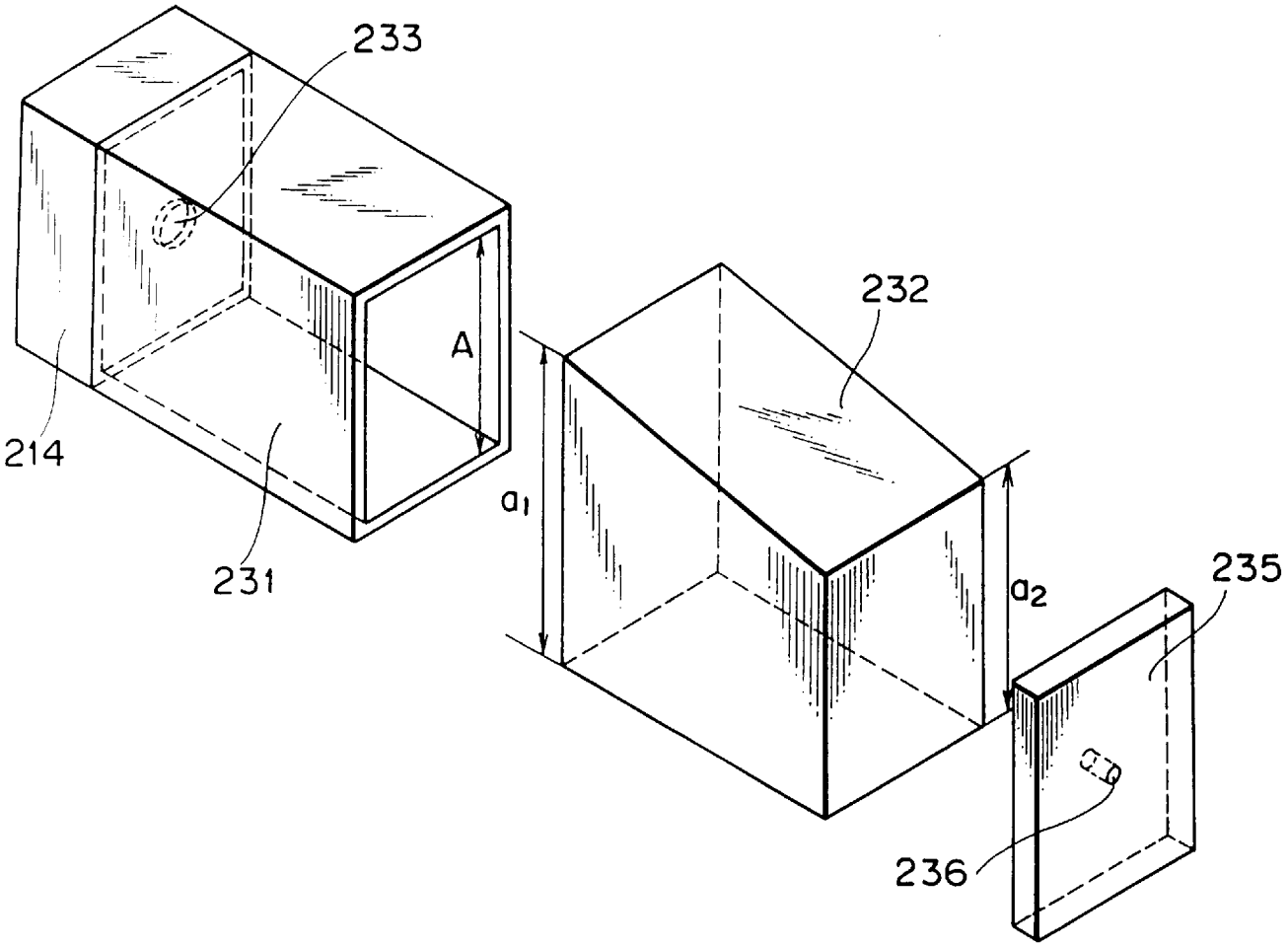
FIG. 7 is a perspective view of an ink tank constructed according to another embodiment modified from the second embodiment of the present invention, showing the structure of the ink tank in the disassembled state.

FIG. 7 is a perspective view of an ink tank constructed according to an embodiment modified from the second embodiment of the present invention, particularly showing the structure of the ink tank in the disassembled state.

Referring to FIG. 7, while a foamed block 232 molded of a melamine resin is accommodated in a housing 231, a dimension a2 of the foamed block 232 located remote from an ink feeding port 233 is determined to be smaller than a dimension a1 of the same located in the proximity of the same so that the foamed block 232 has a certain gradient across the length of the foamed block along the upper surface of the same between both the dimensions a1 and a2. With such construction, while the foamed block 232 is accommodated in the housing 233, a cell size of the foamed block 232 is distributed such that a number of cells are forcibly formed in such a manner as to allow the cell size to become smaller as the measuring position approaches toward the ink feeding port 233 more and more. As a result, since an intensity of ink retaining force becomes higher toward the ink feeding port 233, ink can stably be fed to a printing head 234 attached to the fore surface of the housing 231.

Incidentally, in contrast with the foamed block 232, the same advantageous effects as mentioned above can be obtained also in the case that inner dimensions of the housing 231 are determined in such a manner as to allow them to become smaller toward the ink feeding port 236.

(Modified Example 2 of Second Embodiment 2)

Figure 8:
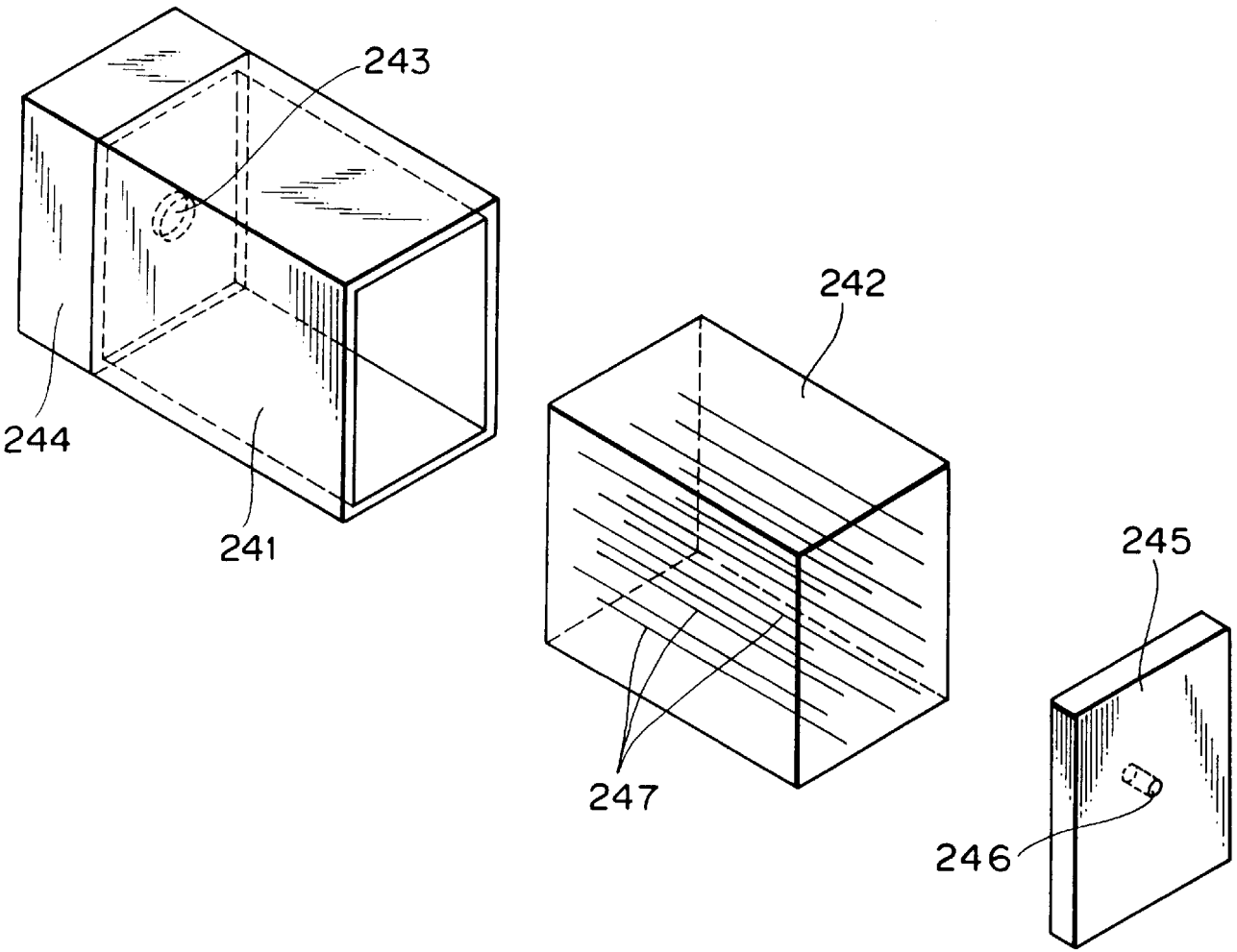
FIG. 8 is a perspective view of an ink tank constructed according to further embodiment modified from the second embodiment of the present invention, showing the structure of the ink tank in the disassembled state.

FIG. 8 is a perspective view of an ink tank constructed according to another embodiment modified from the second embodiment of the present invention, particularly showing the structure of the ink tank in the disassembled state.

Referring to FIG. 8, the ink tank includes a foamed block 242 molded of a melamine resin and a housing 241 in which the foamed block 242 is accommodated, and a number of holes 247 each extending from an atmosphere communicating port 243 side toward an ink feeding port 246 side are formed through the foamed block 242 in the longitudinal direction. With this construction, lattices (composed of fibers) forming a number of cells in the foamed block 242 are separated from each other, causing a part of the foamed block 242 having an enlarged pore size to be forcibly formed.

Consequently, ink can stably be fed to a printing head 244 attached to the fore surface of the housing 241. The extension of each hole 247 from the atmosphere communicating port 246 side toward the ink feeding port 243 side is intended to assure that ink is easily displaced toward the ink feeding port 243 because a part of the ink is displaced through the holes 247 formed in the foamed block 242.

Figure 10B:
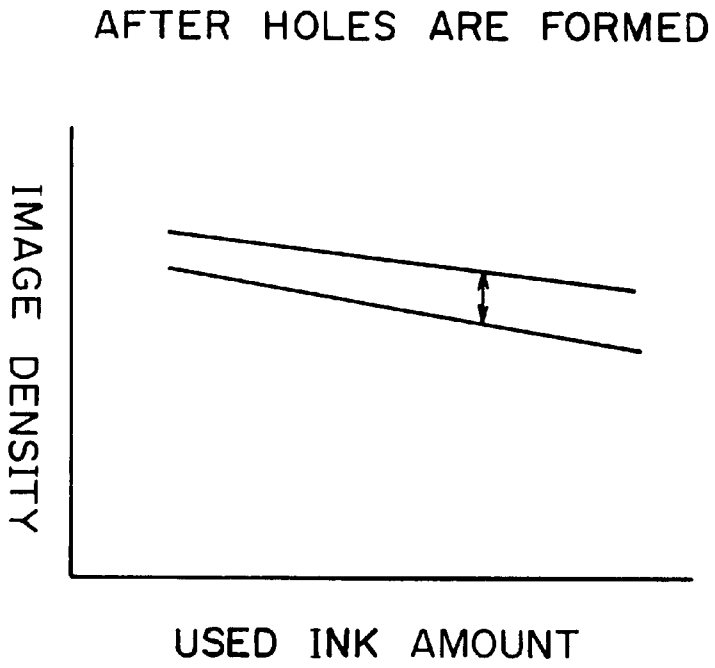
FIG. 10A and FIG. 10B are graphs each of which shows an advantageous effect obtainable from the structure of the ink tank shown in FIG. 8, respectively.
Figure 10A:
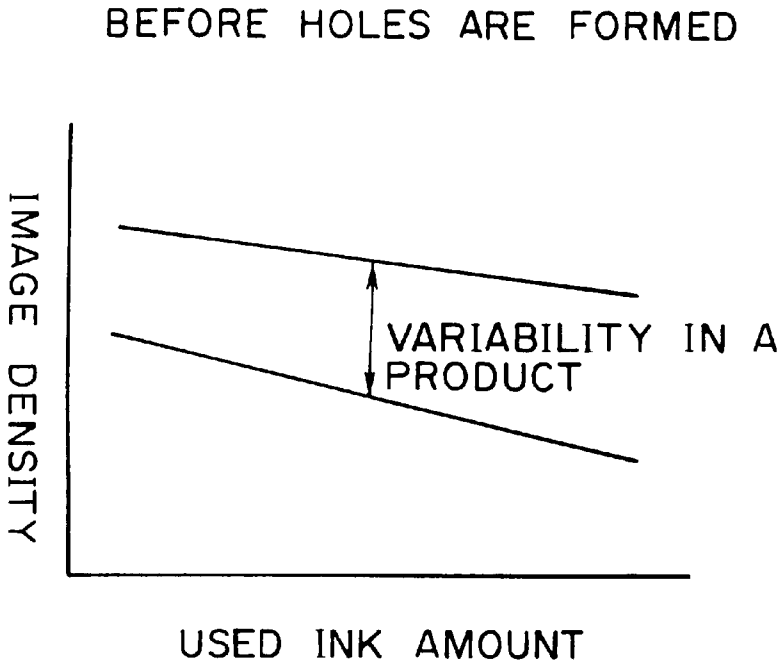

FIG. 10A and FIG. 10B are graphs each of which shows an advantageous effect obtainable from the structure of the ink tank shown in FIG. 8, particularly showing the degree of improvement in respect of fluctuation of a printed image density every production lot before the holes 247 are formed through the foamed block 242 (FIG. 10A) and after they are formed through the same (FIG. 10B), respectively. As is apparent from these graphs, variability of the printed image density in a product is remarkably reduced after the holes 247 are formed through the foamed block 242 in the above-described manner.

(Modified Embodiment 3 of Second Embodiment)

Figure 9:
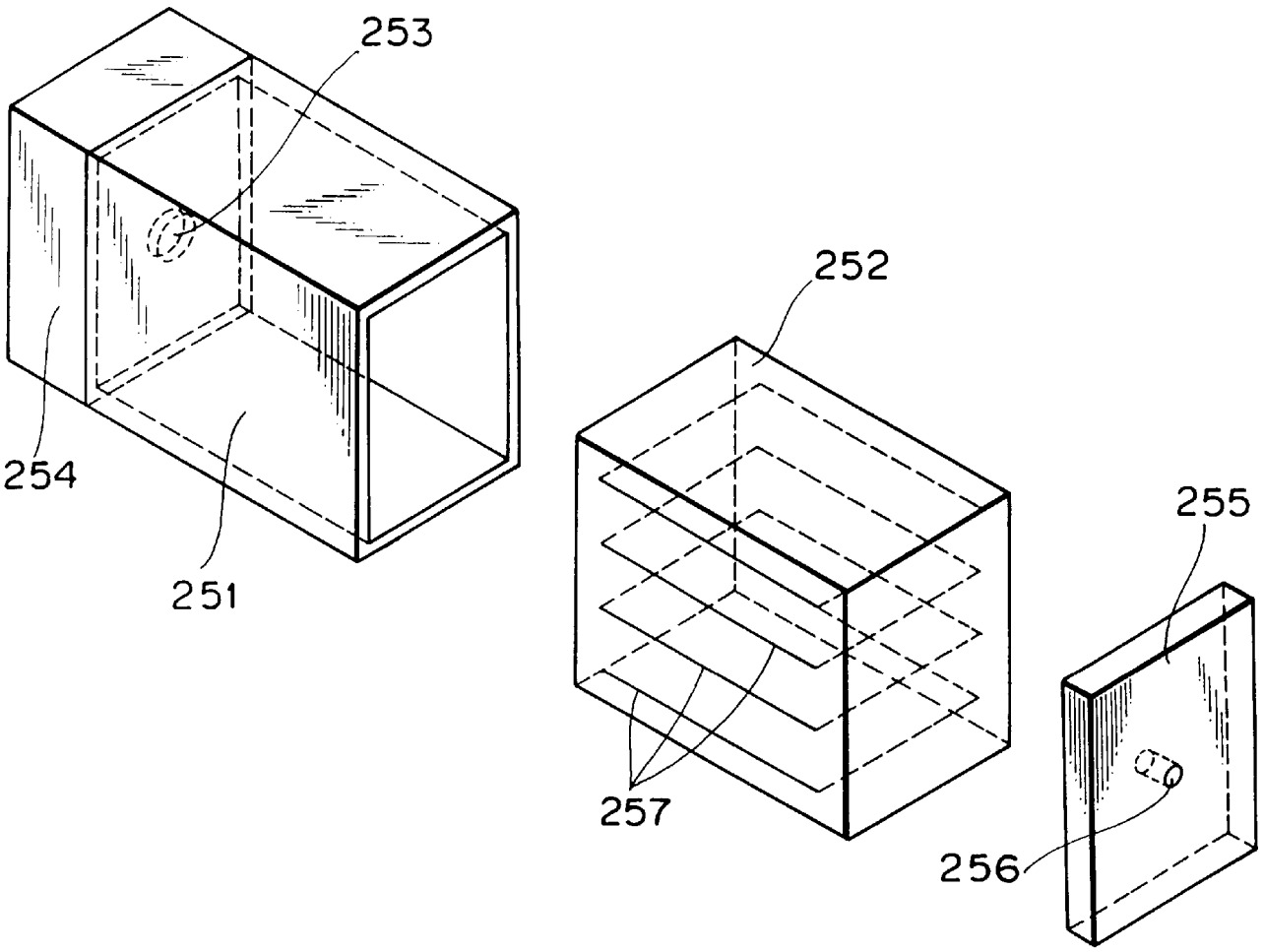
FIG. 9 is a perspective view of an ink tank constructed according to still further embodiment modified from the second embodiment of the present invention, showing the structure of the ink tank in the disassembled state.

FIG. 9 is a perspective view of an ink tank constructed according to another embodiment modified from the second embodiment of the present invention, particularly showing the structure of the ink tank in the disassembled state.

Referring to FIG. 9, the ink tank includes a foamed block 252 molded of a melamine resin and a housing 251 in which the foamed block 252 is accommodated, and a plurality of slits 257 each extending from an atmosphere communicating port 253 side toward an ink feeding port 256 side are formed in the foamed block 252 in the longitudinal direction. With this construction, lattices each forming a cell in the foamed block 252 are separated from each other, causing a pore size in the slit portion to be forcibly largely dimensioned in the foamed block 252. Consequently, ink can stably be fed to a printing head 254 attached to the fore surface of the foamed block 252.

In each of the aforementioned embodiments, to prevent the printing head from being separated from the ink absorbing member, resilient thrusting means such as a spring (a coil spring, a leaf spring or the like) may be disposed in the ink tank so as to allow a certain intensity of resilient force to act on them. This leads to the result that a function for bringing the printing head in close contact with the ink absorbing foamed block can be improved, and moreover, the foregoing function can continuously be maintained with the aid of the resilient thrusting means.

The present invention has been described above with respect to the first embodiment, the second embodiment and the three modified embodiments wherein the ink feeding port is disposed at the central part of the fore surface of the housing of the ink tank but it should of course be understood that the present invention should not be limited only to these embodiments.

For example, in case that the present invention is applied to an ink feeding port which is disposed at a predetermined position offset from the central part of the fore surface of the housing, it is recommendable that the foamed block is slantwise compressed toward the ink feeding port by suitably establishing the relationship between a contour of the foamed block and the housing and a size of each of them. Otherwise, the ink absorbing block is compressed along ink paths formed through the ink absorbing member.

As is apparent from the above description, in each of the aforementioned embodiments, since the foamed block defining the ink absorbing member in the ink tank is compressed in the direction orienting toward the ink feeding port, a pore size of the foamed block as measured in the foregoing direction does not vary but a pore size of the same as measured in the direction orienting at a right angle relative to the foregoing direction is dimensionally reduced. In the circumstances as mentioned above, when each pore size of the foamed block is preliminarily dimensionally enlarged, an intensity of capillary force effective in the compressing direction, i.e., in the direction orienting toward the ink feeding port can be determined to be comparative low, while an intensity of capillary force effective in the direction orienting at a right angle relative to the aforementioned direction can be enlarged. Thus, an ink feeding property can be improved while a predetermined intensity of capillary force is maintained but an intensity of ink retaining force of the foamed block effective in the ink feeding direction is reduced.

Since the ink absorbing member is accommodated in the housing in the compressed state, the ink absorbing member and the housing are brought in close contact with each other at all times. Especially, since the ink absorbing member is brought in close contact with the ink feeding port, there does not arise a malfunction that a gap such as an air layer or the like is formed in the ink feeding paths.

As a result, ink can adequately be fed with the ink tank including the melamine foamed block as an ink absorbing member, especially by activating the printing head at a high ejection frequency.

(Third Embodiment)

This embodiment is intended mainly to illustrate a forming process to be employed when holes and slits described above in the aforementioned embodiments modified from the second embodiment of the present invention are formed in an ink absorbing member molded of a melamine-formaldehyde condensate.

Figure 11:
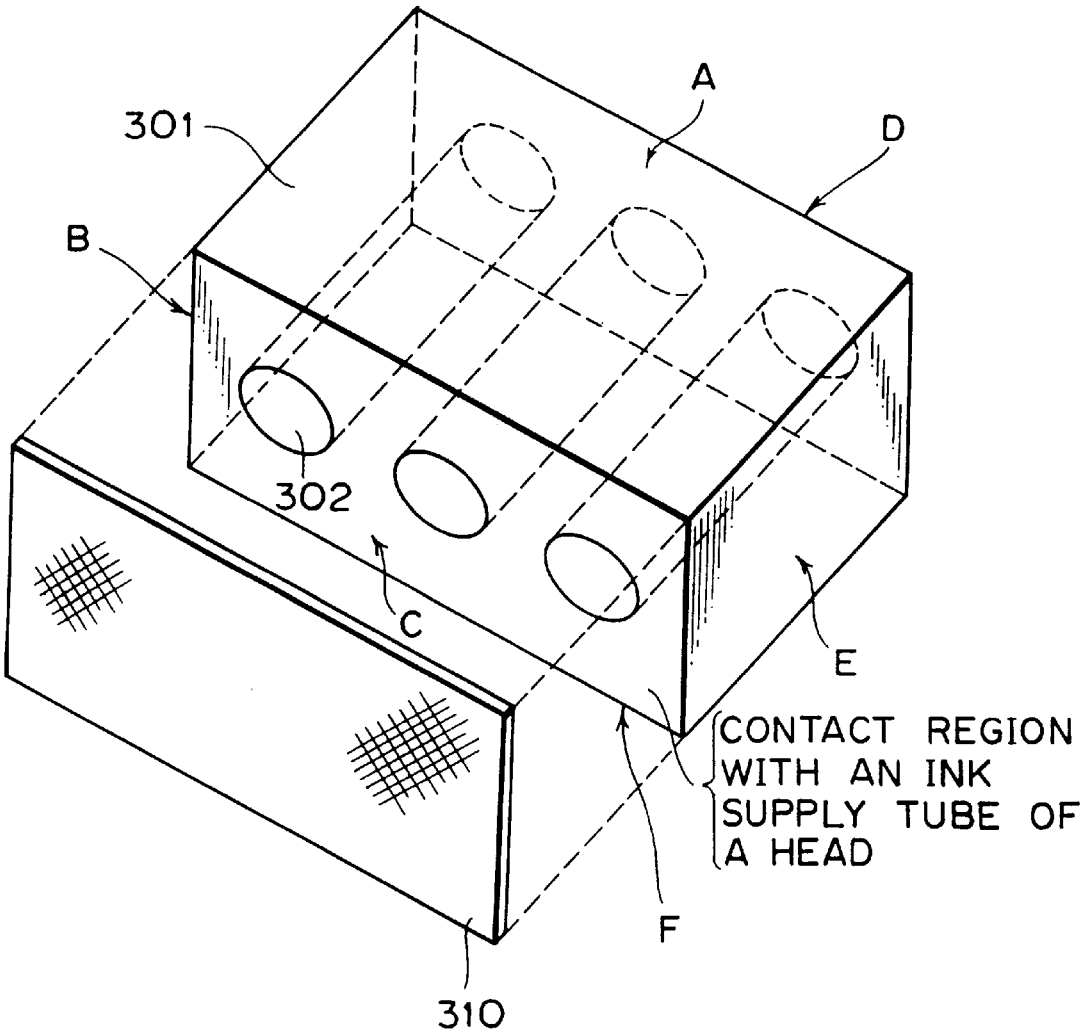
FIG. 11 is a perspective view of an ink absorbing member constructed according to a third embodiment of the present invention.

FIG. 11 shows by way of perspective view the structure of an ink absorbing member constructed according to a third embodiment of the present invention wherein a cutting operation and a hole forming operation are performed for the ink absorbing member by actuating a water jet cutter. In the drawing, reference numeral 301 designates an ink absorbing member, reference numeral 302 designates a plurality of holes each formed by actuating the water jet cutter, and reference numeral 310 designates a filter disposed at an ink outflow portion of the ink absorbing member 301. Incidentally, an ink tank, a housing and a printing head each associated with the ink absorbing member are not shown in FIG. 11 for the purpose of simplification of illustration.

The holes 302 formed through the ink absorbing member 301 shown in FIG. 11 serve to adjust the negative pressure in the ink absorbing member, and at the same time, exhibit a function of allowing ink to smoothly flow toward the filter 310 disposed in the ink outflow portion of the ink absorbing member. Each of the holes 302 extends from the surface located farthest away from the ink outflow portion to the surface located nearest to the same so that the ink smoothly flows through the ink absorbing member. Thus, the function of minimizing EL quantity of ink remaining in the ink tank can be maximized. The respective surfaces A, B, C, D, E and F each defining the ink absorbing member are positionally coincident with those of a head cartridge (not shown). In other words, the holes 302 are formed such that the surface C serving as a contact surface for a printing head (not shown) is communicated with the surface D located on the opposite side therethrough.

Table 4 shows the results derived from evaluations and comparisons conducted when waste particles of each foamed block adhering to the inner wall surface of an ink tank were visually and microscopically observed not only with operator's eyes but also by actuating a microscope wherein fifty ink absorbing members each having the same contour as that shown in FIG. 11 were molded of a polyurethane resin and a melamine-formaldehyde condensate each usable as a raw material, and subsequently, a cutting operation and a hole forming operation were performed by actuating a water jet cutter and a blade made of a metallic material (i.e., a press blade)

TABLE 4

| working means | material employed for molding a foamed block: melamine-formaldehyde condensate | polyurethane |
|---|---|---|
| blade made of metallic material (press blade) | x | Δ–○ |
| water jet cutter | ○ | ○ |

Among the three marks shown in Table 4, a mark of ○ represents that a small quantity of waste particles were recognized with each foamed block, a mark of Δ represents that an appreciably large quantity of waste particles were recognized with the same and a mark of × designates that a large quantity of waste particles were recognized with the same. As is apparent from Table 4, in the case that a polyurethane resin is used as a raw material for molding an ink absorbing member and the foamed block is worked by actuating the blade made of a metallic material in the same manner as the conventional foamed block, comparatively good results are obtained but an effect of remarkably reducing a quantity of waste particles is not recognized with the foamed block when the latter is worked by actuating the water jet cutter. On the contrary, in the case that a melamine formaldehyde condensate is used as a raw material for molding an ink absorbing member, a large quantity of waste particles is generated with the foamed block when the latter is worked by actuating the blade made of a metallic material and the generation of waste particles can largely be reduced when the foamed block is worked by actuating the water jet cutter.

When a foamed block for retaining ink therein is produced, working of the foamed block, e.g., formation of holes or slits is hitherto achieved by cutting or compressing it with a blade made of a metallic material or a ceramic material, and after completion of the working, the foamed block is subjected to heat treatment to assume a desired contour. Subsequently, the foamed block is accommodated in an ink tank. As is apparent from the results derived from a series of experiments, in the case that an ink absorbing member is molded of a foamed polyurethane, generation of waste cut pieces or particles does not become a serious problem. However, when a thermosetting foamed product molded of a condensate, e.g., a melamine-formaldehyde condensate or the like composed of a compound having an amino group and a formaldehyde while including a porous structure having a three-dimensional divergent circuit network is worked by actuating a blade made of a metallic material or a ceramic material, a comparatively large quantity of cut waste pieces or particles are sometimes generated. In addition, when the foamed block is subjected to heat treatment, soot is generated with the foamed block or elution of impurities in the foamed block occurs. This leads to the problem that a plurality of ink ejection openings or liquid paths are clogged with waste particles or a filter disposed in an ink tank likewise is clogged with waste particles, resulting in increased pressure loss or reduced ink flow rate. Further, there is a possibility that chemical properties of the ink are degraded due to the elution of impurities, causing performances of each printing operation to be adversely affected.

Therefore, it is recommendable that the thermosetting foamed block is worked by actuating the water jet cutter like in this embodiment, because appearance of the aforementioned problems can be suppressed, and moreover, a step of cleaning the foamed block after completion of the working can be eliminated.

When the water jet cutter is employed, it is preferable that a nozzle is dimensioned to have a diameter ranging from 0.05 to 2.50 mm and a water pressure is set to the range of 1000 to 4000 kgf/cm$^2$ in order to improve a level of utilization efficiency of the water jet cutter and a working speed for the foamed block. In addition, it is more preferable that the nozzle is dimensioned to have a diameter ranging from 0.1 to 0.2 mm and the water pressure is set to the range of 2000 to 3000 kgf/cm$^2$ in order to work the foamed block at a high efficiency without any useless step.

Figure 12:
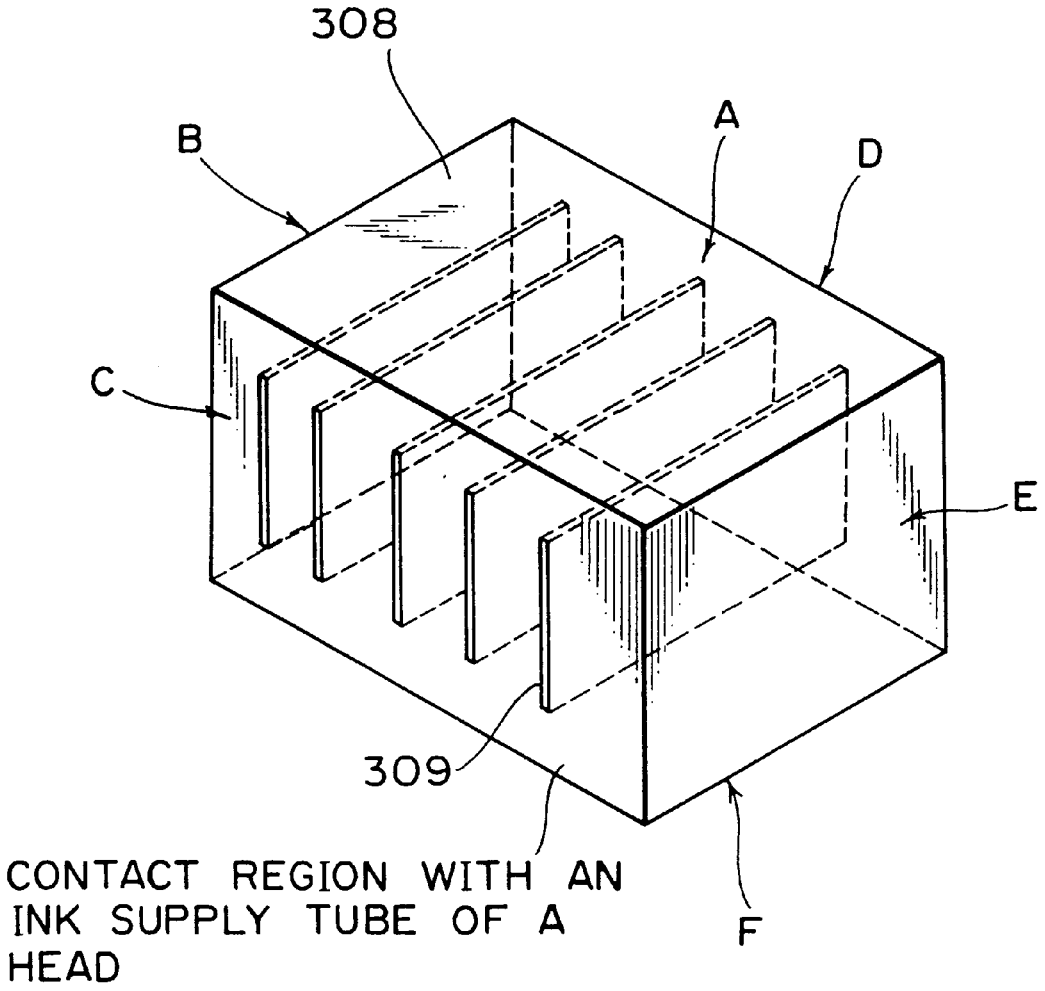
FIG. 12 is a perspective view of an ink absorbing member constructed according to an embodiment modified from the third embodiment of the present invention.

FIG. 12 shows by way of perspective view the structure of an ink absorbing member constructed according to an embodiment modified from the third embodiment of the present invention wherein a foamed block of the ink absorbing member usable as a raw material for the latter is subjected to cutting and slitting by actuating a water jet cutter. In the drawing, reference numeral 308 designates an ink absorbing member, and reference numeral 309 designates a plurality of slits formed in the ink absorbing member 308.

The slits 309 serve to adjust the negative pressure, and moreover, exhibit a function of allowing ink to smoothly flow through the ink absorbing member 308 in the same manner as the holes 302 as described above in the preceding embodiment. The ink absorbing member 308 shown in the drawing is employable for a head cartridge. Each of the slits 309 extends from the surface located farthest from an ink outflow portion to the surface located nearest to the same, whereby ink can smoothly flow through the ink absorbing member 308. Consequently, the ink absorbing member 308 can exhibit a function of minimizing a quantity of ink remaining in an ink tank to the maximum extent. Respective surfaces A, B, C, D, E and F of the ink absorbing member 308 shown in FIG. 12 are exactly positionally coincident with those of a head cartridge. In other words, the slits 309 are formed so as to allow the surface C adapted to come in contact with a surface on the printing head side to be communicated with the surface D located opposite to the surface C via the slits 309.

Table 5 shows the results derived from measurements conducted for confirming on the average basis from what number of printing paper the printed image density becomes weak when a recording operation is practically performed at a rate of printed area of 6% using printing papers each having an A 4 size under a condition that a foamed block is inserted in a head cartridge and it is then charged with ink wherein fifty foamed blocks each having the same contour as that shown in FIG. 12 were molded of not only a polyurethane resin but also a melamine-formaldehyde condensate, and subsequently, a cutting operation and a slitting operation were performed by actuating a water jet cutter and a blade made of a metallic material (i.e., a press blade)

TABLE 5

| working means | material employed for molding a foamed block: melamine-formaldehyde condensate | material employed for molding a foamed block: polyurethane |
|---|---|---|
| blade made of metallic material | 311.4 pieces | 443.1 pieces |
| (press blade) water jet cutter | 492.8 pieces | 459.2 pieces |

When it is found as a result derived from a measurement conducted by using a Macbeth reflection density meter of model NO. RD-918 having a normal reflection density of 1.3 or more that the reflection density measured on the fully printed part of a recording paper assumes a value of 1.2 or less, it can visually be recognized that the printed image density becomes weak. Thus, when the reflection density on the fully printed part of the recording paper assumes a value of 1.2 or less, any user can determine that the printed image density becomes weak. In order to investigate the reason why the printed image density became weak, the inventor removed a foamed body from an ink tank, and thereafter, it was found that an ink flow rate was reduced at the position where waste particles of the foamed body adhered to a filter.

It was confirmed based on the results shown on Table 5 that employment of the water jet cutter, especially at the time of use of the foamed body molded of a melamine-formaldehyde condensate remarkably contributed to continuous maintenance of a high quality of printed image or improvement of the same.

It should be noted that the position where the ink absorbing member is worked by actuating the water jet cutter should not always be limited only to the whole side surface of the ink absorbing member. Provided that it is assured that cut waste particles or the like generated by working the ink absorbing member by actuating a metallic cutter can not reach an ink outflow portion of the ink absorbing member without any appearance of a problem in respect of an ink feeding ability owing to the fiber structure of the ink absorbing member as well as in the presence of a contact portion where the ink absorbing member comes in contact with the inner wall surface of the ink tank, it is acceptable that only a necessary part of the ink absorbing member, e.g., a surface located opposite to the ink outflow portion of the ink absorbing member is worked by actuating the water jet cutter and other part rather than the foregoing one is worked by actuating a metallic cutter or a similar conventional tool. In addition, of course, it is obvious that a part of the ink absorbing member, e.g., a hole, a slit or the like for adjusting the negative pressure in the ink absorbing member or for allowing ink to smoothly flow toward the ink outflow portion should not be limited only to that shown in FIG. 11 or FIG. 12 and that the number of parts of the foregoing kind, the position where the foregoing part is located, dimensions of this part and a contour to be assumed by this part are adequately determined.

As described above, according to the third embodiment of the present invention, an ink absorbing block to be accommodated in the ink tank can be formed without any generation of cut waste particles or impurities during each working operation by actuating the water jet cutter for the purpose of working of the foamed block for retaining ink therein, e.g., forming of holes or slits in the foamed block. Thus, a yielding rate for producing the ink absorbing member and the ink tank in which the ink absorbing member is accommodated can be improved, and as the ink feeding ability is improved, a requirement for activating the printing head at a high ejection frequency can satisfactorily be met with an elevated quality of printed image. Since the water jet cutter is actuated while using a water stream during each working operation, the foamed block can simultaneously be cleaned only with a small amount of expenditure additionally required for a piping operation. This leads to an advantageous effect that a process of forming the ink absorbing member can be simplified.

(Fourth Embodiment)

This embodiment is concerned with the structure of an ink tank and the structure of an ink outflow portion for feeding ink from the ink tank to a printing head in the case that an ink absorbing member molded of a melamine-formaldehyde condensate is used for the ink tank in the same manner as each of the aforementioned embodiments.

Figure 13:
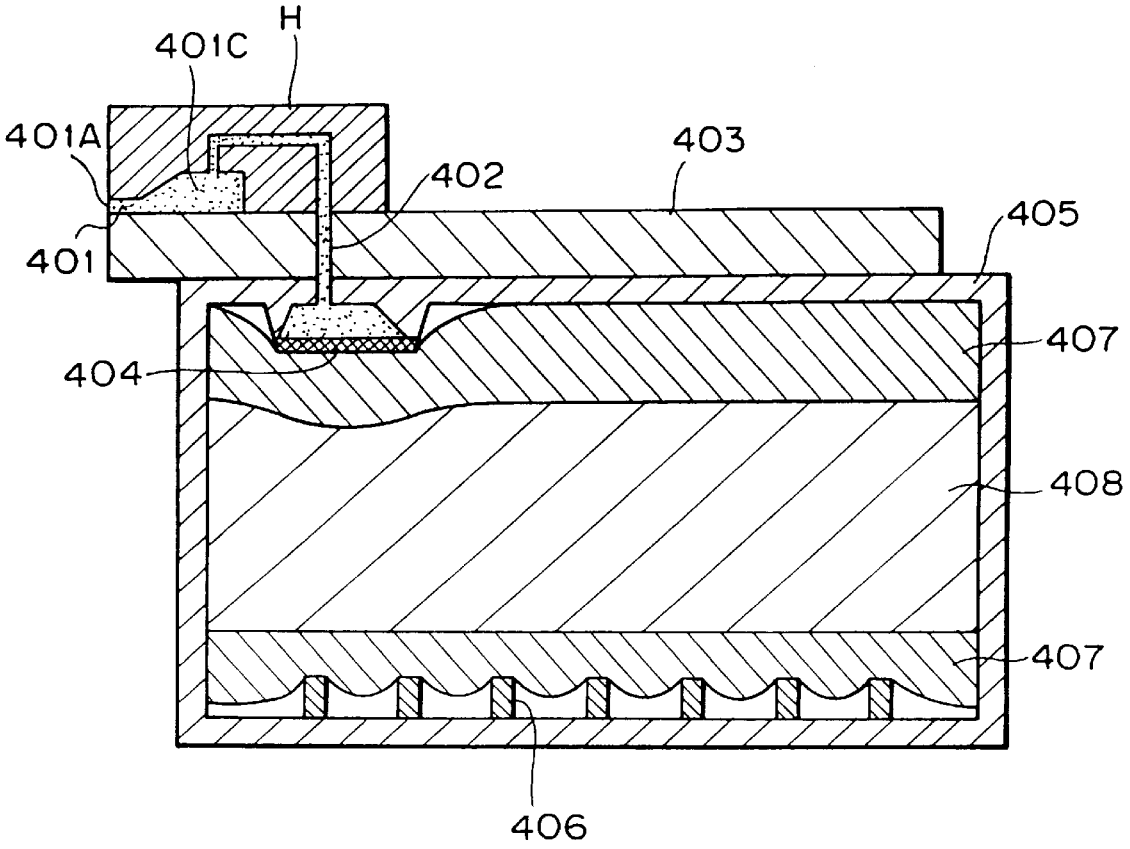
FIG. 13 is a schematic sectional view of a head cartridge of the type integrated with an ink tank according to a forth embodiment of the present invention, showing by way of example of the structure of the head cartridge.

FIG. 13 is a schematic sectional view of an ink absorbing member, i.e., a head cartridge of the type integrated with an ink tank constructed according to a fourth embodiment of the present invention, showing by way of example the structure of the head cartridge. In this embodiment, a printing head designated by reference character H includes liquid paths 401 which are arranged in the direction orienting at a right angle relative to the plane of the drawing and which correspond to a plurality of ink ejecting openings 401A. To generate energy required for ejecting ink from the ink ejecting openings 401A, it is recommendable to employ an electrothermal converting element for heating ink so as to generate a bubble with the ink in order to achieve ink ejection under the influence of the pressure induced by the bubble, an electromechanical converting element, e.g., a piezoelectric element for generating vibrations in ink or the like. The ink is fed via an ink feeding tube 402 from an ink tank 405 secured to the head H with a base plate 403 interposed therebetween to the liquid paths 401 or a common liquid chamber 401C communicated with the liquid paths 401. The lower end of the ink feeding tube 402 serves as an ink outflow or feeding port of the ink tank 405, and a filter 404 is disposed at the ink outflow port of the ink tank 405. The filter 404 serves to prevent the liquid path 401 and associated components from being clogged with dust particles involved in an ink absorbing member, causing a quality of printed image to be degraded. In addition, the filter 404 serves to prevent small bubbles present in the ink absorbing member from reaching each liquid path 401 to induce a malfunction that ink is incorrectly ejected from the ink ejecting openings 401A.

It is preferable that an opening area of the ink outflow port is determined to assume a large value not only in consideration of the number of liquid paths 401, dimensions of each liquid path 401 and a frequency employable for driving the foregoing energy generating element but also in consideration of the fact that as a quantity of ink passing through each liquid path 401 per unit time increases, a property of frequency responsiveness is degraded. On the other hand, in the case that a filter is disposed at the ink outflow portion of an ink tank like in the embodiment, to assure that an ink tank is produced at an inexpensive cost, it is required from the viewpoint of a production cost that the filter is designed to have small dimensions as far as possible. To satisfactorily meet the foregoing requirement, it is acceptable that an opening area of the ink outflow portion of the ink tank is adequately determined. In this embodiment, the filter 404 is disposed at the ink outflow portion of the ink tank in such a manner as to come in pressure contact with an ink absorbing member 407 having high elasticity. Thus, the filter 404 itself is brought in close contact with the ink absorbing member 407. Alternatively, the filter 404 may be disposed at the intermediate position of an ink feeding tube 402 which extends in the printing head H to reach the liquid paths 401. A metallic material, a synthetic resin or the like can be used as a structural material constituting the filter 404.

In this embodiment, the ink absorbing member 408 basically composed of a number of single fibers is accommodated in the ink tank 405. The ink absorbing member 408 includes a porous three-dimensional divergent circuit network molded of a thermosetting melamine condensate or the like having no cell film formed therein as described in each of the aforementioned embodiments. That is, the ink absorbing member 408 is constructed of a thermosetting foamed block molded of a condensate composed of a compound having an amino group and a formaldehyde as a base material. Since the ink absorbing member 408 composed of a number of single fibers has no cell film formed therein, an advantageous effect of the ink absorbing member 408 is that a very small quantity of ink remains in the ink absorbing member 408 after completion of a recording operation performed using the ink storably received in the ink tank 405.

In contrast, in the case that an ink absorbing member is molded of a foamed polyurethane resin which is hitherto usually used as a raw material, a cell film is formed in the ink absorbing member. Thus, ink is liable to adhere to the remaining film portion, causing ink having a quantity of about 10 to 20% based on an initially charged quantity to finally uselessly remain in the ink absorbing member. For this reason, it is preferable to employ an ink absorbing member made of a number of single fibers like the ink absorbing member 408 for an ink absorbing block serving as an ink impregnant.

In this embodiment, two ink absorbing blocks 407 each molded of a foamed polyurethane resin while exhibiting high elasticity or two members each having high elasticity are accommodated in the ink tank 405 in addition to the ink absorbing member 408 made of a number of single fibers. The positions where the ink absorbing blocks 407 are accommodated in the ink tank 405 in that way are determined to be positionally coincident with those where a high intensity of pressure is applied to the ink absorbing member 408. In this embodiment, the position where one of the ink absorbing blocks 407, i.e., the upper ink absorbing block 407 is accommodated in the ink tank 405 is positionally coincident with an ink outflow portion or a pressure contact portion where the ink absorbing block 407 comes in pressure contact with the ink absorbing member 408. In addition, in this embodiment, a plurality of ribs 406 are formed on the bottom wall of the ink tank 405 in such a manner as to allow the ink absorbing block 407 to apply a certain intensity of pressure to the ink absorbing member 408 from below while coming in pressure contact with the latter.

Specifically, in this embodiment, the filter 404 disposed at the lower end of the ink feeding tube 402 positionally coincident with the ink outflow portion of the ink absorbing member 408 is effective for pressing the ink absorbing member 408 from above, and moreover, the ribs 406 serve as compressing means effective for pressing the ink absorbing member 408 from below.

Figure 14:
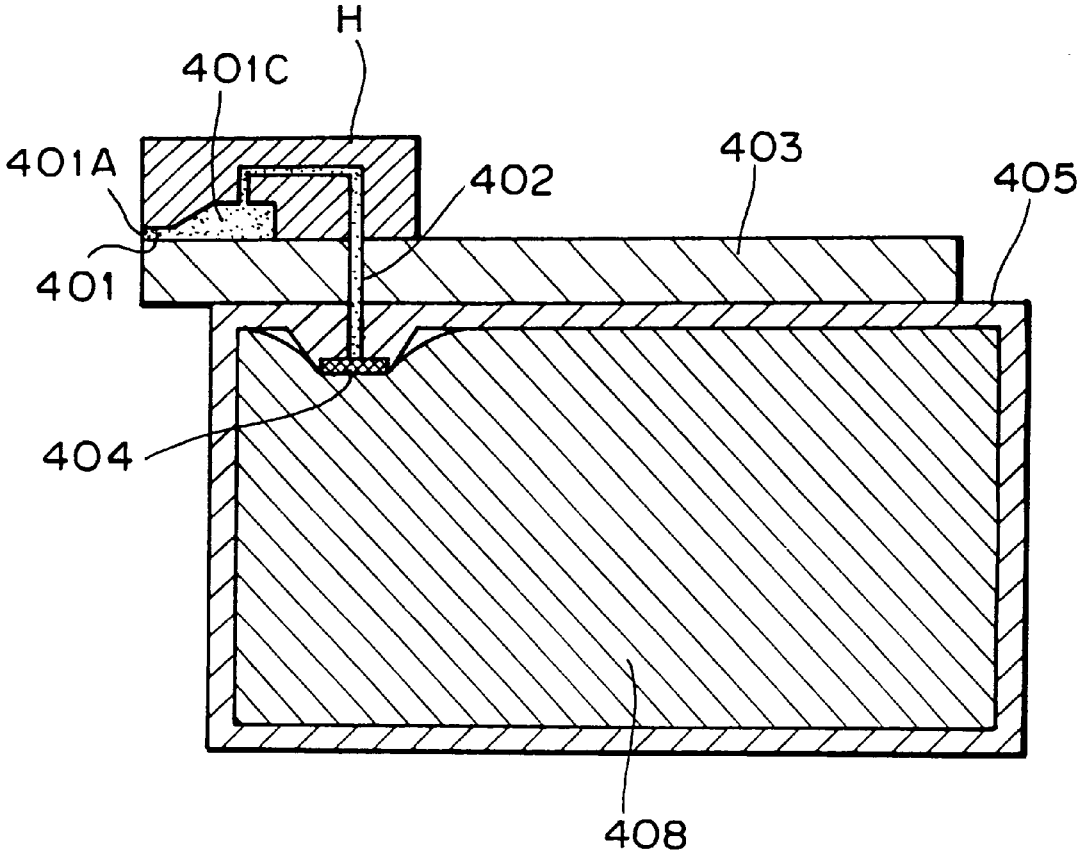
FIG. 14 is a schematic sectional view similar to FIG. 13, showing by way of comparative example of the structure of a head cartridge of the type integrated with an ink tank according to the fourth embodiment of the present invention.

In practice, a various kind of material exhibiting poor elasticity is employed for the ink absorbing member 408 made of a number single fibers. For example, in the case that the ink absorbing member 408 is molded of a thermosetting melamine condensate, when a high intensity of pressure is applied to the ink absorbing member 408, i.e., when the filter 404 or the ink outflow portion is brought directly in pressure contact with the ink absorbing member 408 as shown in FIG. 14, there arises a malfunction that a three-dimensional divergent circuit network of the ink absorbing member 408 is broken or damaged and, after the pressure disappears, it can not be restored to the original configuration, resulting in permanent deformation occurring with the ink absorbing member 408. In this embodiment, the two ink absorbing blocks 407 each having excellent elasticity are arranged at the positions located opposite to the ink outflow portion and the ribs 406 so as to allow the ink absorbing blocks 407 to be elastically deformed due to close contact with projected parts of the ink outflow portion and the ribs 406 in order to attenuate or alleviate the pressure applied to the ink absorbing member 408. With this construction, the ink absorbing member 408 is hardly deformed without any possibility that the structure thereof is broken or damaged.

Next, a necessity for bringing the ink absorbing member in pressure contact with the ink outflow portion or the filter 404 disposed in the ink absorbing member will be described below with reference to FIG. 15 and FIG. 16.

Figure 15:
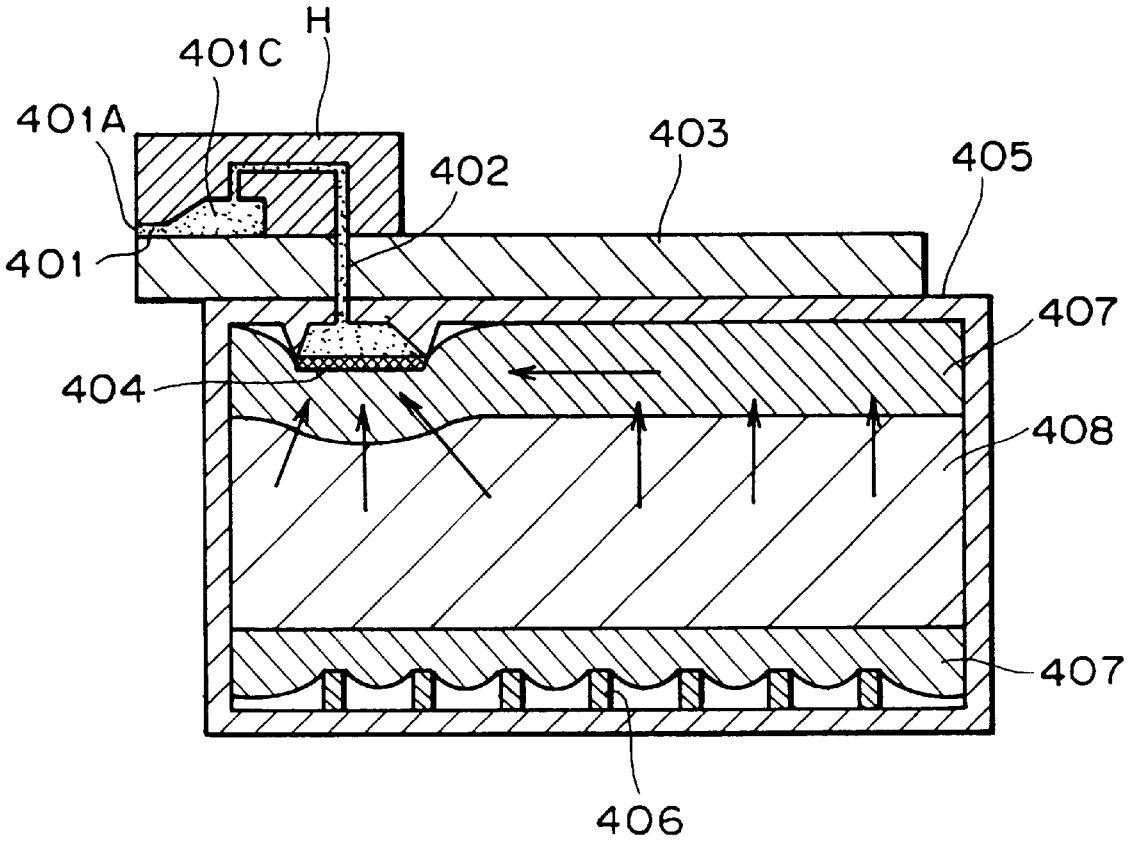
FIG. 15 is an illustrative sectional view of an ink tank shown in FIG. 13, showing how ink flows in the ink tank.
Figure 16:
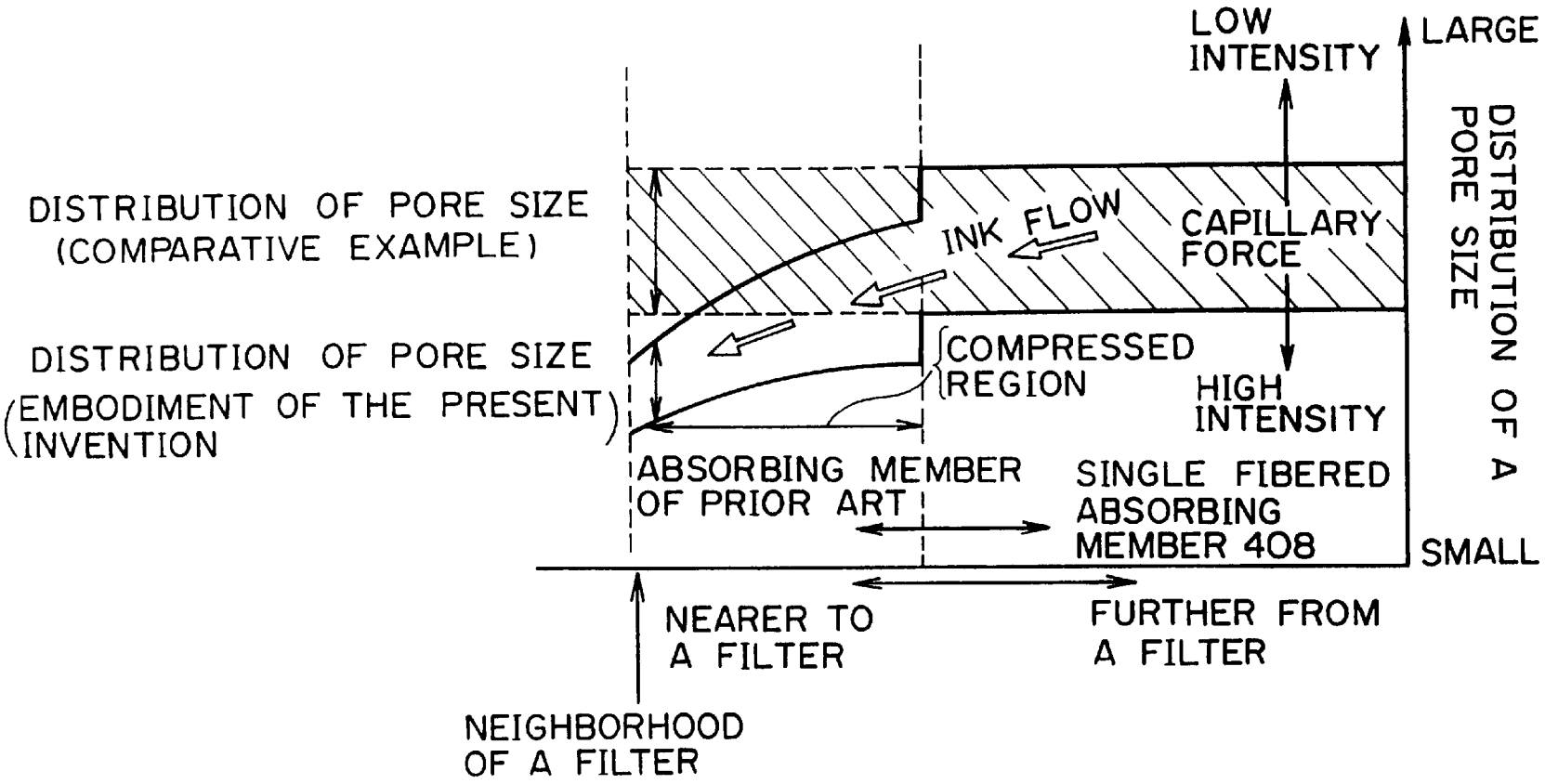
FIG. 16 is an illustrative view which shows the distribution of a pore size measured with respect to a number of pores formed through an ink absorbing member accommodated in the ink tank while illustratively explaining how ink easily flows through the pores of the ink absorbing member in the ink tank.

FIG. 15 is an illustrative sectional view of an ink tank 405 constructed according to the fourth embodiment of the present invention, particularly showing how ink flow in the ink tank, and FIG. 16 is a graph which shows the distribution of a pore size measured with respect to a number of pores formed through an ink absorbing member received in the ink tank while illustratively explaining how ink easily flows through the pores of the ink absorbing member in the ink tank.

A pore size of each of the pores formed in the ink absorbing member is dimensioned to largely fluctuate due to various conditions associated with production of ink tanks. In this connection, a mechanism for retaining ink in the ink absorbing member is operated by the action of a capillary force given by each pore. As is apparent from a principle representing a capillary phenomenon, the smaller the pore size, the higher the intensity of force effective for absorbing ink in each pore. Since the pore size fluctuates in that way, an intensity of ink absorbing force correspondingly fluctuates in such a manner as to allow ink to remain in the region where each pore is dimensioned to have a small pore size (i.e., the region where the capillary power exhibits a high intensity) with a problem that it is difficult that the ink flows out of the pore in the course of consumption of the ink. While the foregoing state is unchangeably maintained, an ink consumption efficiency is degraded.

The part defined by hatched lines in FIG. 16 represents the state that the filter is not brought in pressure contact with the ink absorbing member. At this time, the capillary power of the ink absorbing member uniformly fluctuates in the ink tank. This leads to the result that any force effective for displacing ink in the direction orienting toward the filter is not generated by the capillary force derived from each pore but the flowing of ink to be fed to the recording head H is achieved mainly by the negative force arising in the printing head side.

In this embodiment, to cope with the foregoing malfunction, since the ink absorbing blocks 407 each having high elasticity and the ink absorbing member 408 made of single fibers are brought in pressure contact with the ink outflow portion or the filter 404, the pore size can forcibly be changed by the foregoing pressure contact regardless of how the pore size fluctuates, whereby the direction of displacement of the ink can be oriented toward the ink outflow portion side as illustrated by arrow marks in FIG.

15. Distribution of the pore size in the ink absorbing member constructed in the above-described manner is represented by solid lines each having a comparatively large width in FIG. 16. As is apparent from the drawing, a force effective for allowing to ink to be collected in the vicinity of the ink outflow portion having a small pore size, i.e., a high intensity of capillary force is generated by compressing the ink absorbing member in such a manner that the pore size becomes smaller than the smallest pore size employable when the ink absorbing member is used in the non-compressed state. In addition, when the ink absorbing blocks 407 each having a pore size smaller than that of the ink absorbing member 408 is used, a quantity of ink remaining after completion of the practical use of the ink tank can be reduced, resulting in an ink use efficiency being increased. In the case that the ink absorbing member is used in the uncompressed state, ink is caused to flow only by the gravity weight thereof. For this reason, the position assumed by the ink outflow portion relative to the ink tank is restrictively determined in such a manner as to allow the ink outflow portion to be substantially oriented in the downward direction. In contrast with the foregoing case, according to the fourth embodiment of the present invention, ink can be fed to the ink outflow portion not only in the upward direction but also in the transverse direction. In other words, limitative restriction on an attitude to be assumed when an ink tank or a head cartridge is used for performing a recording operation can be alleviated.

As is apparent from the above description, it is very advantageously effective that the ink absorbing member made of single fibers is adequately compressed. However, in the case that an ink absorbing member made of single fibers while exhibiting low elasticity is brought directly in pressure contact with the filter or the ink outflow portion in the same manner as the ink absorbing member having high elasticity, structural breakage occurs with the ink absorbing member. Thus, there arise malfunctions that the contour of each pore is undesirably deformed, the capillary force is hardly generated, and the filter is covered with pulverized fiber particles, causing it to clogged with them.

In this embodiment, a plurality of ribs 406 are formed on the bottom wall of the ink tank 406 so as to allow the ink absorbing member 408 made of single fibers to be pressed against the filter 407. Thus, a high intensity of pressure is generated by the ribs 406 while the ink absorbing block 407 having high elasticity is interposed between the ribs 406 and the ink absorbing member 408 made of single fibers. In the case that any structural breakage does not occur or the pressure having such a low intensity that no particular problem appears with the ink absorbing member 408 is applied to the latter like in the case that the pressing member has a wide pressing area, there does not arise a necessity for arranging an ink absorbing block having a high elasticity for the ink absorbing member 408. This case is exemplified by the case that a certain intensity of compressing force is applied to the inner wall surface of the ink tank located on the opposite side relative to the ink outflow portion or the filter 404 without any formation of the ribs 406 on the bottom wall of the ink tank.

Alternatively, the compressing force may be applied to the inner wall surface of the ink tank other than the foregoing one in order to assure that ink adequately flows in the ink absorbing member 408. Otherwise, inner dimensions of the ink tank may be determined to be appreciably smaller than outer dimensions of the ink absorbing member 408 in order to assure that the ink absorbing member 408 is accommodated in the ink tank in the adequately compressed state.

The aforementioned facts are equally applicable to embodiments modified from the fourth embodiment of the present invention.

(Modified Embodiment of the Fourth Embodiment)

Figure 17:
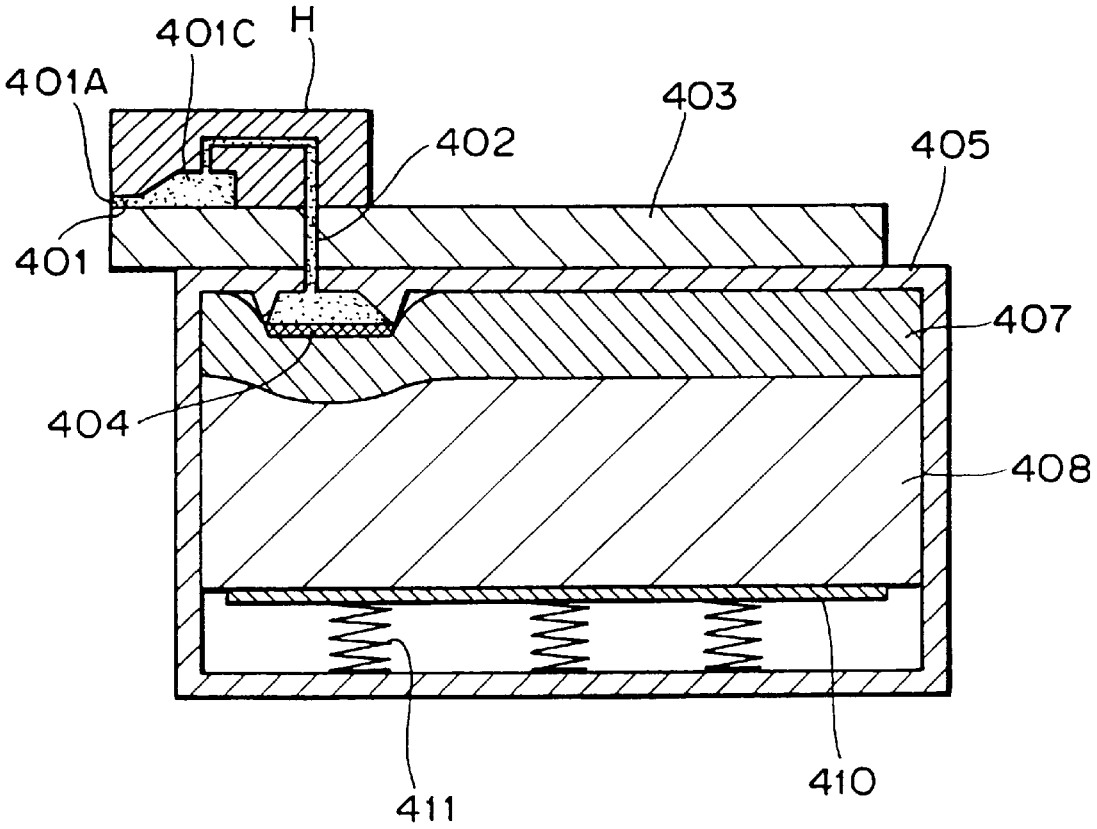
FIG. 17 is a schematic sectional view of a head cartridge of the type integrated with an ink tank according to an embodiment modified from the fourth embodiment of the present invention.

FIG. 17 shows by way of schematic sectional view the structure of a head cartridge of the type integrated with an ink tank according to an embodiment modified from the fourth embodiment of the present invention wherein a plurality of compression coil springs are used as second compressing means for pressing an ink absorbing member against a filter or an ink outflow portion of the ink tank. In this embodiment, the pressing force given by the springs 411 is applied to an ink absorbing member 408 made of single fibers via a plate-shaped member 410 having a comparative wide area. According to this modified embodiment, the pressing force can be accurately adjusted.

The second compressing means should not be limited only to the compression coil springs as shown in the drawing. Any type of suitable member can be employed in place of the compression coil springs, provided that it is proven that it can utilize an elastic restoring force given by a material constituting the foregoing member. For example, a leaf spring made of a metallic material, a synthetic resin or the like, an air pressure spring or the like can be noted as second thrusting means.

(Modified Embodiment 2 of the Fourth Embodiment)

Figure 18:
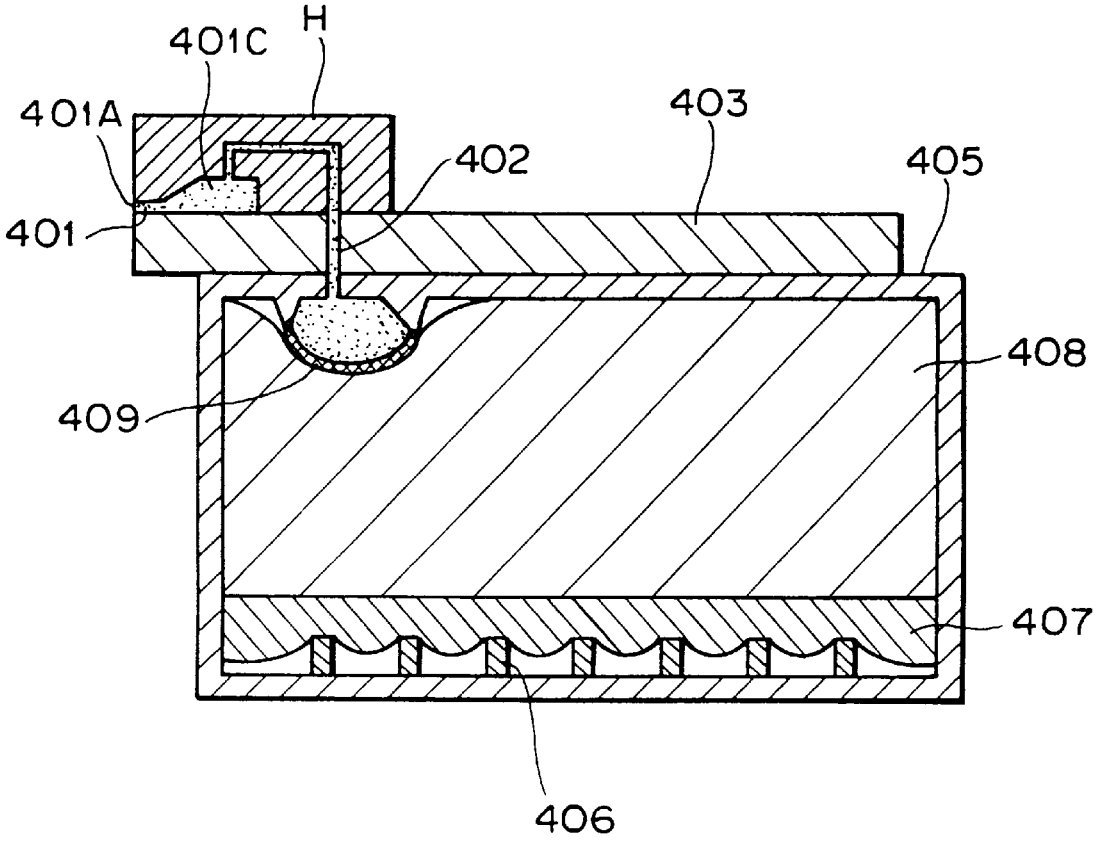
FIG. 18 is a schematic sectional view of a head cartridge of the type integrated with an ink tank according to another embodiment modified from the fourth embodiment of the present invention.

FIG. 18 shows by way of schematic sectional view the structure of a head cartridge of the type integrated with an ink tank according to another embodiment modified from the fourth embodiment of the present invention wherein an ink outflow portion or a filter 409 having a substantially semispherical contour is disposed in the ink tank. This embodiment is intended to prevent an ink absorbing member from being broken or damaged due to stress concentration along an edge portion of the ink outflow portion or the filter 409 when the latter is pressed against the ink absorbing member. With this construction, the ink outflow portion or the filter 409 can be brought in direct contact with an ink absorbing member 408 made of single fibers but not with an ink absorbing block 407 having high elasticity.

(Modified Embodiment 3 of the Fourth Embodiment)

Figure 19:
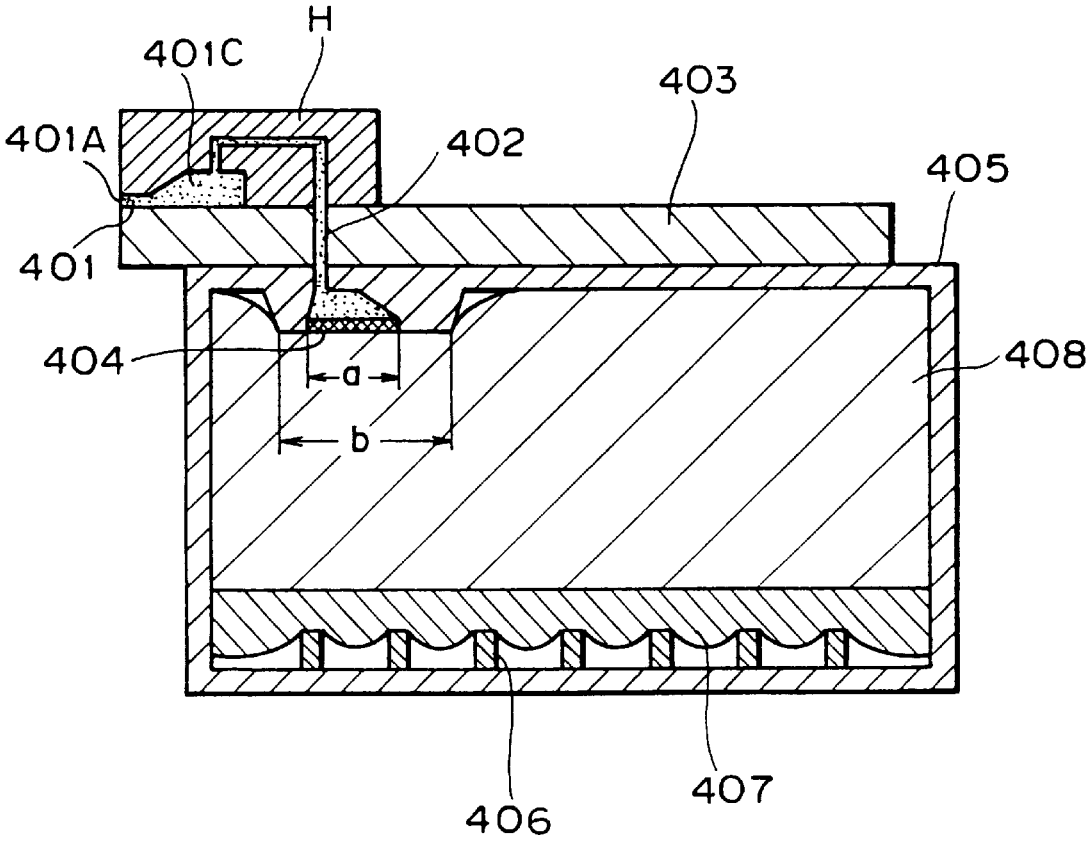
FIG. 19 is a schematic sectional view of a head cartridge of the type integrated with an ink tank according to further embodiment modified from the fourth embodiment of the present invention.

FIG. 19 shows by way of schematic sectional view the structure of a head cartridge of the type integrated with an ink tank according to another embodiment modified from the fourth embodiment of the present invention wherein a filter collision umpingement portion of the ink tank adapted to come in contact with an ink absorbing member 408 having an area larger than that of an ink outflow portion or a filter 404. An area required by the filter 404 is determined by a value preset for an ink flow rate, and it is preferable from the viewpoint of a production cost that the foregoing area is set to a necessary minimum limitative value. When a quantity of thrusting of the filter 404 against the ink absorbing member 408 is increased so as to obtain an effect for compressing the ink absorbing member 408 with the filter 404 having small dimensions, a large magnitude of load is exerted on the ink absorbing member 408. In this embodiment, to cope with the foregoing malfunction, a sufficiently large compressive volume of the ink absorbing member 408 can be maintained while suppressibly reducing an intensity of stress acting on the ink absorbing member 408 by determining a dimension b of the filter collision part larger than a dimension a of the filter 404. This makes it possible to press the ink outflow portion or the filter 404 directly against the ink absorbing member 408 made of single fibers but not against an ink absorbing block 407 having high elasticity. Usually, the filter collision part having a dimension b includes an allowance smaller than 1 mm in association with an effective area of the filter 404 having a dimension a for enabling ink to practically pass therethrough. An operational effect of the filter 404 can substantially be improved by determining the foregoing allowance of the filter collision part to assume a value of 1 mm or more.

(Modified Embodiment 3 of the Fourth Embodiment)

Figure 20:
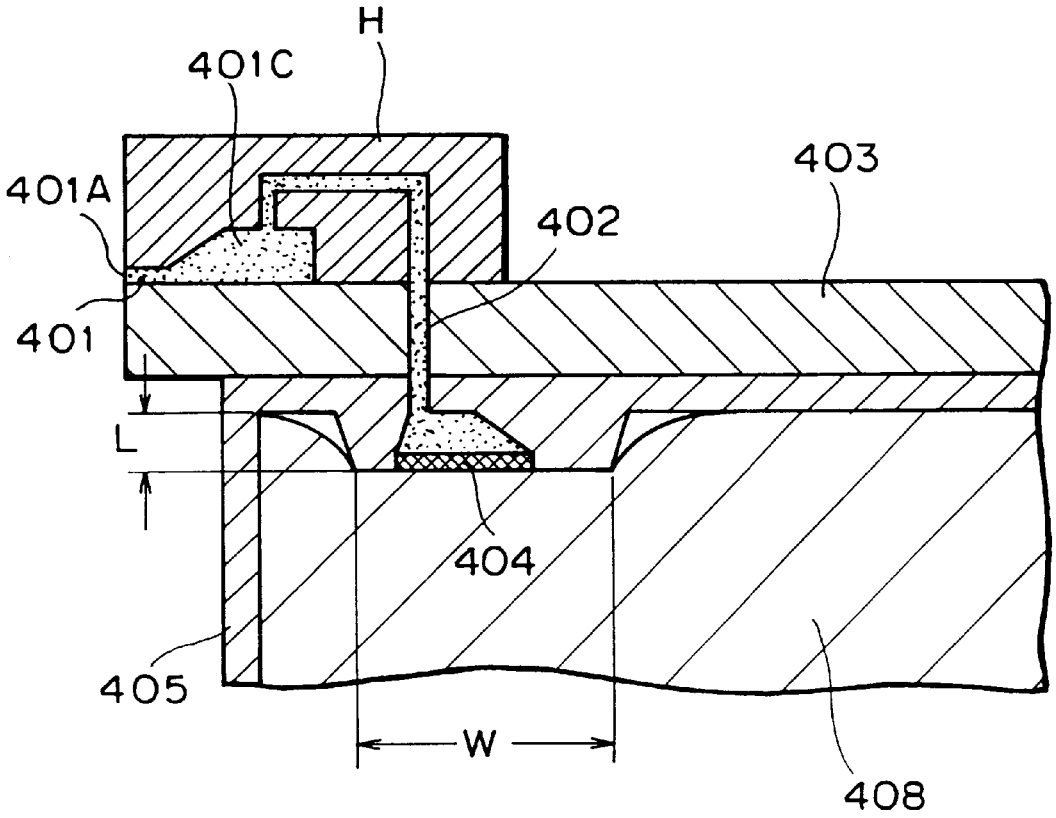
FIG. 20 is a fragmentary schematic sectional view of a head cartridge of the type integrated with an ink tank according to still further embodiment modified from the fourth embodiment of the present invention.

FIG. 20 shows by way of schematic sectional view the structure of a head cartridge of the type integrated with a ink tank according to further embodiment modified from the fourth embodiment of the present invention wherein a quantity L of thrusting of the filter collision part of a filter 404 against an ink absorbing member 408 made of single fibers is determined based on a diameter W of a fictitious circle defining the filter collision part or unpinging portion including the filter 404 by way of convertible calculation.

Figure 21:
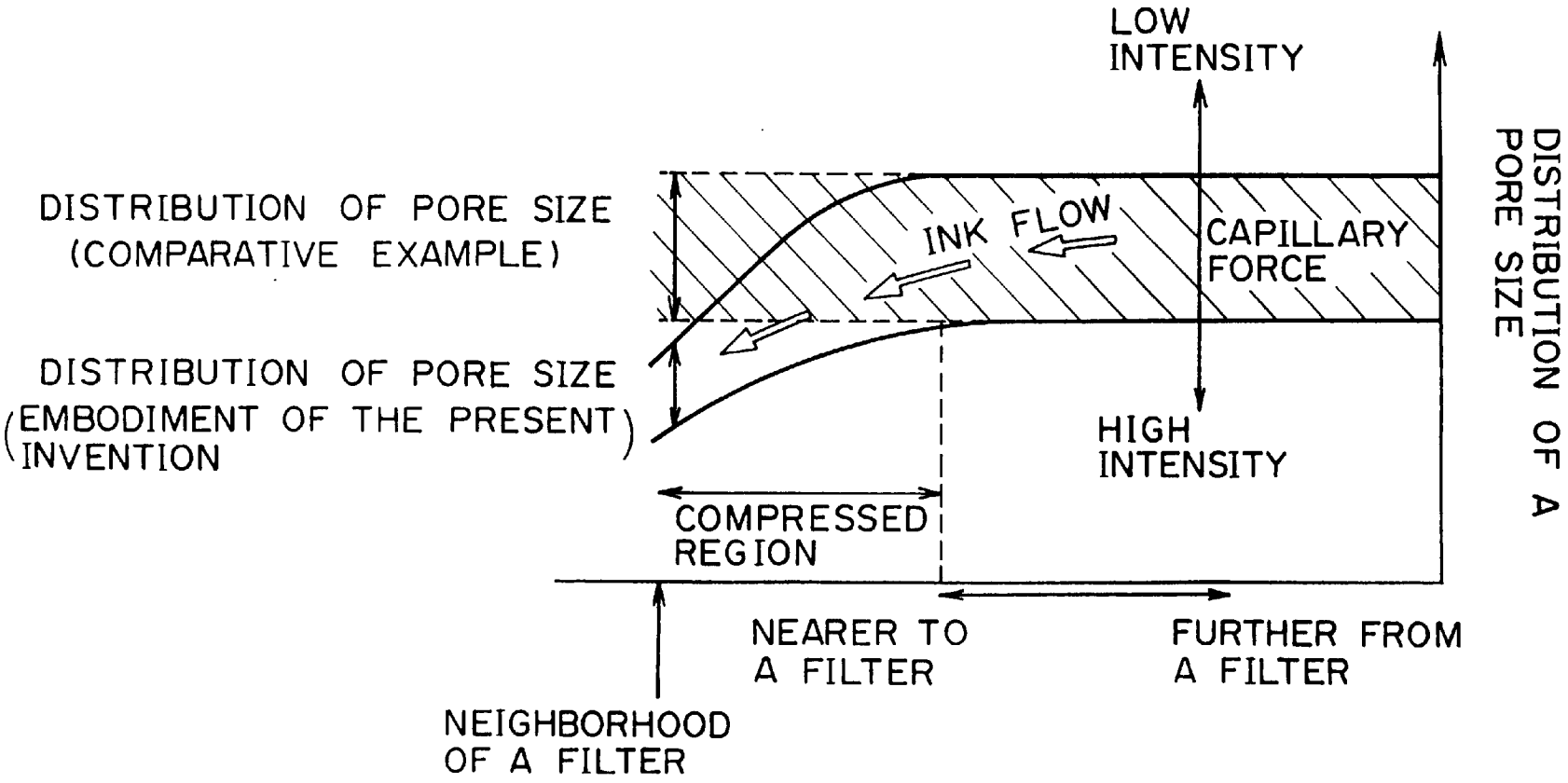
FIG. 21 is an illustrative view which shows the distribution of a pore size measured with respect to a number of pores formed through an ink absorbing member received in the ink tank while illustratively explaining how ink easily flows through the pores of the ink absorbing member in the ink tank.

As described above with reference to FIG. 16, the larger the quantity L of thrusting of the filter collision part of the filter 404 is, the higher the operational efficiency of ink consumption is. However, in the case that the filter 404 has a small width compared with the thrusting quantity L, there is a danger that the fibrous structure of the ink absorbing member is broken or damaged. In view of this fact, it is desirable that the relationship between the thrusting quantity L and the diameter W of the fictitious circle, i.e., a ratio of W/L is set to 10 or less. To assure that an ink consumption efficiency is increased by the compressing effect of the ink absorbing member, it is acceptable that the thrusting quantity L is enlarged. In practice, the extent of enlargement of the thrusting quantity L is determined depending on fluctuation of a pore size in the ink absorbing member 408. In the case that the ink absorbing member 408 is molded of, e.g., a melamine resin so as to allow it to have a pore size ranging from about 50 $\mu$m to 250 $\mu$m, it is desirable that the ratio of W/L is set to 0.1 or more. Thus, when the ratio of W/L lies within the range represented by an inequality of $0.1 \leqq W/L \leqq 10$, fluctuation of an intensity of capillary force arising in the vicinity of the filter can be enlarged much more fluctuation of the capillary force attributable to fluctuation of the pore size as shown in FIG. 21. Consequently, an ink consumption efficiency of the ink absorbing member 408 can be improved.

(Modified Embodiment 4 of the Fourth Embodiment)

Figure 22:
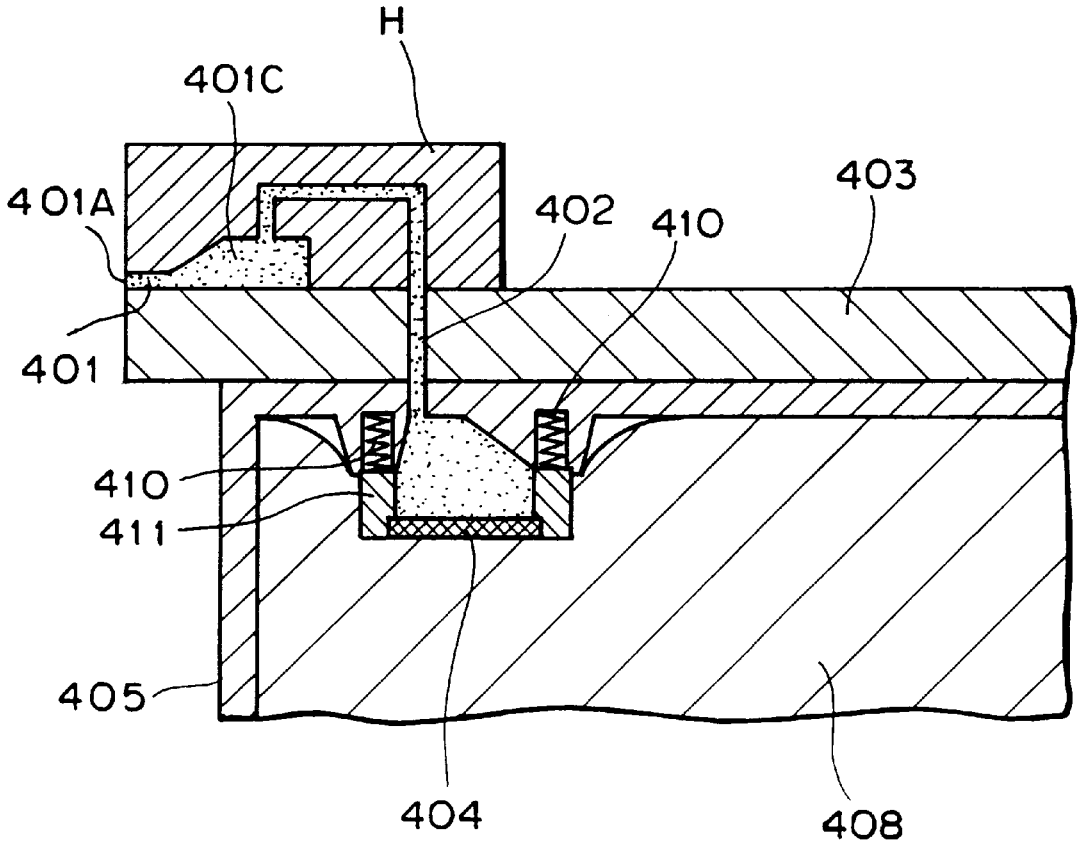
FIG. 22 is a fragmentary schematic sectional view of a head cartridge of the type integrated with an ink tank according to still further embodiment modified from the fourth embodiment of the present invention.

FIG. 22 shows by way of fragmentary schematic sectional view the structure of a head cartridge of the type integrated with an ink tank according to further another embodiment modified from the fourth embodiment of the present invention wherein an ink absorbing member is compressed in a different manner.

In this embodiment, a member 411 for supporting a filter 404 is displaceably held in an ink tank so that the filter 404 is brought in pressure contact with an ink absorbing member 408 by the resilient force given by a plurality of filter pressing springs 410. With this construction, the same advantageous effects as those in each of the aforementioned embodiments can be obtained with the head cartridge. In addition, the same effect for compressing the ink absorbing member as mentioned above can be obtained by employing a plurality of resilient members for the filter.

(Modified Embodiment 5 of the Fourth Embodiment)

Figure 23:
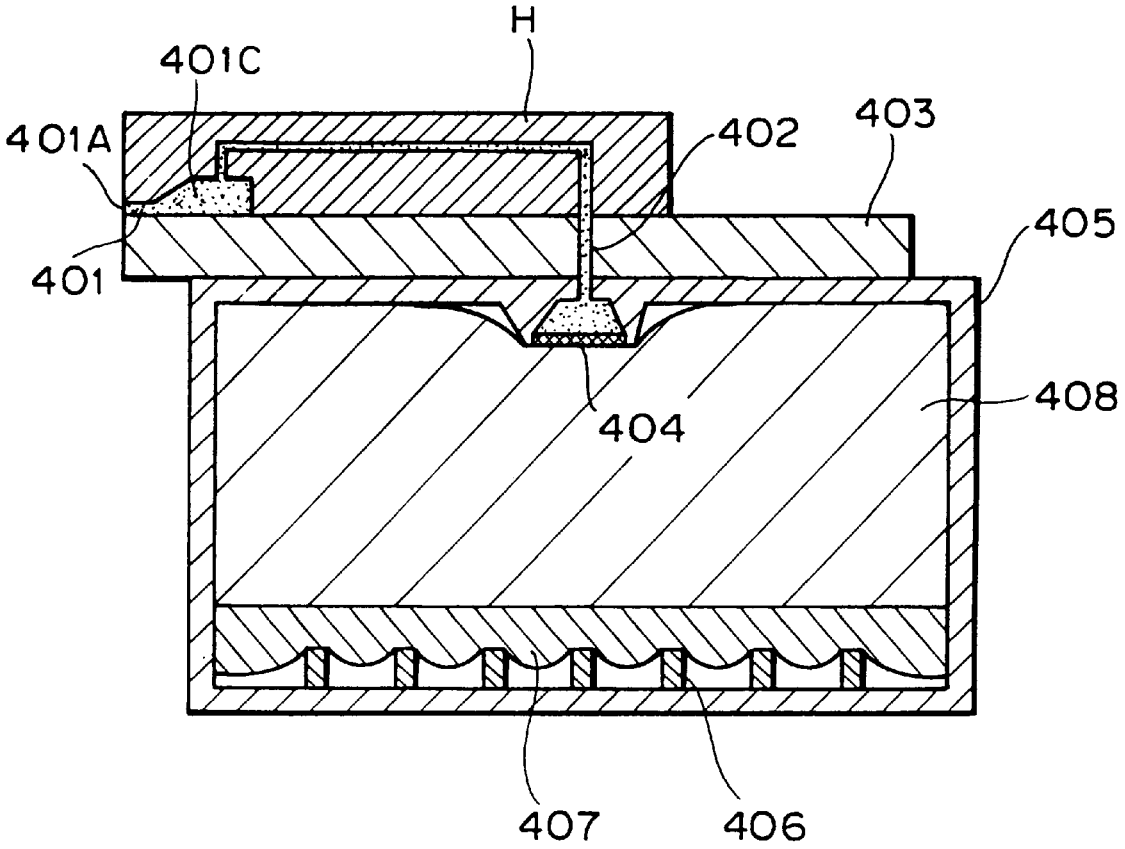
FIG. 23 is a schematic sectional view of a head cartridge of the type integrated with an ink tank according to still further embodiment modified from the fourth embodiment of the present invention.

FIG. 23 shows by way of schematic sectional view the structure of a head cartridge of the type integrated with an ink tank according to still further embodiment modified from the fourth embodiment of the present invention wherein an ink consumption efficiency is substantially improved.

In the case that a filter 404 is disposed in the vicinity of the inner wall surface of an ink tank 405, a stress is liable to appear in an ink absorbing member 408 molded of, e.g., a melamine resin having low elasticity while exhibiting a steep gradient. In this embodiment, a filter portion is disposed at the position located at the substantially same distance as measured from the respective inner wall surfaces of an ink tank 405, whereby any stress does not appear in the ink absorbing member 408 with a steep gradient. Thus, the ink absorbing member 408 is satisfactorily protected from damage or injury, and the ink absorbing member 408 can be compressed at a high efficiency.

In each of the fourth embodiment and the embodiments modified from the latter, one end of the ink feeding tube is inserted into the ink tank, and the ink outflow portion or the filter disposed in the latter is brought in close contact with the ink absorbing member so as to allow it to serve as thrusting means. However, the present invention should not be limited only to this. Alternatively, e.g., a hole formed through one side wall of the ink tank mat be substituted for the ink outflow portion.

In this case, it is acceptable that thrusting means such as a spring, a rib or the like is disposed in the hole. For example, the spring or the rib serving as second thrusting means employed for the embodiment as shown in FIG. 13 and FIG. 17 can be used as thrusting means to be disposed in the foregoing hole.

When the technical concept of the present invention is examined from other viewpoint, properties of the ink absorbing member made of single fibers are liable to be deteriorated due to so-called warpage or the like, and as they are deteriorated, an ink feeding ability of the ink absorbing member is correspondingly deteriorated. To compensate the deterioration of the ink absorbing ability of the ink absorbing member, it is advantageously effective to dispose compensating means for applying a functional force to an ink absorbing foamed block while compensating the foregoing deterioration, i.e., compensating means for applying to the ink absorbing foamed block the functional force effective for collectively feeding ink to the ink outflow portion to maintain the ink feeding ability. In practice, the compensating means of the foregoing type is employed for carrying out the present invention. In each of the aforementioned embodiments, the ink absorbing block disposed in the vicinity of the ink outflow portion while exhibiting elastic properties more excellent than those of the ink absorbing member made of single fibers or a capillary force having an intensity higher than that of the ink absorbing member as shown in FIG. 13 or FIG. 17 or the spring for thrusting the ink absorbing member while following the variation of a contour of the ink absorbing member as shown in FIG. 17 corresponds to the aforementioned compensating means. However, it is obvious that the compensating means may be designed in other different manner rather than the foregoing one.

As is apparent from the above description, according to each of the fourth embodiment of the present invention and the embodiments modified from the latter, the following advantageous effects can be obtained by adequately pressing the ink outflow portion against the ink absorbing member with the aid of the pressing means as mentioned above.

1. Since the ink absorbing member made of single fibers while exhibiting a high ink consumption efficiency and excellent easiness of allowing it to be filled with ink can be employed as an ink absorbing member to be accommodated in the ink tank, a printing head can be produced at a reduced cost, and moreover, it can practically be used at a low running cost.

2. Since a capillary force can be generated with the ink absorbing member while exhibiting a certain gradient in terms of an intensity thereof, the ink absorbing member made of single fibers can practically be used at an increased ink consumption efficiency.

3. Since the degree of freedom is increased in respect of the direction of ink outflow from the ink tank, a printing head or a printing unit can be designed and constructed with an improved degree of freedom.

(Fifth Embodiment)

This embodiment is intended to use an ink absorbing foamed block molded of a melamine resin for ink tanks each having a various kind of structure.

Figure 24:
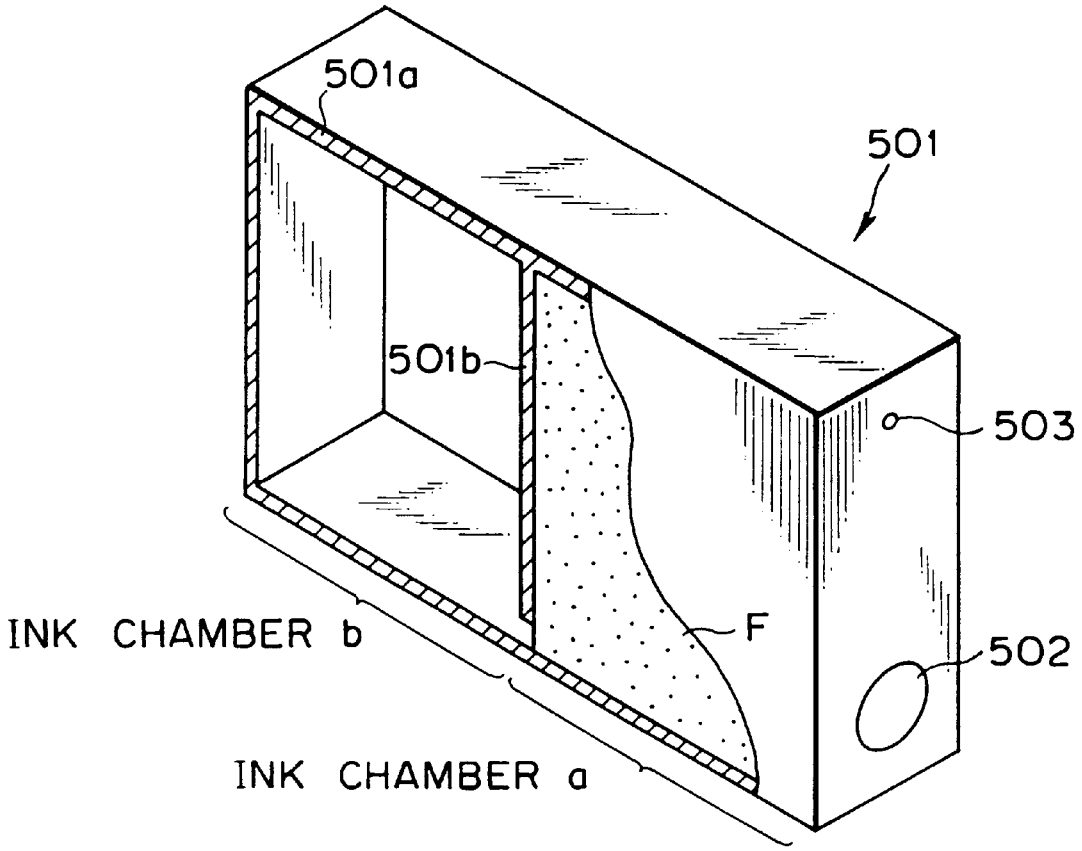
FIG. 24 is a partially exploded schematic perspective view of an ink tank constructed according to a fifth embodiment of the present invention, showing the structure of the ink tank.
Figure 25A:
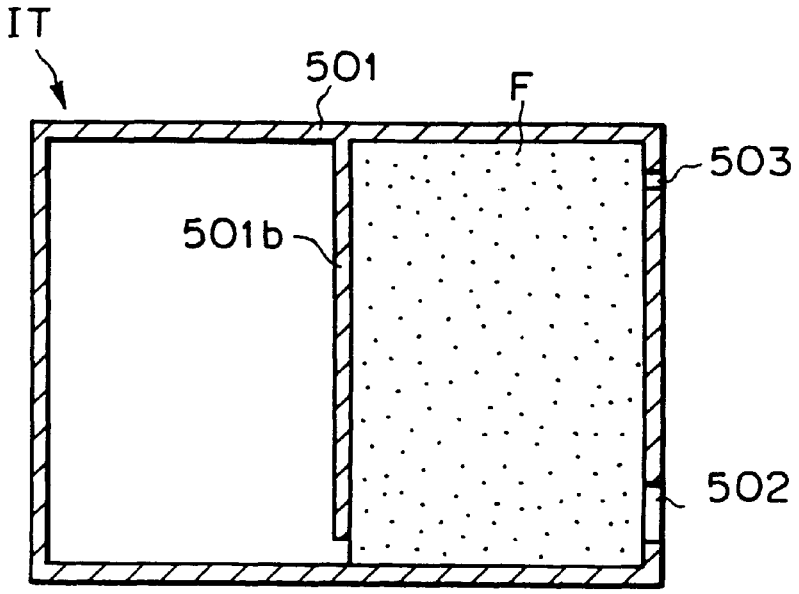
FIG. 25A and FIG. 25B are sectional views which show by way of two examples of the structure of the ink tank shown in FIG. 24, respectively.

FIG. 24 is a partially exploded schematic perspective view of an ink tank constructed according to a fifth embodiment of the present invention, and FIG. 25A is a schematic sectional view of the ink tank shown in FIG. 24.

In this embodiment, as shown in the drawings, the interior of a housing 501*a* of an ink tank 501 is divided into two ink chambers a and b with an ink chamber wall 501*b* interposed therebetween, and both the ink chambers a and b are communicated with each other via an aperture formed on the bottom of the ink tank 501. An ink absorbing member F, of which capillary force is properly adjusted, is accommodated in the ink chamber a. An ink feeding portion 502 and an atmosphere communicating portion 503 are formed through the right-hand side wall of the ink chamber a for connecting the ink tank 501 to an ink jet head (not shown)

Figure 25B:
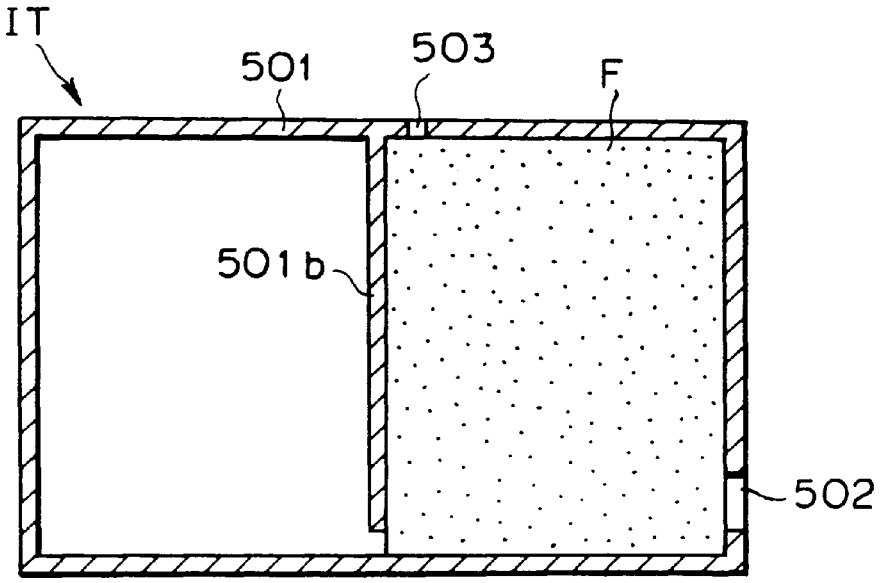

The positions assumed by the atmosphere communicating portion 503 and the ink feeding portion 502 should not be limited only to the shown ones. Alternatively, they may be formed through the housing 501*a* of the ink tank 501 in the positional relationship as shown in FIG. 25B.

Figure 26:
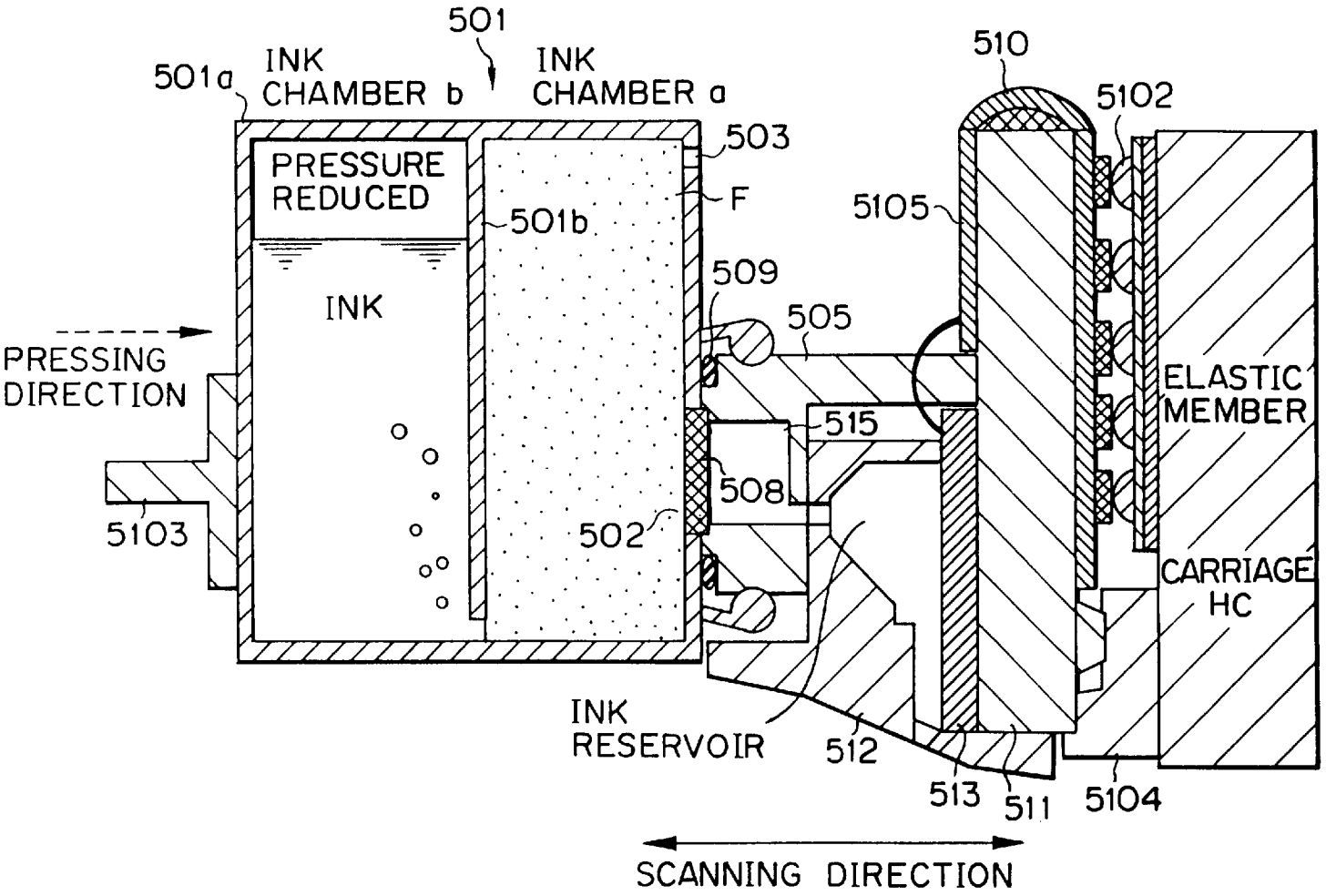
FIG. 26 is a schematic sectional view of a head cartridge for which the ink tank shown in FIG. 24 is used.

FIG. 26 is a schematic sectional view of a head cartridge for which the ink tank shown in FIG. 24 is used, particularly showing the state that an ink jet head, and ink tank and a carriage constituting an ink jet apparatus are connected to each other.

In this embodiment, a bubble jet process is employed for an ink jet head 510 which serves to achieve a recording operation using an electrothermal converting element for generating thermal energy required for inducing a phenomenon of film boiling in ink in response to an electric signal.

All essential components constituting the ink jet head 510 are arranged on a head base plate 511 one above another by adhering or crimping in the laminated state while a position determining protuberance formed on the head base plate 511 is taken as a position determining datum. The position of the ink jet head 510 on the paper plane of FIG. 26 as seen in the vertical direction is determined based on a head position determining portion 5104 for a carriage HC and the position determining protuberance. In addition, a part of the position determining protuberance of the ink jet head 510 is projected in the direction orienting at a right angle relative to the paper plane of FIG. 26 in such a manner as to allow the head position determining portion 5104 to be covered therewith, whereby the position of the ink jet head 510 is determined by a cutout portion (not shown) of the position determining protuberance and the head position determining portion 5104. A plurality of electrothermal converting elements (each serving as an ink ejection heater) arranged on a silicon base board in the form of a plurality of rows and a plurality of electrical conductors each made of a metallic material such as aluminum or the like to feed electricity to the electrothermal converting elements are formed on a heater board 513 by employing a film forming process. The heater board 513 is electrically connected to a head flexible base board (hereinafter referred to as a head PCB) 5105 including conductors each having a pad disposed at one end thereof for receiving an electrical signal from the ink jet unit while conductors on the heater board 513 side are correspondingly connected to the conductors on the head PCB 5105 side via wire bonding. A plurality of partition walls for separating a plurality of ink flow paths (liquid paths) 515 from each other corresponding to the ink ejection heaters, a common liquid chamber having ink introduced thereinto from an exchangeable ink tank 501 via the ink flow paths 515 so as to feed the ink to the ink flow paths, and a plurality of openings each serving as an ink ejection port are integrally molded of a polysulfone resin or the like to form a grooved ceiling plate 512. Subsequently, the grooved ceiling plate 512 is thrusted against the heater board 513 with the aid of springs (not shown) so that it is sealably secured to the heater board 513 using a sealing agent to form an ink ejecting portion on the ink jet head 510. In this embodiment, to assure that the head base plate 511 can be connected to the exchangeable ink tank 501, a member sealably connected to the grooved ceiling plate 512 and having the ink flow paths 515 formed therein is caused to extend through holes formed through the head PCB 5105 and the head base plate 511 to reach the opposite side of the head base plate 511, and the foregoing member is fixed to the head base plate 511 in the thus formed holes using an adhesive. In addition, a filter 508 is disposed at the left-hand ends of the ink flow paths 515 on the connecting side relative to the exchangeable ink tank 501 in order to prevent dust particles or unnecessary bubbles from entering the ink ejecting portion. The exchangeable ink tank 501 is mechanically connected to the ink jet head 510 with the aid of an engagement guide 505 and a thrusting member 5103 while an ink absorbing member F accommodated adjacent to an ink feeding portion 502 in the ink tank 501 comes in contact with the filter 508 disposed at the foremost end of the ink flow path 515. After completion of the connecting operation, ink can forcibly be fed to the recording head 510 from the exchangeable ink tank 501 by driving a recording head activating recovery pump arranged for the ink jet unit.

In this embodiment, while the ink tank 501 is connected to the ink jet head 510 by actuating the thrusting member 5103, a foamed block molded of a condensate composed of a compound having an amino group and a formaldehyde in the form of a porous material having a three-dimensional net-shaped structure is accommodated in each of the ink jet head 510 and the exchangeable ink tank 510. Since the ink jet head 501 and the carriage HC are mechanically and electrically connected to each other in the same direction when it is connected to the ink jet head 510, the positions assumed by the pads on the head PCB 5105 and head driving electrodes 5102 are reliably determined.

A ring seal 509 is sealably fitted around the left-hand end of the engagement guide 505 in such a manner as to permit the ink feeding portion 502 to be slightly vibratively displaced and has a comparatively large contact area with the right-hand side wall of the exchangeable ink tank 501. In this embodiment, the ring seal 509 is prepared in the form of an elastic ring having a slightly large sectional area.

As described above, according to the fifth embodiment of the present invention, after the exchangeable ink tank 501 is firmly connected to the ink jet head 510, the former is thrusted against the latter by actuating the thrusting member 5103, whereby the positions assumed by the carriage HC and the ink jet head 510 can reliably be determined with a simple structure. Since the ink jet head 510 is attached to the carriage HC after the ink jet head 510 and the exchangeable ink tank 501 are simply connected to each other outside of a housing of the ink jet unit, each used empty ink tank 501 can easily be exchanged with a new one. In addition, since the carriage HC and the exchangeable ink tank 501 are electrically connected to each other at the same time, each exchanging operation can be achieved not only for the exchangeable ink tank 501 but also for the ink jet head 501 at a high efficiency. It is acceptable that electrical connection is made for the exchangeable ink tank 501 and the ink jet head 510 by employing a connector connecting process and that the degree of structural freedom is increased in order to more reliably determine the position of the ink jet head 510 and connect the exchangeable ink tank 501 to the ink jet head 510.

Next, the structure of an ink cartridge (ink tank) constructed according to the fifth embodiment of the present invention will be described in more detail.

Figure 27:
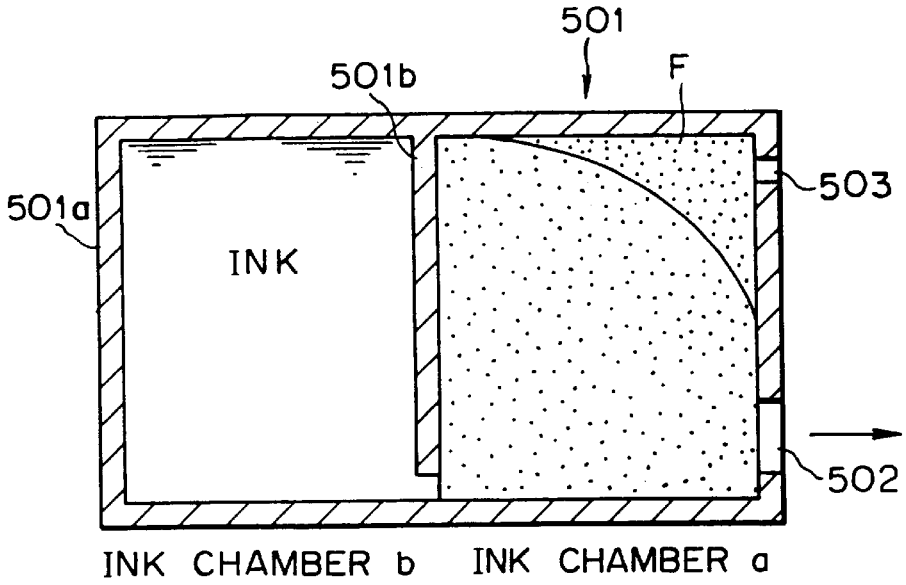
FIG. 27 is a schematic sectional view of the ink tank constructed according to the fifth embodiment of the present invention, showing an initial state of the ink tank.
Figure 28:
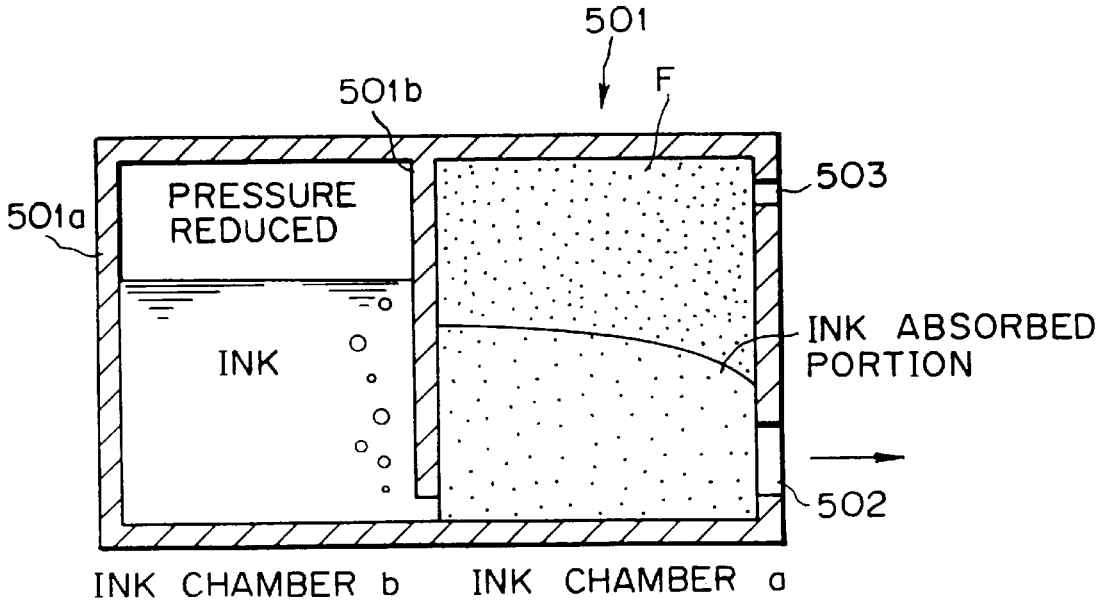
FIG. 28 is a schematic sectional view of the ink tank constructed according to the firth embodiment of the present invention, showing an intermediate state of usage of the ink tank.

FIG. 27 shows by way of schematic sectional view the initial state that an ink tank is divided into two ink chambers a and b each of which is sufficiently filled with ink, and FIG. 28 shows by way of schematic sectional view the state that a quantity of ink capable of being fed from the initial state is storably received in the ink chamber a and a quantity of ink equal to about one third of the volume of the ink chamber b is consumed.

In the case that the ink tank is filled with ink in such a manner that the ink chamber b is filled with ink to the volumetric limitative extent in order to maintain a certain negative pressure in the ink tank without any occurrence of ink leakage in the unconnected state, it is preferable that a quantity of ink filled in the ink chamber a is determined to assume a value representing a limit of the ink retaining force of the ink absorbing member or another value smaller than the foregoing value. In this sense, FIG. 27 shows the state that a large part of the ink chamber a is filled with ink within the range defined by the thus determined value. It should be noted that the ink retaining force as mentioned above represents a capability that ink can be retained only in the ink absorbing member after the latter is filled with ink.

Referring to FIG. 28 again, the ink received in the compressed ink absorbing member F is retained such that the water head pressure in the ink ejecting portion of the ink jet head, the reduced pressure in the ink chamber b and the capillary power in the compressed ink absorbing member F are kept in the well-balanced state. As ink is fed to the ink jet head side from the ink feeding portion, a quantity of ink received in the ink chamber a is not reduced but the ink in the ink chamber b is increasingly consumed. Specifically, while the inner pressure in the ink tank is kept in the balanced state without any variation of the distribution of ink pressure in the ink chamber a, a quantity of ink corresponding to the quantity of fed ink is displaced to the ink chamber a, and at the same time, a volume of atmospheric air corresponding to the quantity of fed ink is introduced into the ink chamber a through an atmosphere communication portion 503.

Figure 29:
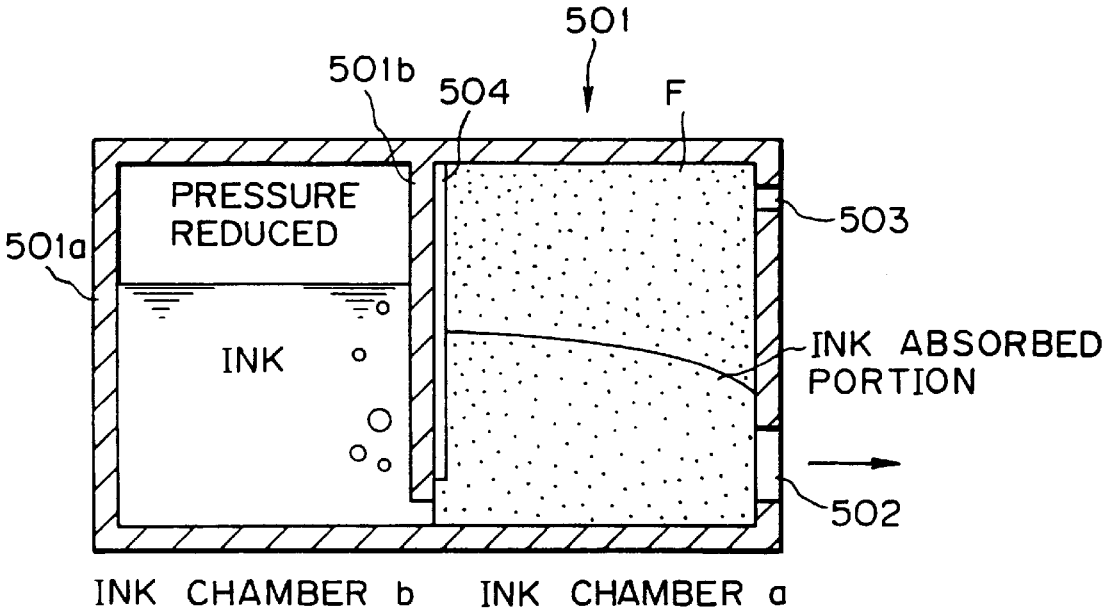
FIG. 29 is a schematic sectional view of an ink tank constructed according to an embodiment modified from the fifth embodiment of the present invention.

At this time, air/liquid replacement occurs between atmospheric air and ink through the communication portion between the ink chamber a and the ink chamber b. As ink is fed through the ink feeding portion 502, a part of the meniscus formed on the ink absorbing member F in the ink chamber a and located in the vicinity of the ink chamber b is broken, causing an intensity of pressure in the ink chamber a to be reduced, whereby atmospheric air is introduced into the ink chamber b so as to allow the ink pressure in the ink chamber b to be equalized to the meniscus retaining force of the compressed ink absorbing member F. Thus, an intensity of inner pressure acting on the ink feeding portion 502 is maintained to assume a predetermined value by the capillary force of the ink absorbing member F in the ink chamber a. At this time, a compressing rate of the ink absorbing member at a part of the latter located in the proximity of the ink feeding portion 502 is increased by squeezing the ink flow path 515 of the ink jet head in the ink feeding portion 502 so as to allow the filter 508 to come in close contact with the ink absorbing member F as described above in the aforementioned embodiment. Thus, a larger quantity of ink is distributed at the ink feeding portion 502 so that air/liquid replacement is easily attained along the ink chamber wall 501*b*. Otherwise, as shown in FIG. 29, a rib 504 is disposed in the ink chamber a between the ink chamber wall 501*b* and the compressed ink absorbing member F in order to allow atmospheric air to be easily introduced into the ink chamber a through the atmosphere communication portion 503.

Figure 30:
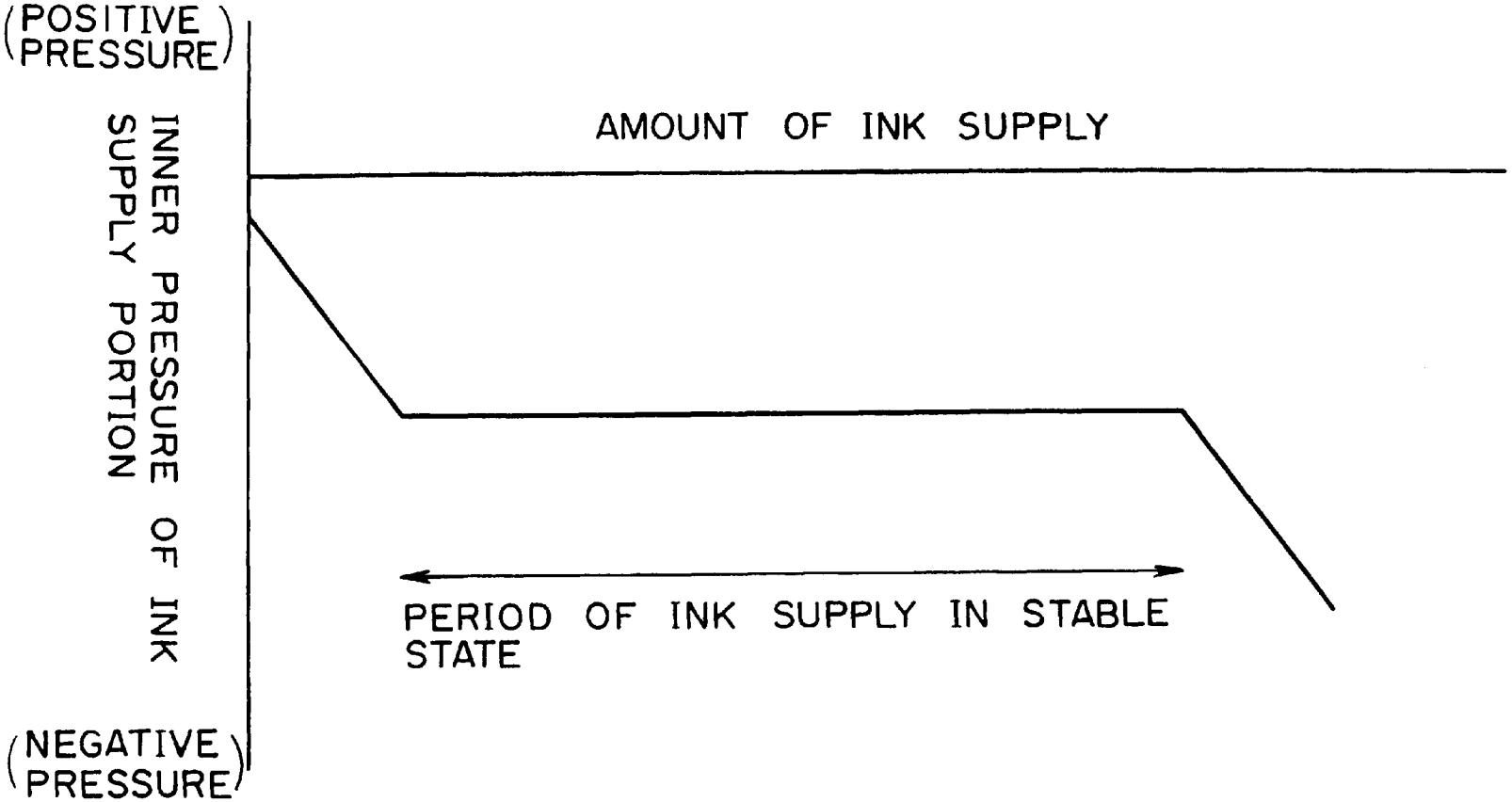
FIG. 30 is a graph which shows how an inner pressure in the ink tank constructed according to the fifth embodiment of the present invention.

FIG. 30 shows by way of graph how the inner pressure acting at the ink feeding portion 502 of the exchangeable ink tank 501 constructed according to the fifth embodiment of the present invention varies corresponding to a quantity of fed ink (i.e., a quantity of consumed ink). While the ink tank 501 is held in the initial state, a certain quantity of ink is present also in the ink tank a and a certain intensity of inner pressure is generated in the ink chamber a by the capillary force of the compressed ink absorbing member F. As ink is fed to the ink jet head 510, causing a quantity of ink in the ink chamber a to be reduced, an intensity of inner pressure (negative pressure) generated by the capillary force is gradually increased corresponding to distribution of the compressing rate of the compressed ink absorbing member F (i.e., distribution of pores in the compressed ink absorbing member F). As ink is consumingly fed to the ink jet head 510 further, the ink distribution in the ink tank a is stabilized while ink in the ink chamber b is supplementarily consumed, and subsequently, a substantially constant intensity of inner pressure is maintained by introducing atmospheric air into the ink tank b. When ink in the ink tank b is completely consumed as ink is consumingly fed to the ink jet head 510 further, ink in the ink tank a starts to be consumed again, causing the inner pressure in the ink tank a to vary. When it is detected that an intensity of inner pressure at the ink feeding portion 502 is increased in excess of a predetermined negative value, there arises a necessity for exchanging the used ink tank with a new one or exchanging the used ink tank integrated with the ink jet head with a new one.

Figure 31:
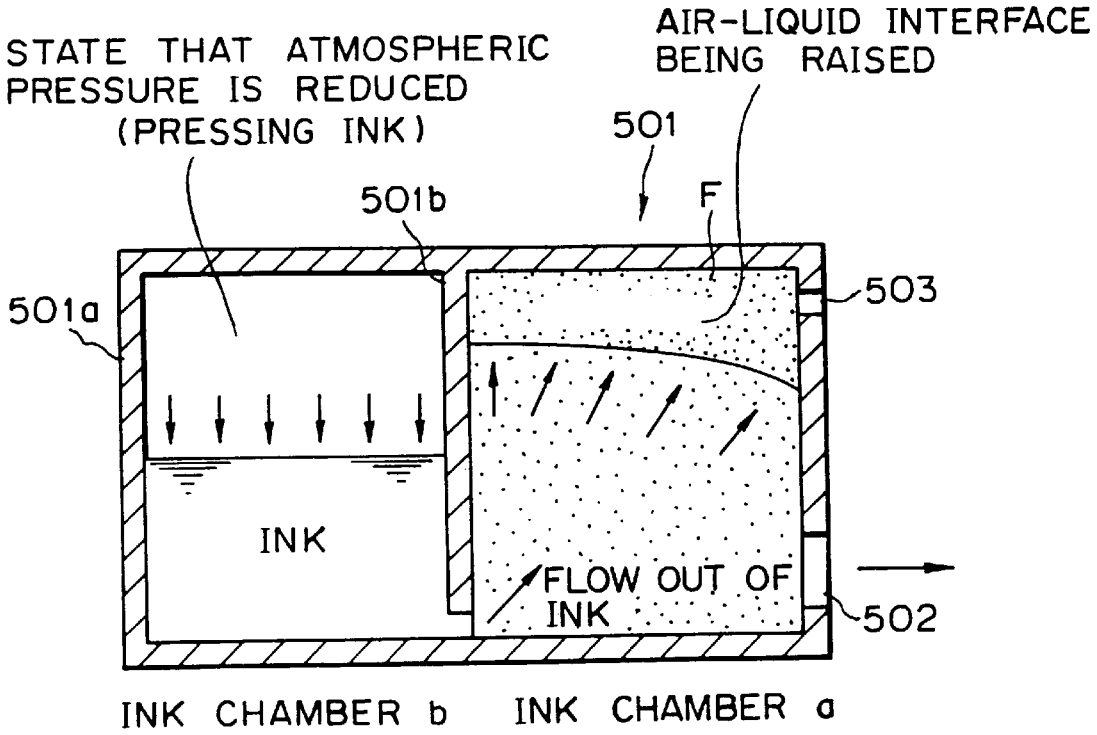
FIG. 31 is an illustrative view of the ink tank constructed according to the fifth embodiment of the present invention, illustratively showing how a compressible absorbing member in the ink tank functions as a buffer type absorbing member.
Figure 32:
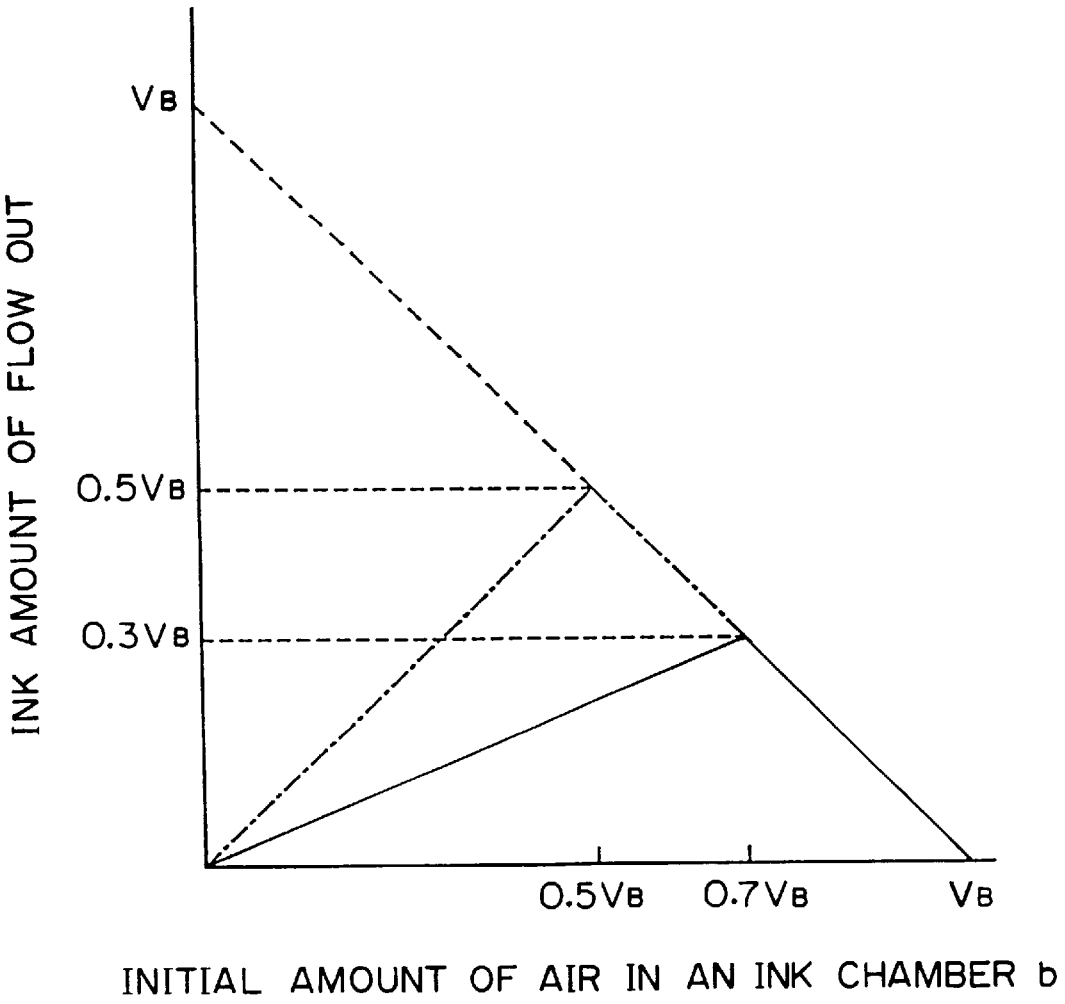
FIG. 32 is a graph which shows the relationship between a volume of initial hollow space of the ink tank constructed according to the fifth embodiment of the present invention and a quantity of ink flowing outside of the hollow space of the ink tank when an inner pressure in the ink tank is reduced.

FIG. 31 is a schematic sectional view of the ink tank constructed according to the fifth embodiment of the present invention, illustratively showing how a compressed ink absorbing member F function as a buffer type ink absorbing member. Specifically, FIG. 31 shows how ink in the ink chamber b flows in the ink chamber a due to expansion of air in the ink chamber b caused as the atmospheric pressure is decreased or the atmospheric air temperature is elevated from the state as shown in FIG. 28. With respect to the relationship between a quantity of ink absorbed in the compressed ink absorbing member F and each ink chamber, it is acceptable from the viewpoint of preventing ink from leaking from the ink tank when the atmospheric pressure is decreased or the atmospheric temperature varies as mentioned above that a maximum quantity of ink absorption in the ink chamber a is determined in consideration of a quantity of ink flowing from the ink chamber b under worst conditions and a quantity of ink storably received in the ink chamber a when ink is fed from the ink chamber b and that the ink chamber a has at least a large volumetric capacity enough to accommodate the compressed ink absorbing member F therein. FIG. 32 is a graph which shows the relationship between a volume of initial hollow space of the ink chamber b prior to decreasing of the atmospheric pressure and a quantity of ink flowing outside of the hollow space of the ink tank when the atmospheric pressure of the ink chamber a is decreased to a level of 0.7 at. In addition, the case that a condition of maximum decreasing of the atmospheric pressure is shown by a one-dotted chain line in FIG. 32. When a quantity of ink flowing from the ink chamber b is estimated, e.g., in the case that a condition of maximum decreasing of the atmospheric pressure is set to 0.7 at, a maximum quantity of ink flowing from the ink chamber b corresponds to the case that ink remains in the ink chamber b by a quantity equal to 30% of a volumetric capacity VB of the ink chamber b. Thus, when it is assumed that ink remaining below the lower end of the ink chamber wall is absorbed in the compressed ink absorbing member accommodated in the ink chamber a, it may be considered that all the ink remaining in the ink chamber b (equal to 30% of the volumetric capacity VB) leaks from the latter. In the case that a worst condition of the atmospheric pressure is set to 0.5 at, ink flows from the ink chamber b by a quantity equal to 50% of the volume of the ink chamber b. The volume of air in the ink chamber b expanded under the decreased pressure is enlarged as a quantity of ink remaining in the ink chamber b is reduced more and more but it does not flow from the ink chamber b in excess of a quantity of ink in the ink chamber b. Therefore, in the case that it is presumed that a condition of maximum decreasing of the atmospheric pressure is set to 0.7 at, when a quantity of ink remaining in the ink chamber b is reduced to a level of 30% or more, a quantity of remaining ink becomes smaller than a quantity of expansion of the atmospheric air, resulting in a quantity of ink flowing to the ink chamber a being reduced. Thus, a maximum quantity of leaked ink is represented by 30% of the volumetric capacity of the ink chamber b (corresponding to 50% under a condition of 0.5 at).

The ink used for practicing this embodiment has the following composition.

| COMPOSITION | |
|---|---|
| pigment | 4 parts |
| glycerol | 7.5 parts |
| thioglycol | 7.5 parts |
| urea | 7.5 parts |
| pure water | 73.5 parts |

This kind of ink is ink preferably employable for printing characters each having a high quality on a so-called plain paper such as a copying paper, a bond paper or the like. Generally, it is mentioned that ink employable for performing an ink jet type printing operation can be impregnated in a paper at a higher speed as a value of $\eta/(\pm \cos \theta)$ is reduced more and more. Here, $\eta$ designates a viscosity of the ink, $\gamma$ designates a surface tension of the ink, and $\theta$ designates a contact angle defined between the ink and the paper. Generally, when the contact angle is reduced and the ink is impregnated in the paper at a high speed, the ink is caused to ooze along irregularly distributed fibers on the opposite surfaces of the paper, resulting in a quality of printed image being degraded. One of measures to be taken for improving a quality of printed image is to increase a rate of water in the ink (representing a high value of $\gamma$ and a high value of $\theta$). In this case, however, a property of impregnation of the ink in the paper is degraded. The ink having the above-noted composition exhibits a high surface tension ranging from 40 to 50 dyne/cm. Thus, a quality of printed image can be improved with this ink by degrading the property of ink in a paper in consideration of a good balance to be maintained in association with a fixing property while preventing the ink from being spread over the opposite surfaces of the paper, causing the ink to ooze along irregularly distributed fibers.

The inventors conducted a series of reduced pressure tests using ink of the foregoing kind and a polyurethane foamed block accommodated in one of the aforementioned ink tanks as an ink absorbing member, and it was found as a result derived from the tests that some of the ink tanks had a problem that ink leaked outside of each ink tank because a quality of fabrication of these ink tanks fluctuated from tank to tank. However, an occurrence of ink leakage could be prevented by using a melamine foamed block as an ink absorbing member. Specifically, it was found as a result derived from examinations conducted by the inventors that the problem of ink leakage could be solved by improving not only a volumetric property of an ink buffer chamber but also a hydrophilic property of the ink absorbing member accommodated in the ink tank, and moreover, using a melamine foamed block having a hydrophilic property higher than that of the conventional polyurethane foamed block. It should be noted that the melamine foamed block is a porous member having a three-dimensional net-shaped structure which is one of foamed blocks each molded of a condensate composed of a compound having an amino group and formaldehyde.

Figure 33:
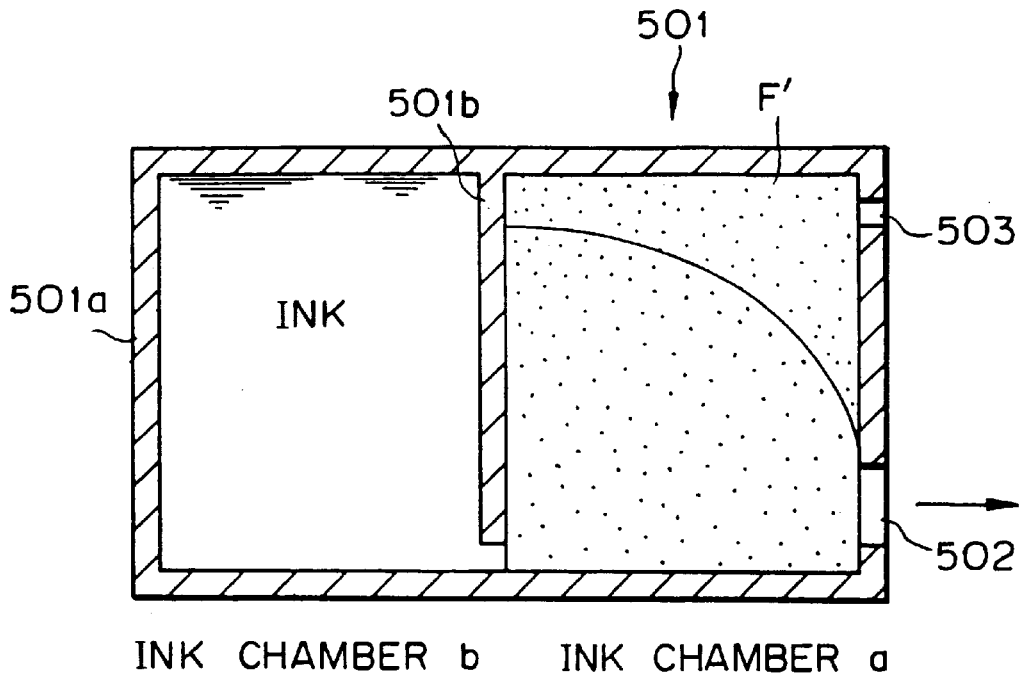
FIG. 33 is a schematic sectional view of the ink tank constructed according to a comparative example, showing how ink leaks from the ink tank.
Figure 34:
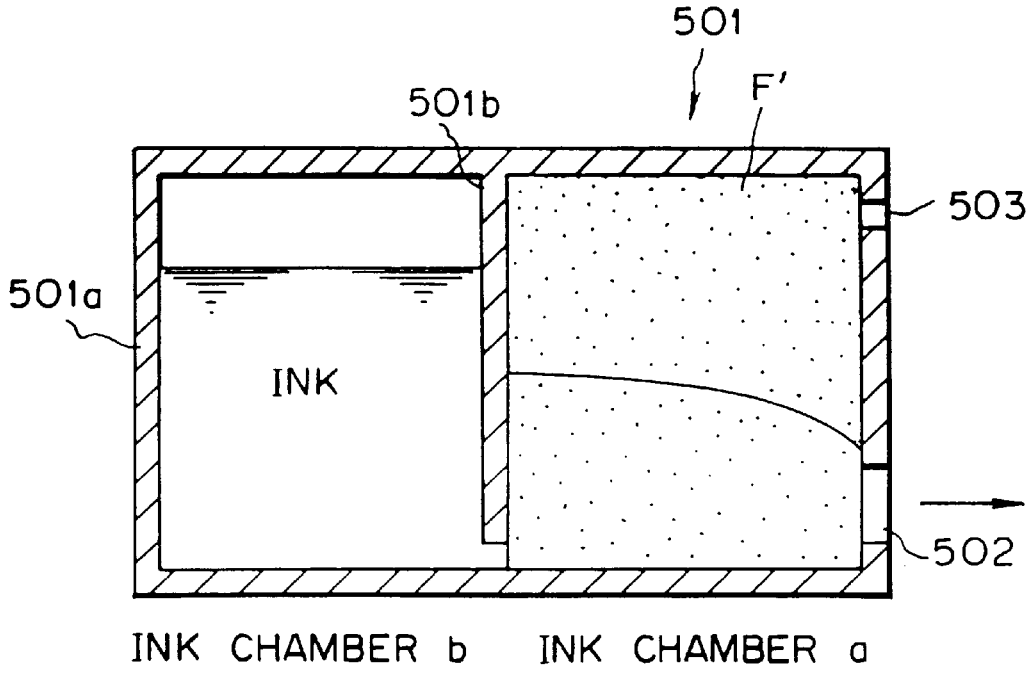
FIG. 34 is a schematic sectional view of the ink tank constructed according to a comparative example, showing how ink leaks from the ink tank.
Figure 35:
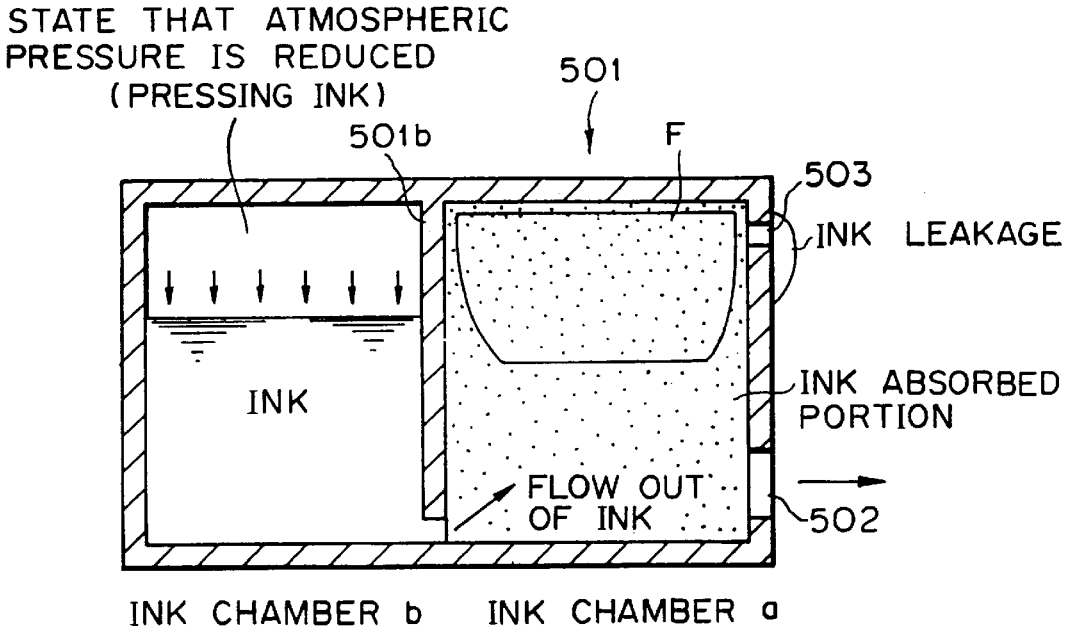
FIG. 35 is a schematic sectional view of the ink tank constructed according to a comparative example, showing how ink leaks from the ink tank.

FIG. 33 to FIG. 35 are schematic ink absorbing memberal views each of which shows by way of comparative example the structure of an ink tank constructed according to the fifth embodiment of the present invention wherein a polyurethane foamed block F' is used as an ink absorbing member but a malfunction of ink leakage occurs with the ink tank, respectively.

FIG. 33 shows an initial state of the ink tank, and FIG. 34 shows the state that ink capable of being fed to an ink chamber a from the initial state and a quantity of ink equal to about one fifth of a volume of an ink chamber b are consumed. FIG. 35 shows the state that ink in the ink tank b is squeezed to the ink chamber a from the state shown in FIG. 34 due to reduction of the atmospheric pressure and elevation of the atmospheric temperature. A large part of the ink is absorbed in the ink absorbing member (polyurethane foamed block) F' having ink preliminarily impregnated therein but the other part of ink is not absorbed in the ink absorbing member (polyurethane foamed block) F' but flows along a gap between an ink tank wall 501*a* and the ink absorbing member (polyurethane foamed block) F' as well as a gap between an ink chamber wall 501*b* and the ink absorbing member (polyurethane foamed block) F' until it leaks outside of the ink tank 501 through an atmospheric air communication portion 503.

The foregoing problem of ink leakage is attributable to the fact that since the water absorbing ink absorbing member F' composed of a polyurethane foamed block exhibits a water repelling property also to ink, the surface state of a part of the ink absorbing member F' having ink once absorbed therein varies, enabling a certain quantity of ink to be absorbed therein again, but another part of the water absorbing ink absorbing member F' having no ink absorbed therein unchangeably maintains the water repelling property, resulting in an ink absorbing property of the ink absorbing member F' being degraded.

Figure 36:
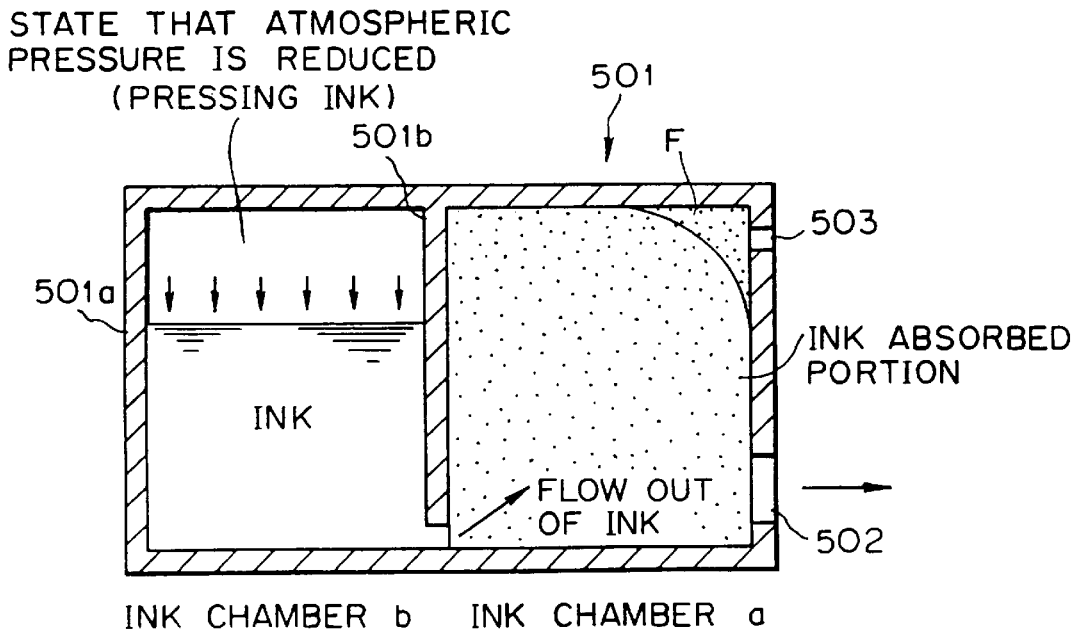
FIG. 36 is a schematic sectional view of the ink tank constructed according to the fifth embodiment of the present invention, showing how ink flows in the ink tank when an atmospheric pressure in the ink tank is reduced.

On the other hand, FIG. 36 shows how ink flows in the ink tank 501 at the time of a reduced atmospheric pressure in the case that a melamine foamed block F is used as an ink absorbing member.

In contrast with the polyurethane foamed block, the melamine foamed block F has an excellent hydrophilic property. For this reason, the ink flows from the ink chamber b is quickly absorbed in any part of the melamine foamed block F having no ink preliminarily absorbed therein. As is apparent from the drawing, ink absorption is gradually achieved from the communication portion between the ink chamber a and the ink chamber b toward the atmospheric air communication portion 503. Thus, the ink chamber a can fully be utilized as an ink buffer chamber.

Utilization of the ink tank 501 is finally terminated when the ink absorbed in the ink absorbing member accommodated in the ink chamber a is completely consumed. Subsequently, when the polyurethane foamed block and the melamine foamed block are compared with each other, a difference is recognized in respect of a quantity of remaining ink (i.e., a quantity of ink incapable of being used) therebetween. This is attributable to the fact that since no film is formed on the melamine foamed block after completion of a molding operation, there does not arise a malfunction that a certain quantity of ink remains in the ink absorbing member due to the formation of a film or the presence of a residue of the foamed block like the polyurethane foamed block after ink is consumed, resulting in the ink being fully consumed at a high efficiency.

In practical use, the melamine foamed block F having a pore size ranging from 100 $\mu$m to 800 $\mu$m was accommodated in the space of the ink tank 501 defined between the inner wall surface of the ink chamber wall 501*b* and the ink feeding portion 502 in the compressed state that the melamine foamed block F was compressed to an extent represented by a numeral of 1.1.

A series of reduced pressure tests were conducted by the inventors under a condition that the ink tank having the melamine foamed block F accommodated therein was mounted on an ink jet unit. It was confirmed as a result derived from the tests that the ink tank advantageously employable for the ink jet unit could be realized without any occurrence of ink leakage while maintaining a high quality of printed image.

Figure 37:
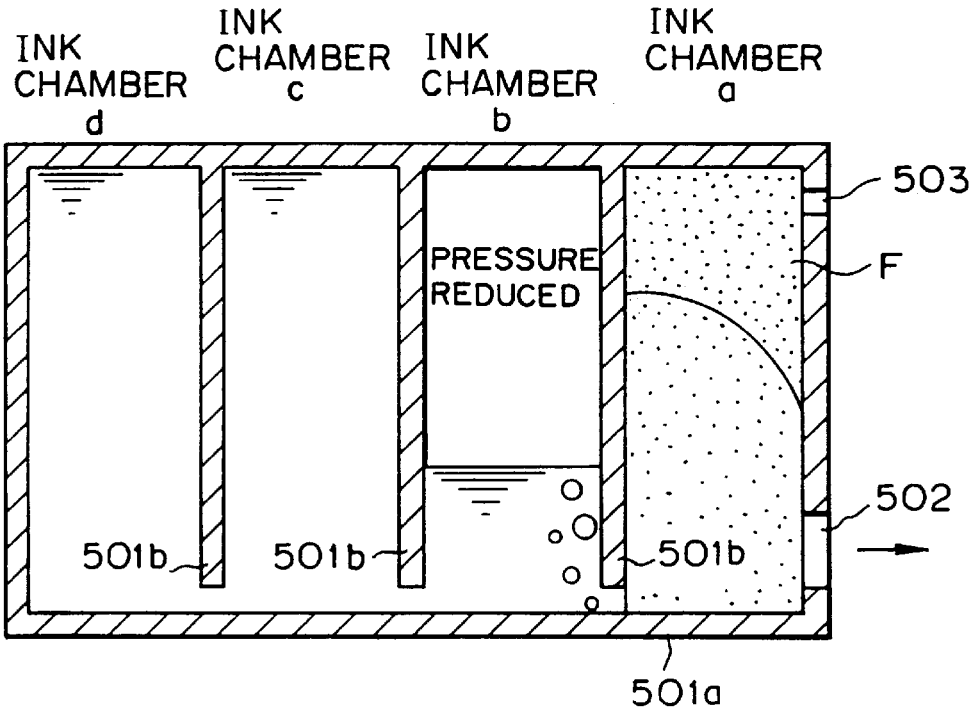
FIG. 37 is a schematic sectional view of an ink tank constructed according to an embodiment modified from the fifth embodiment of the present invention.
Figure 38:
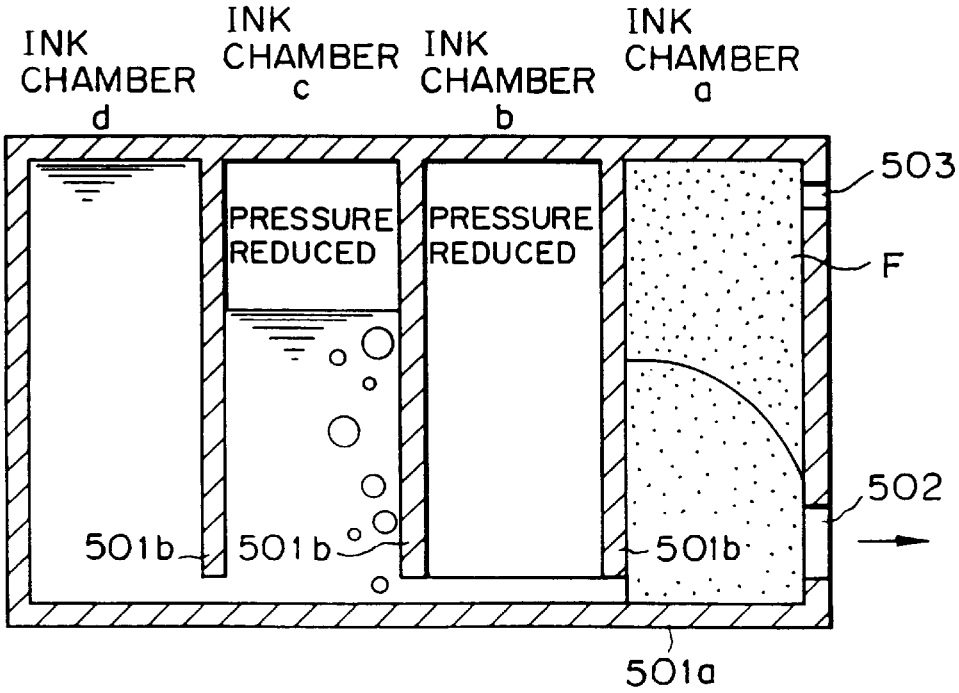
FIG. 38 is a schematic sectional view of an ink tank constructed according to another embodiment modified from the fifth embodiment of the present invention.

FIG. 37 and FIG. 38 are schematic ink absorbing memberal views each of which shows an ink tank constructed according to an embodiment modified from the fifth embodiment of the present invention, respectively. In each of these embodiments, two ink chambers c and d are additionally arranged in the ink tank while making communication with an ink chamber b. With this construction, ink is consumed in accordance with the order of the ink chamber b, the ink chamber c and the ink chamber d as seen from the right-hand side of each drawing. In these embodiments, the reason why the ink tank is divided into four ink chambers consists in preventing ink from leaking from the ink tank under the reduced pressure atmosphere when the atmospheric temperature varies. For example, in the case that atmospheric air in the ink chamber b and the ink tank chamber c is expanded while the state as shown in FIG. 38 is maintained, a quantity of expanded atmospheric air in the ink chamber b is released through the atmospheric air communicating portion 503 via the ink chamber a, and a quantity of expanded atmospheric air in the ink chamber c is released by flowing ink in the ink chamber b and the ink chamber a from the ink chamber c. In other words, the ink chamber a exhibits a function of serving as a buffer chamber, and therefore, it is acceptable that an ink retaining capacity of the ink absorbing capacity F accommodated in the ink chamber a in the compressed state is determined in consideration of a quantity of ink which leaks outside of the ink chamber a.

Also in this embodiment, it is obvious that an effect derived from the buffer chamber is maximized by using the melamine foamed block F for an ink absorbing member to be accommodated in the ink chamber a.

While the fifth embodiment of the present invention has been described above with respect to a monochromatic ink jet unit including a single ink jet head, it can equally be applied to a color ink jet unit including a plurality of ink jet heads each capable of ejecting an ink having a different color, e.g., four ink jet heads adapted to eject four kinds of inks having colors black, cyan, magenta and yellow. In addition, it can equally be applied to a single ink jet head which is designed to eject plural kinds of colors therefrom. In this case, it is recommendable that an exchangeable ink tank is additionally equipped with means for limitatively determining the position where the exchangeable ink tank is connected to the color ink jet unit as well as the direction of connecting the exchangeable ink tank to the color ink jet unit.

Further, while the fifth embodiment of the present invention has been described above with respect to the case that an ink tank can be exchanged with another one, it can equally be applied to an ink jet unit of the type including an ink jet head integrated with an ink tank having a predetermined quantity of ink filled therein.

(Modified Embodiment of the Fifth Embodiment)

Figure 39:
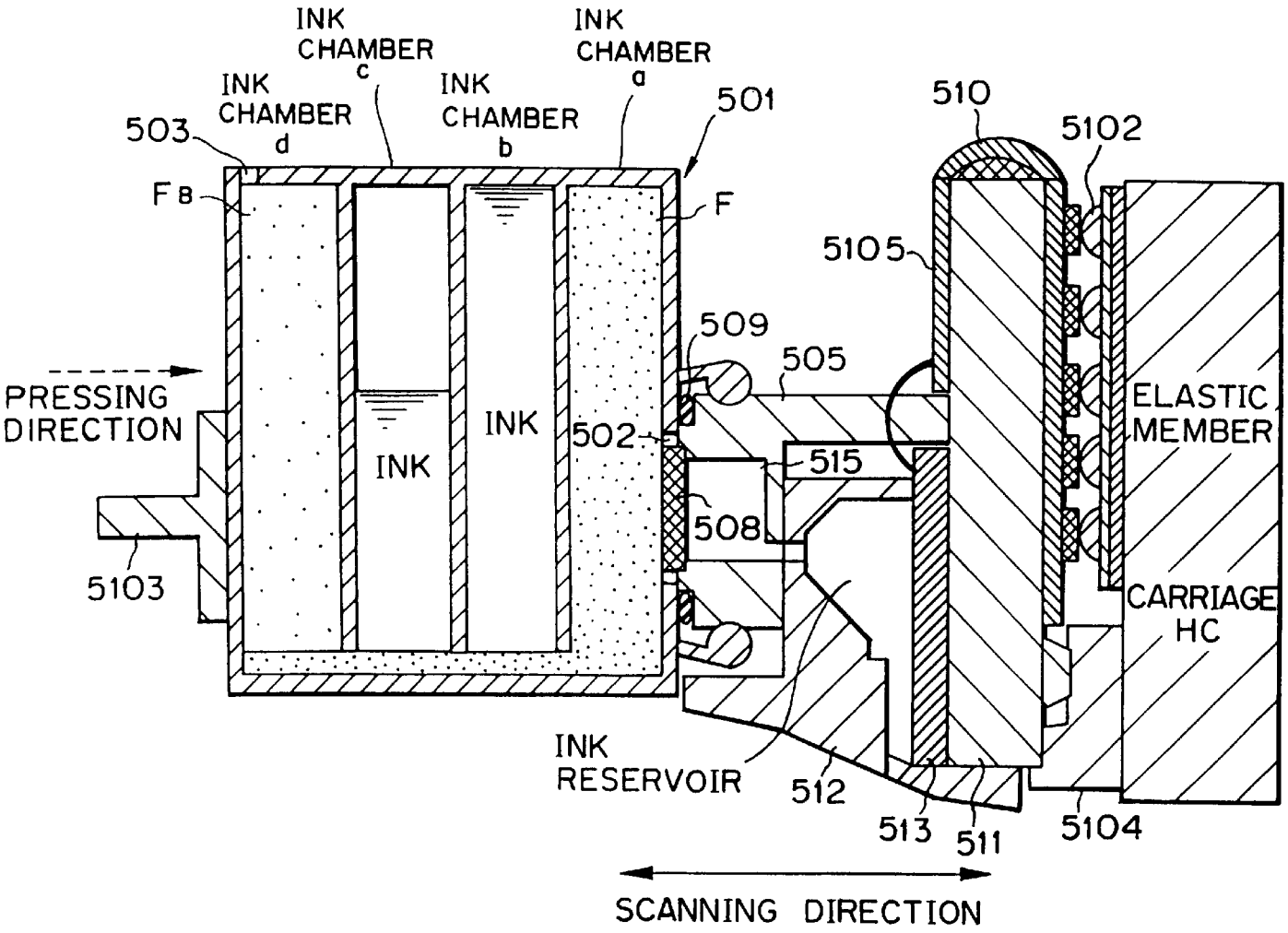
FIG. 39 is a schematic sectional view of a head cartridge for which an ink tank constructed according to a modified embodiment of the present invention is used, showing an initial state of the head cartridge.

FIG. 39 is a schematic ink absorbing memberal view of a head cartridge constructed according to an embodiment modified from the fifth embodiment of the present invention, particularly showing the function of an ink tank integrated with an ink jet head. An exchangeable ink tank 501 is divided into four ink chambers, i.e., an ink chamber a, an ink chamber b, an ink chamber c and an ink chamber d which are communicated with each other through apertures formed on the bottom thereof. An ink feeding portion 502 is disposed in the ink chamber a, an ink absorbing member F of which capillary force is adequately adjusted is accommodated in the ink chamber a and the communicating portion extending across the ink chambers b, c and d in the compressed state, and a buffer type ink absorbing member $F_B$ serving to prevent an occurrence of ink leakage is accommodated in the ink chamber d having an atmospheric air communicating portion 503 formed therethrough. In other words, the head carriage is constructed in the form of an improved type ink cartridge.

Figure 40:
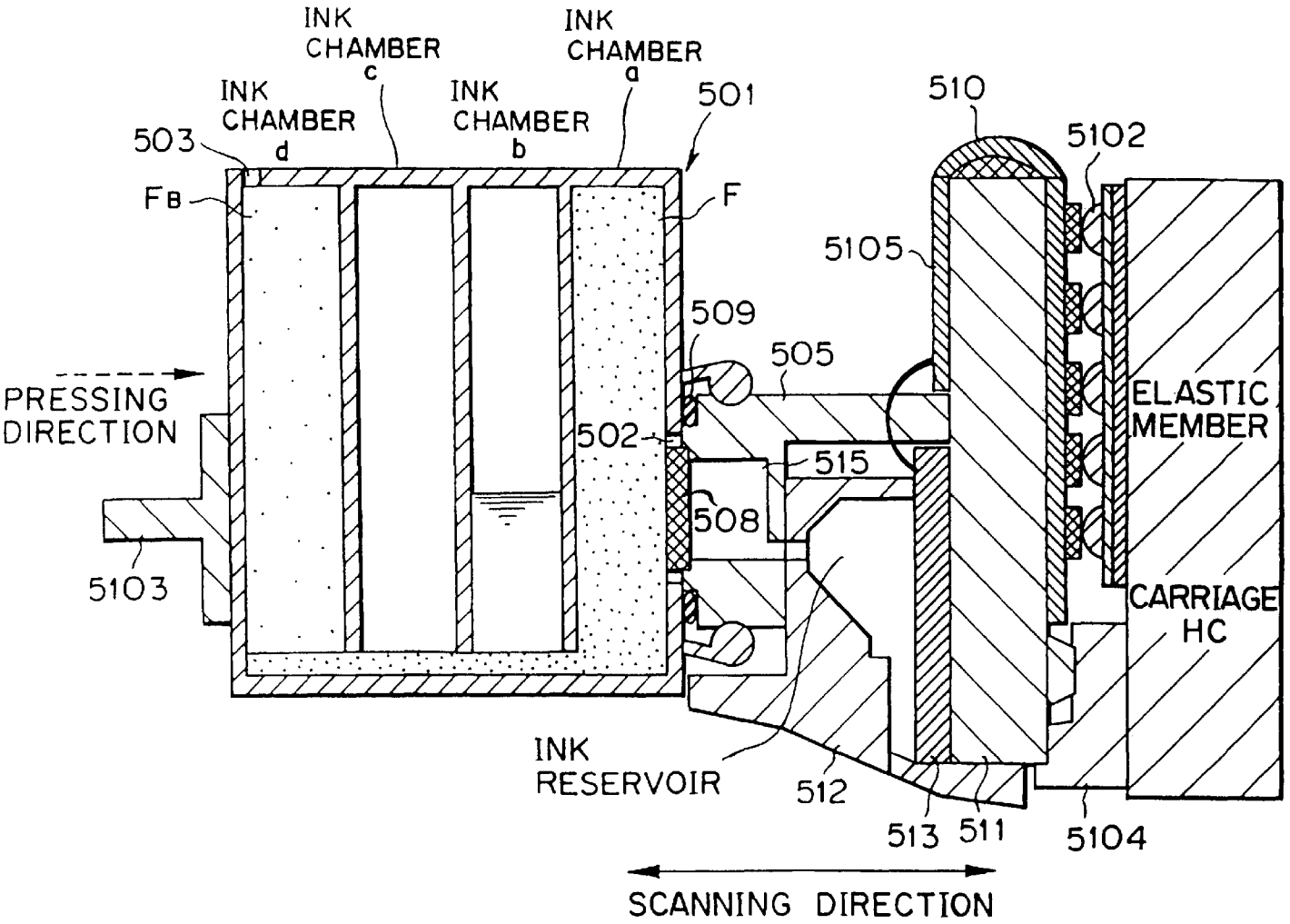
FIG. 40 is a schematic sectional view of the head cartridge shown in FIG. 39, showing an intermediate state of usage of the head cartridge.

The state of an ink tank 501 shown in FIG. 39 represents the operative state of the head cartridge that a quantity of ink equal to about a half of the volumetric capacity of the ink chamber c is consumed from the initial state that ink is sufficiently filled in the ink chamber a, the ink chamber b and the ink chamber c. When ink in the ink chamber c disappears as ink is consumed further, ink in the ink chamber b starts to be fed from the latter as shown in FIG. 40. Thereafter, when the ink in the ink chamber b disappears as ink is consumed further from the state shown in FIG. 40, ink retained in an ink absorbing member F accommodated in the ink chamber a starts to be fed from the latter. Subsequently, when the ink in the ink chamber a substantially disappears, the ink tank 501 is exchanged with a new one.

Figure 41:
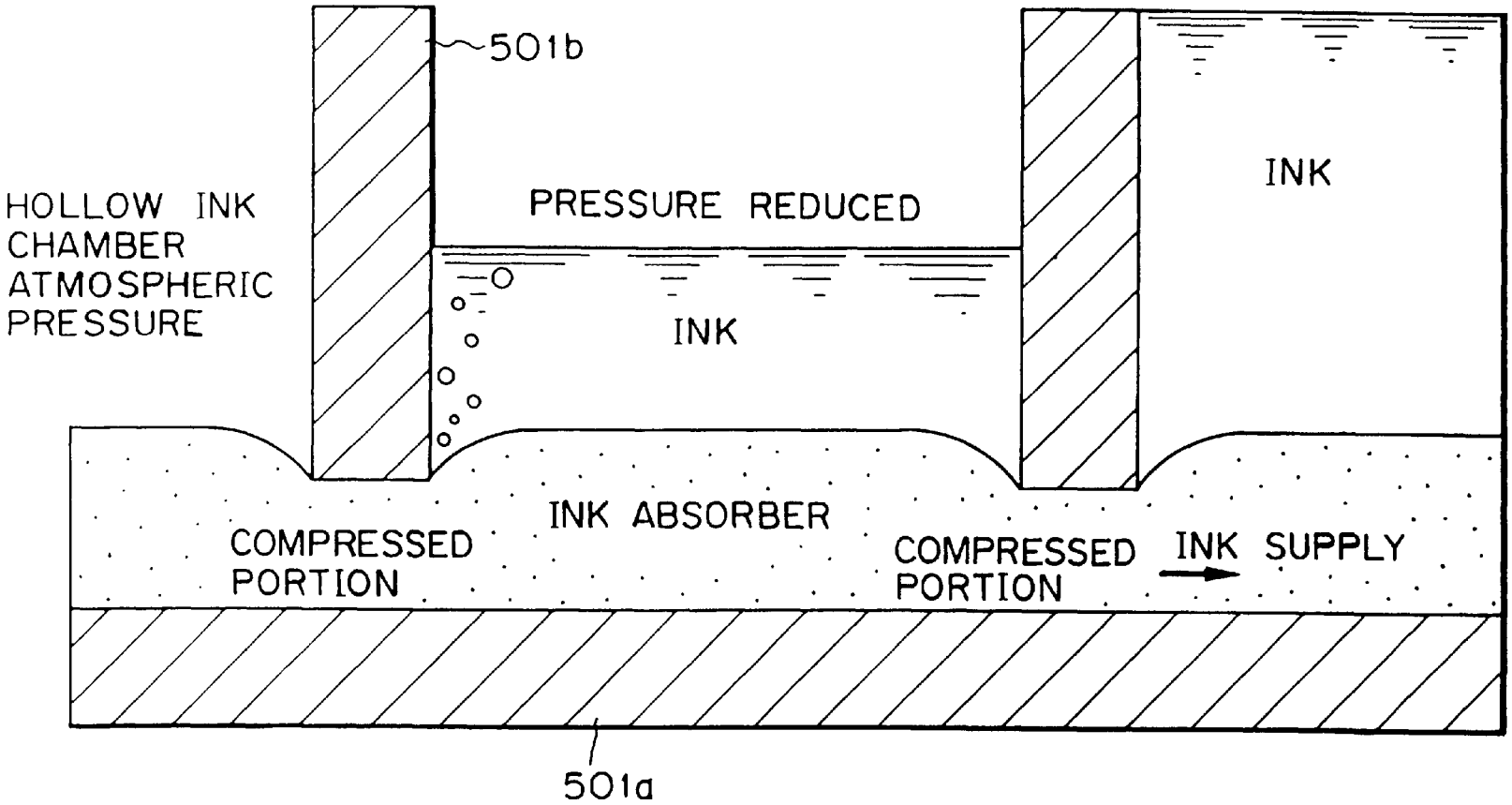
FIG. 41 is a schematic fragmentary enlarged sectional view of the head cartridge constructed according to the modified embodiment of the present invention, illustratively explaining a principle of ink feeding and generation of an inner pressure in the ink tank.

FIG. 41 is a schematic fragmentary enlarged ink absorbing memberal view of a head cartridge constructed according to an embodiment modified from the fifth embodiment of the present invention, particularly explaining a principle of ink feeding and generation of an inner pressure in an ink tank. Referring to FIG. 41, ink in the left-hand ink chamber is substantially consumed. At this time, since the left-hand ink chamber is communicated with an atmospheric air communication portion 503 by the function of a communicating portion between adjacent ink chambers, an atmospheric pressure is introduced into the left-hand ink chamber through the atmosphere air communicating portion 503. As ink is fed from the ink feeding portion 502 to the ink jet head side, ink flows from an ink chamber located adjacent to the left-hand ink chamber via the ink absorbing member F of which capillary force is intensified by the compression given by the communicating portion between adjacent ink chambers. As ink is consumed in each ink chamber, an intensity of pressure in the ink chamber is correspondingly reduced, whereby a meniscus formed over the ink absorbing member F compressed between adjacent ink chambers is partially broken, causing an atmospheric air to be introduced into the ink chamber in such a manner as to allow the reduced pressure in the ink chamber to be held in the balanced state relative to the meniscus retaining force of the compressed ink absorbing member. Thus, the inner pressure at the ink feeding portion 502 is maintained to assume a predetermined value by the capillary force of the compressed ink absorbing member located at the communicating portion between the adjacent ink chambers.

Figure 42:
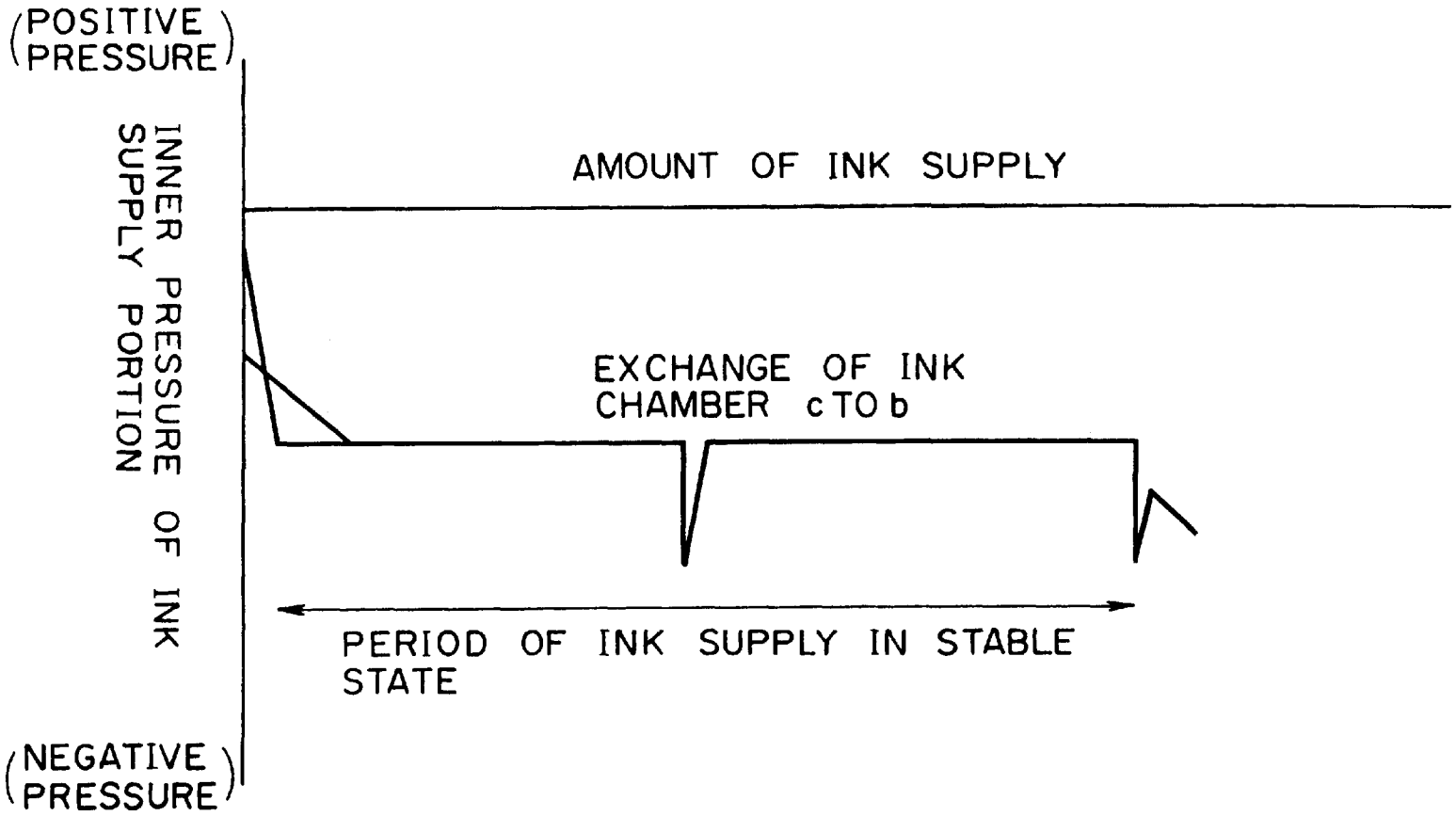
FIG. 42 is a graph which shows how an inner pressure of ink in an ink feeding portion of the head cartridge constructed according to the modified embodiment of the present invention varies.

FIG. 42 is a graph which shows how the inner pressure at the ink feeding portion of the exchangeable ink tank 501 constructed according to the modified embodiment of the present invention varies corresponding to a quantity of fed ink (i.e., a quantity of consumed ink). Although the inner pressure is generated by the capillary force given by the buffer type ink absorbing member $F_B$ or the ink absorbing member F, a certain intensity of inner pressure is generated by the capillary force given by a part of the compressed ink absorbing member (compressed part) located at the communicating portion between the ink chamber d and the ink chamber c as ink is fed from the ink feeding portion 502. As long as ink is fed from the ink chamber c, a substantially constant intensity of inner pressure is maintained. As ink is consumed further, ink in the ink chamber b starts to be fed, and the inner pressure at the ink feeding portion slightly varies every time the working ink tank is shifted to a subsequent one. It is considered that this is associated with the facts that while ink is continuously fed from the ink feeding portion 502, the inner pressure is measured and that the state of a reduced intensity of inner pressure in each of the ink chamber c and b temporarily appears. However, it has been confirmed by the inventors that no serious problem appears in respect to functional properties such as recording properties of a recording head or the like. When ink in the ink chamber b is stably consumed, the inner pressure at the ink feeding portion 502 is stabilized again. When the ink in the ink tank b is completely consumed, ink in the next ink chamber a starts to be fed (consumed) from the ink feeding portion 502. The inventors conducted a variety of examinations, and as a result derived from the examinations, they confirmed that a good printing operation could be performed without any particular problem during the period of stable ink feeding as shown in FIG. 42.

Figure 43:
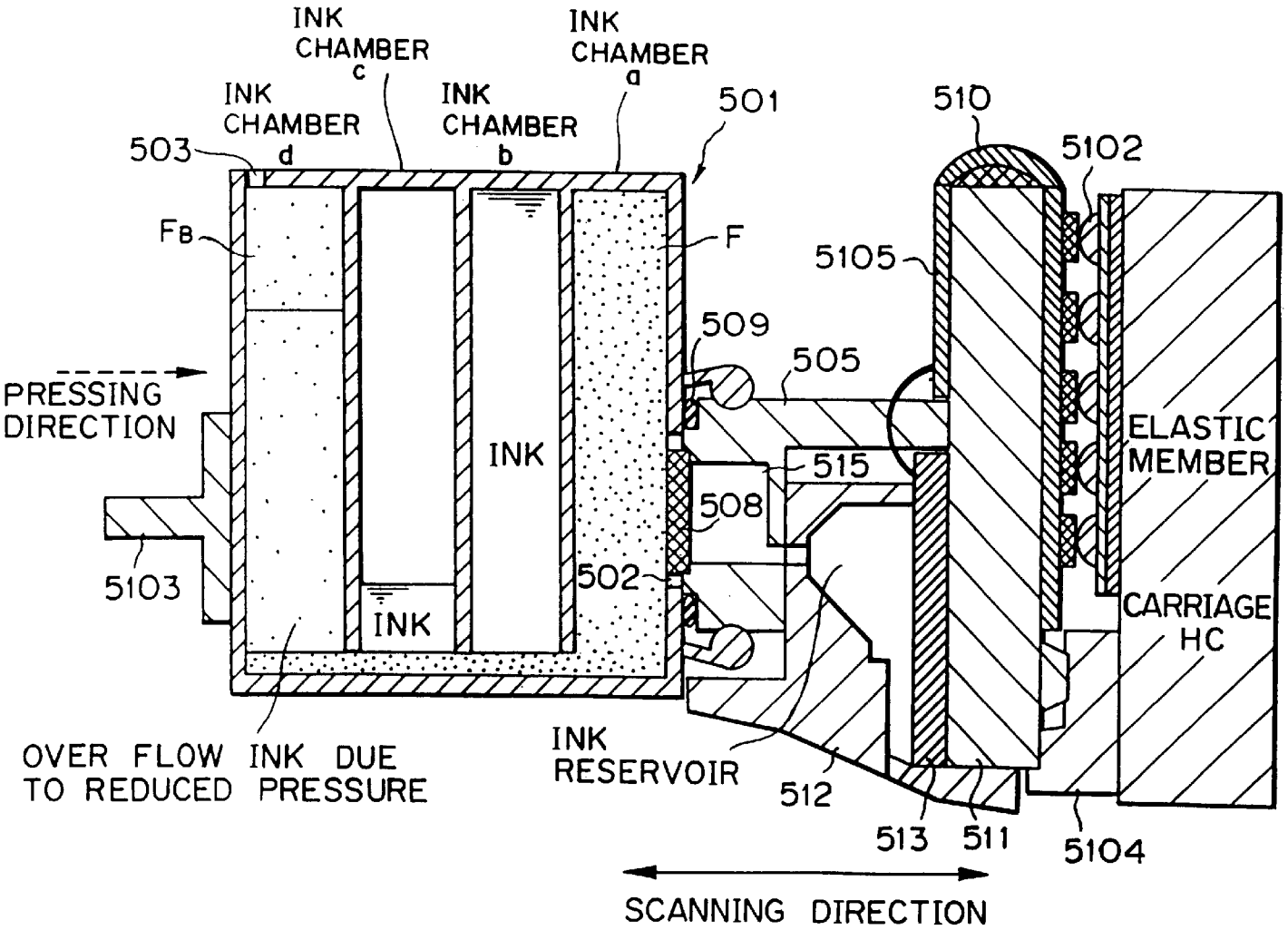
FIG. 43 is a schematic sectional view of a head cartridge constructed according to another embodiment modified from the fifth embodiment of the present invention, showing how a buffer type absorbing member in the ink tank functions.

FIG. 43 is a schematic ink absorbing memberal view of a head cartridge constructed according to another embodiment modified from the fifth embodiment of the present invention, particularly showing how a buffer type ink absorbing member function. Specifically, FIG. 43 shows how ink in the ink chamber c overflows from the latter due to expansion of the air in the ink chamber c induced by decrease of the atmospheric pressure or elevation of the atmospheric temperature. In this embodiment, the ink overflowed in the ink chamber d is retained in the buffer type ink absorbing member $F_B$. In view of the foregoing fact, it is acceptable that a quantity of ink to be absorbed in the buffer type ink absorbing member $F_B$ is determined in consideration of the fact that ink leaks from the ink chamber c by a quantity equal to at largest 30% of the volumetric capacity of the ink chamber c in the case that the atmospheric air has a reduced pressure of 0.7 at. When the atmospheric pressure is restored to the original level (corresponding to 1 at) before it is reduced, the ink overflowed in the ink chamber d and retained in the buffer type ink absorbing member $F_B$ returns to the ink tank c again. The aforementioned phenomenon likewise equally appears also in the case that the temperature of the ink tank varies. For example, when the temperature of the ink tank is elevated by about 50° C., a quantity of ink leaked from the ink chamber c is smaller than that at the time of pressure reduction.

Also in this case, it is considered that it is acceptable that an ink buffer is designed in consideration of a maximum quantity of leaked ink. In this connection, the inventors conducted a series of reduced pressure tests, and as a result derived from the reduced pressure tests, it was confirmed by them that a problem of ink leakage arose with some ink tanks each having a polyurethane foamed block used for a buffer type ink absorbing member but the same problem of ink leakage as mentioned above did not arise with an ink tank having a melamine foamed block having an excellent hydrophilic property used as a buffer type ink absorbing member.

As described above, according to the fifth embodiment of the present invention, a foamed block molded of a condensate composed of a compound having an amino group and a formaldehyde is used as a base material for an ink tank cartridge including an ink chamber having an ink feeding portion disposed therein and one or a plurality of ink chambers communicated with the first-mentioned ink chamber having an ink absorbing member accommodated therein of which capillary force is adequately adjusted, and the ink absorbing member accommodated in the first-mentioned ink chamber has a porous three-dimensional net-shaped structure and ink is storably filled in each of the last-mentioned ink tanks. With this construction, any ink leakage does not occur with the ink tank cartridge irrespective of variation of the working environment of the ink jet unit not only when a printing operation is performed but also when no printing operation is performed with the ink jet unit. Consequently, the ink tank cartridge having a high ink consumption efficiency and an excellent quality of printed image can be realized according to the present invention.

Figure 44:
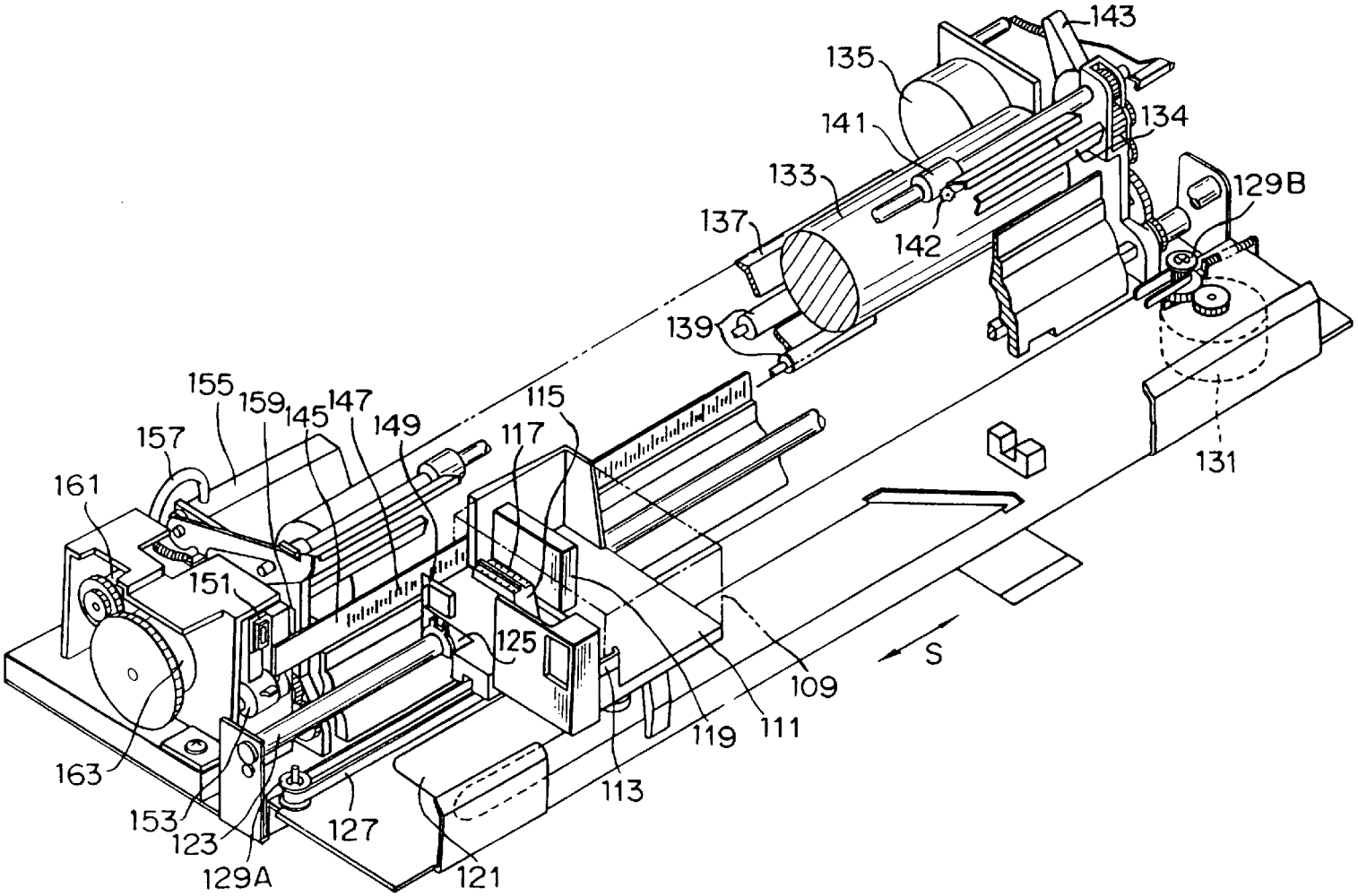
FIG. 44 is a perspective view of an ink jet printing apparatus adapted to perform a printing operation using the head cartridge constructed according to each of several preferred embodiments of the present invention as mentioned above.

FIG. 44 is a perspective view of an ink jet printing apparatus adapted to perform a printing operation using a head cartridge constructed according to each of the embodiments and the modified embodiments of the present invention as mentioned above.

In the drawing reference numeral 109 designates a head cartridge including an ink tank and a printing head integrated with each other, and reference numeral 111 designates a carriage having the head cartridge 109 mounted thereon to perform a scanning operation in the S arrow-marked direction. Reference numeral 113 designates a hook for securing the head cartridge 109 to the carriage 111, and reference numeral 115 designates a lever for actuating the hook 113. A plurality of markers 117 are impressed on the lever 115 for enabling the position where a printing operation is performed with the printing head at present and the position where the lever 115 has been actuated to be visually read by a user based on a plurality of calibrations recessed on a cover (not shown) for the ink jet printing apparatus. Reference numeral 119 designates a support plate for supporting electrical connecting portions to be electrically connected to the head cartridge 109, and reference numeral 121 designates a flexible cable for electrically connecting the electrical connecting portions to a main controlling ink absorbing member for the ink jet recording apparatus.

Reference numeral 123 designates a guide shaft for guiding the reciprocable displacement of the carriage 111 in the S arrow-marked direction. The guide shaft 123 is inserted through a bearing 125 of the carriage 111. Reference numeral 127 designates an endless timing belt fixedly secured to the carriage 111 for transmitting a power required for reciprocably displacing the carriage 111 in the S arrow-marked direction. The timing belt 127 is spanned between a pair of pulleys 129A and 129B disposed on the opposite sides of the ink jet printing apparatus. A certain intensity of driving power is transmitted from a carriage motor 131 to the right-hand pulley 129B via a power transmitting mechanism including gears and others.

Reference numeral 133 designates a conveyance roller for conveying a printing medium such as a paper or the like while restrictively defining a printing plane of the printing medium. The conveyance roller 133 is rotationally driven by a conveyance motor 135. Reference numeral 137 designates a paper pan for bringing the printing medium to the printing position from the paper feeding tray 104 side, and reference numeral 139 designates a feed roller disposed at the intermediate position located on a feeding path for the printing medium for conveying the printing paper while thrusting the latter against the conveyance rollers 133. Reference numeral 134 designates a platen located opposite to an ink ejecting port of the head cartridge 109 for restrictively defining the printing plane of the printing medium, and reference numeral 141 designates a paper discharging roller disposed at the position located downstream of the printing position as seen in the printing medium conveying direction for discharging the printing medium toward a paper discharging port (not shown). Reference numeral 142 designates a pulley disposed opposite to the paper discharging roller 141 for generating a conveying power required for conveying the printing medium in cooperation with the paper discharging roller 141 while thrusting the latter via the printing medium, and reference numeral 143 designates a releasing lever for releasing the feed roller 139, a retaining plate 145 and the pulley 142 from the thrusted state.

Reference numeral 145 designates a retaining plate disposed for suppressively preventing the printing medium from being floated up at the position located in the printing position. In the shown case, a printing head adapted to perform a printing operation by ejecting ink is employed for the ink jet printing apparatus. Thus, a distance between the ink ejecting port forming plane of the printing head and the printing plane of the printing medium is comparatively small, and moreover, since the foregoing distance should strictly be controlled in order to preventing the printing medium from coming in contact with the ink ejecting port forming plane, it is advantageously acceptable that the retaining plate 145 is disposed in the above-described manner. Reference numeral 147 designates a series of calibrations impressed on the retaining plate 145, and reference numeral 149 designates a marker formed on the carriage 111 to correspond to one of the calibrations 147. With this construction, the position where each printing operation is performed with the printing head and the position where the printing head is mounted for the ink jet printing apparatus can visually be read by a user with the aid of the calibrations 147 and the marker 149.

Reference numeral 151 designates a cap disposed opposite to the ink ejecting port forming plane of the printing head. The cap 151 is molded of an elastic material such as a rubber or the like, and it is supported in such a manner as to enable it to be brought in contact with the ink ejecting port on the printing head and then released from the contact state relative to the printing head. The cap 151 is used for the purpose of protecting the printing head from damage or injury or allowing the printing head to be subjected to suction recovering treatment when no printing operation is performed with the printing head. The suction recovering treatment represents a treatment to be executed in such a manner that the cap 151 is located opposite to the ink ejecting port forming plane of the printing head and ink is then ejected from the ink ejecting port by activating the energy generating element disposed inside of the ink ejecting port for generating energy to be utilized for the purpose of ink ejection whereby a factor of causing incorrect ink ejection due to the presence of bubbles, dust particles or ink having an increased viscosity unsuitably employable for each printing operation is eliminated. In addition, the suction recovering treatment represents another treatment to be executed in such a manner that a factor of causing incorrect ink ejection is eliminated by forcibly ejecting ink from the ink ejecting port while the ink ejecting plane of the printing head is covered with the cap 151.

Reference numeral 153 designates a pump for allowing a suction force effective for forcibly ejecting ink from the ink ejecting port to be applied to the printing head, and moreover, sucking the extra ink received in the cap 151 for executing suction recovering treatment subsequent to the forcible ink ejection or suction recovering treatment subsequent to preliminary ink ejection. Reference numeral 155 designates a waste ink tank in which waste ink sucked by the pump 153 is storably received, and reference numeral 157 designates a tube for making communication between the pump 153 and the waste ink tank 155.

Reference numeral 159 designates a blade for wiping the ink ejecting port forming plate of the printing head. The blade 159 is supported in such a manner as to be displaced to the position where a wiping operation is performed in the course of displacement of the printing head while the blade 159 is projected toward the printing head side as well as the position where the blade 159 is retracted away from the ink ejecting port forming plane of the printing head without any contact with the latter. Reference numeral 161 designates a motor, and reference numeral 163 designates a cam assembly for driving the pump 153 and displacing the cap 151 and the blade 159 with the driving power transmitted from the motor 161.

The first and second embodiments of the present invention have been described above with respect to the case where the ink feeding portion is disposed at the central part on a predetermined side wall of the ink tank housing. However, it is obvious that the present invention should not be applied only to the foregoing type of ink tank.

Specifically, in the case that the ink feeding portion is disposed at the position deviated from the foregoing central part of the predetermined side wall of the ink tank housing, the foamed block may slantwise be compressed toward the ink feeding portion on the assumption that the relationship between a contour of each of the foamed block and the housing and dimensions each defining the same is adequately determined. Alternatively, the foamed block may be compressed toward the ink feeding portion in conformity with the extension of an ink path in the ink absorbing member.

What is claimed is:

1. An ink tank separably connected to an ink jet head of an ink jet printing apparatus, said ink tank comprising:

a first chamber having a negative pressure generation member accommodated therein and including a liquid supplying portion for supplying liquid to the ink jet head and an atmospheric air communicating portion communicating with atmospheric air, said negative pressure generation member being accommodated in said first chamber;

a second chamber communicating with said first chamber through a communication portion disposed apart from said atmospheric air communicating portion, said second chamber retaining liquid for supply to said first chamber and being substantially sealed except at said communication portion; and a partition wall defining said communication portion and separating said first and said second chambers from each other, wherein said negative pressure generation member is a porous member which has a three-dimensional net-shaped structure and is molded of a condensate composed of a compound having an amino group and a formaldehyde, and wherein, during supply of the liquid to the first chamber, an interface between air and the liquid is located in a region of said negative pressure generation member between said communication portion and said atmospheric air communicating portion, and a region of said negative pressure generation member between said interface and said air communicating portion is used as a buffer region.

2. An ink tank as claimed in claim 1, wherein said ink tank is separable from a printing head so as to enable it be exchanged another one.

3. An ink tank as claimed in claim 1, wherein the ink jet head is driven at a frequency of at least 3 KHz.

4. A head cartridge, comprising:

an ink tank including a first chamber having a negative pressure generation member accommodated therein and including a liquid supplying portion for supplying liquid to an ink jet printing head and an atmospheric air communicating portion communicating with atmospheric air, said negative pressure generation member being accommodated in said first chamber, a second chamber communicating with said first chamber through a communication portion disposed apart from said atmospheric air communicating portion, said second chamber retaining liquid for supply to said first chamber and being substantially sealed except at said communication portion, and a partition wall defining said communication portion and separating said first and said second chambers from each other, wherein said negative pressure generation member is a porous member which has a three-dimensional net-shaped structure and is molded of a condensate composed of a compound having an amino group and a formaldehyde, wherein, during supply of the liquid to the first chamber, an interface between air and the liquid is located in a region of said negative pressure generation member between said communication portion and said atmospheric air communicating portion, and a region of said negative pressure generation member between said interface and said air communicating portion is used as a buffer region; and said printing head, said printing head allowing ink to be fed from said ink tank and then ejecting the fed ink therefrom.

5. A head cartridge as claimed in claim 4, wherein said printing head includes an energy generating element for generating energy to be utilized for the purpose of ink ejection.

6. A head cartridge as claimed in claim 5, wherein said printing head includes an electrothermal converting element for generating thermal energy required for generating a bubble in said ink, said electrothermal converting element serving as said energy generating element.

7. A head cartridge as claimed in claim 4, wherein the ink jet head is driven at a frequency of at least 3 KHz.

8. An ink jet printing apparatus, comprising:

a head cartridge including an ink tank including a first chamber having a negative pressure generation member accommodated therein and including a liquid supplying portion for supplying liquid to an ink jet printing head and an atmospheric air communicating portion communicating with atmospheric air, said negative pressure generation member being accommodated in said first chamber, a second chamber communicating with said first chamber through a communication portion disposed apart from said atmospheric air communicating portion, said second chamber retaining liquid for supply to said first chamber and being substantially sealed except at said communication portion, and a partition wall defining said communication portion and separating said first and said second chambers from each other, wherein said negative pressure generation member is a porous member which has a three-dimensional net-shaped structure and is molded of a condensate composed of a compound having an amino group and a formaldehyde, and wherein, during supply of the liquid to the first chamber, an interface between air and the liquid is located in a region of said negative pressure generation member between said communication portion and said atmospheric air communicating portion, and a region of said negative pressure generation member between said interface and said air communicating portion is used as a buffer region, said printing head allowing ink to be fed from said ink tank and then ejecting the fed ink therefrom, and wherein said printing head includes an energy generating element for generating energy to be utilized for the purpose of ink ejection, said printing head includes an electrothermal converting element for generating thermal energy required for generating a bubble in said ink, said electrothermal converting element serving as said energy generating element, and said printing head is detachably mounted on said ink jet printing apparatus.

9. An ink jet printing apparatus as claimed in claim 8, wherein the ink jet head is driven at a frequency of at least 3 KHz.

* * * * *

UNITED STATES PATENT AND TRADEMARK OFFICE

CERTIFICATE OF CORRECTION

PATENT NO. : 6,109,742
DATED : August 29, 2000
INVENTOR(S) : Higuma et al.

It is certified that error appears in the above-identified patent and that said Letters Patent is hereby corrected as shown below:

Title page,
Item [30], Foreign Application Priority Data, "May 13, 1993 [JP] Japan……..5-350238" should read -- December 2, 1993 [JP] Japan…… 5-350238 --.
Item [56], *Attorney, Agent, or Firm,* "Fitzpatrcik, Cella, Harper & Scinto" should read -- Fitzpatrick, Cella, Harper & Scinto --.

Column 1,
Line 36, "can not" should read -- cannot --.

Column 2,
Line 2, "can not" should read -- cannot --.

Column 3,
Line 38, "can not" should read -- cannot --; and
Line 55, "is" should read -- are --.

Column 4,
Line 31, "can" should read -- can be --.

Column 7,
Line 60, "object, " should read -- objects, --.

Column 8,
Line 1, "an" should read -- a --.

Column 9,
Line 38, "firth" should read -- fifth --.

Column 11,
Line 19, "can not" should read -- cannot --.

Column 13,
Line 41, "can not" should read -- cannot --;
Line 42, "can not" should read -- cannot --;
Line 47, "can not" should read -- cannot --; and
Line 57, "am-de," should read -- amide --.

Column 15,
Line 24, "thaws" should read -- that --.

UNITED STATES PATENT AND TRADEMARK OFFICE

CERTIFICATE OF CORRECTION

PATENT NO. : 6,109,742
DATED : August 29, 2000
INVENTOR(S) : Higuma et al.

It is certified that error appears in the above-identified patent and that said Letters Patent is hereby corrected as shown below:

Column 20,
Line 46, "EL" should read -- a --.

Column 23,
Line 39, "can not" should read -- cannot --.

Column 26,
Line 7, "can not" should read -- cannot --.

Column 27,
Line 5, "to" (first occurrence) should read -- the --.

Column 28,
Line 46, "umpingement" should read -- impingement --.

Column 29,
Line 14, "unpinging" should read -- impinging --.

Column 35,
Line 52, "$\eta/(\pm \cos \theta)$" should read -- $\eta/(\gamma \cos \theta)$ --.

Column 39,
Line 59, "function." should read -- functions. --.

Column 43,
Line 31, "exchanged" should read -- exchanged for --.

Signed and Sealed this

Twenty-fifth Day of June, 2002

*Attest:*

*Attesting Officer*

JAMES E. ROGAN
*Director of the United States Patent and Trademark Office*